US008967553B2

(12) United States Patent
Asuka et al.

(10) Patent No.: US 8,967,553 B2
(45) Date of Patent: Mar. 3, 2015

(54) TRAIN OPERATION CONTROL SYSTEM

(75) Inventors: Masashi Asuka, Tokyo (JP); Satoru Takahashi, Tokyo (JP); Koki Yoshimoto, Tokyo (JP); Atsushi Takami, Tokyo (JP); Yusaku Nagasaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/116,255

(22) PCT Filed: Nov. 15, 2011

(86) PCT No.: PCT/JP2011/076285

§ 371 (c)(1),
(2), (4) Date: Nov. 7, 2013

(87) PCT Pub. No.: WO2012/176348

PCT Pub. Date: Dec. 27, 2012

(65) Prior Publication Data

US 2014/0103166 A1 Apr. 17, 2014

(30) Foreign Application Priority Data

Jun. 23, 2011 (JP) ..... 2011-139275

(51) Int. Cl.
*B61L 27/00* (2006.01)
*B61L 23/24* (2006.01)

(52) U.S. Cl.
CPC ..... *B61L 27/0011* (2013.01); *B61L 23/24* (2013.01)
USPC ..... 246/4; 246/167 R

(58) Field of Classification Search
CPC ..... B61L 27/0011; B61L 23/24
USPC ..... 246/3, 4, 167 R, 175, 176
See application file for complete search history.

(56) References Cited

U.S. PATENT DOCUMENTS 3,251,991 A * 5/1966 Coley et al. ..... 246/182 A
3,260,842 A * 7/1966 Davison et al. ..... 246/4

(Continued)

FOREIGN PATENT DOCUMENTS

JP 61 108054 5/1986
JP 5 131931 5/1993

(Continued)

OTHER PUBLICATIONS

Kuroiwa, A., et al., "Practical Application of ATACS in Senseki Line", JR East Techincal Review, vol. 28, No. 28, pp. 41-46, (2009).

(Continued)

*Primary Examiner* — Jason C Smith
(74) *Attorney, Agent, or Firm* — Oblon, McClelland, Maier & Neustadt, L.L.P.

(57) ABSTRACT

In accordance with a predetermined segment definition rule based on a point-switch protection section, a point switch control direction, and a train advancing direction, a plurality of segments are defined in advance with respect to a railway network. Segment competition information in which a competitive relationship between the plurality of segments is set in advance is prepared. A segment use permission setting part determines whether or not a competition for a use-requested segment in terms of a train operation occurs between the plurality of trains, by using segment competition information and segment use permission status information. A use-requested segment for which it is determined that no competition occurs is incorporated, as a use permission segment, into use permission segment information of the corresponding train. In accordance with a result of the competition determination, the segment use permission status information is updated.

10 Claims, 37 Drawing Sheets

(56) References Cited

U.S. PATENT DOCUMENTS

| | | | | |
|---|---|---|---|---|
| 3,810,099 | A * | 5/1974 | Woods | 246/4 |
| 4,858,859 | A * | 8/1989 | Apperson | 246/20 |
| 5,487,516 | A * | 1/1996 | Murata et al. | 246/182 C |
| 5,921,185 | A * | 7/1999 | Hoyon et al. | 105/4.1 |
| 5,943,962 | A * | 8/1999 | Birkhahn et al. | 105/199.2 |
| 6,131,520 | A * | 10/2000 | Dull | 105/199.2 |
| 6,246,956 | B1 | 6/2001 | Miyoshi et al. | |
| 6,273,002 | B1 * | 8/2001 | Hachmann et al. | 105/199.1 |
| 6,279,488 | B1 * | 8/2001 | Hachmann et al. | 105/453 |
| 6,474,455 | B1 * | 11/2002 | Blaschko et al. | 191/45 R |
| 6,978,719 | B2 * | 12/2005 | Sebata et al. | 105/199.1 |
| 7,210,656 | B2 * | 5/2007 | Wolf et al | 246/4 |
| 8,702,043 | B2 * | 4/2014 | Daum et al. | 246/186 |
| 2002/0035947 | A1 * | 3/2002 | Sebata et al. | 105/199.2 |
| 2006/0212184 | A1 * | 9/2006 | Philp et al. | 701/19 |
| 2011/0184619 | A1 * | 7/2011 | Kamata et al. | 701/70 |
| 2013/0325258 | A1 * | 12/2013 | Cooper et al. | 701/36 |
| 2014/0088802 | A1 * | 3/2014 | Knollmann et al. | 701/20 |
| 2014/0103166 | A1 * | 4/2014 | Asuka et al. | 246/4 |

FOREIGN PATENT DOCUMENTS

| | | |
|---|---|---|
| JP | 2000 108903 | 4/2000 |
| JP | 2003 81090 | 3/2003 |
| JP | 2003 220950 | 8/2003 |
| JP | 2003 261028 | 9/2003 |
| JP | 2009 83628 | 4/2009 |

OTHER PUBLICATIONS

International Search Report Issued Jan. 31, 2012 in PCT/JP11/076285 Filed Nov. 15, 2011.

International Preliminary Report on Patentability and Written Opinion issued Jan. 9, 2014 in PCT/JP2011/076285 (with English language translation).

* cited by examiner

F I G . 1
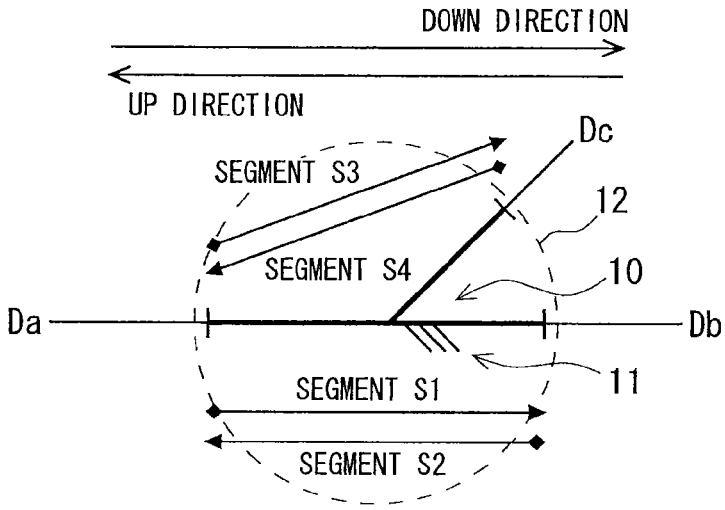
F I G . 2
| SEGMENT | POINT-SWITCH CONTROL DIRECTION | TRAIN ADVANCING DIRECTION |
|---|---|---|
| S1 | NORMAL | DOWN |
| S2 | NORMAL | UP |
| S3 | REVERSE | DOWN |
| S4 | REVERSE | UP |
F I G . 3
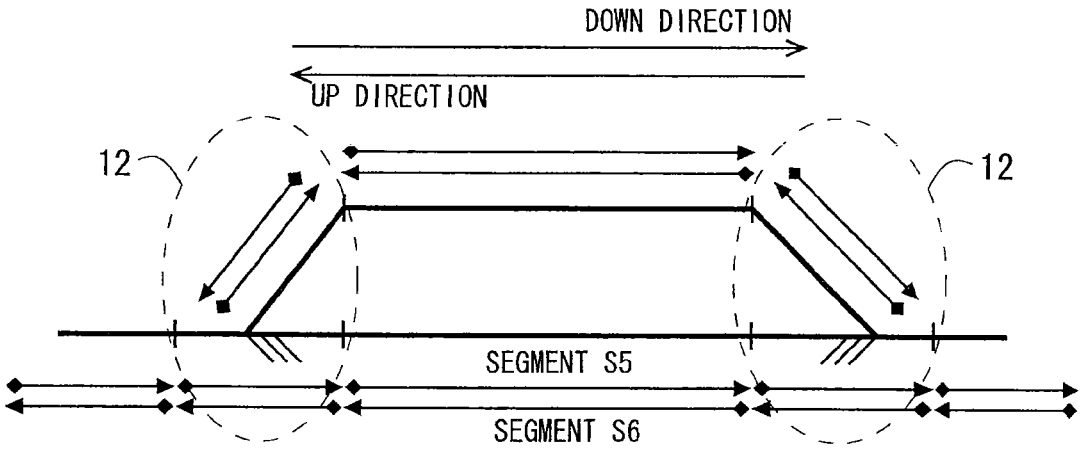

| SEGMENT | TRAIN ADVANCING DIRECTION |
|---|---|
| S5 | DOWN |
| S6 | UP |

F I G . 6

| SEGMENT | S0001 | S0102 | S0203 | S0402 | S0204 | S0205 | S0502 | S0406 | S0604 | S0507 | S0705 |
|---|---|---|---|---|---|---|---|---|---|---|---|
| S0001 | ○ | — | — | — | — | — | — | — | — | — | — |
| S0102 | ○ | ○ | — | — | — | — | — | — | — | — | — |
| S0203 | ○ | × | ○ | — | — | — | — | — | — | — | — |
| S0402 | ○ | ○ | ○ | ○ | — | — | — | — | — | — | — |
| S0204 | ○ | ○ | ○ | × | ○ | — | — | — | — | — | — |
| S0205 | ○ | ○ | ○ | × | × | ○ | — | — | — | — | — |
| S0502 | ○ | ○ | ○ | × | × | × | ○ | — | — | — | — |
| S0406 | ○ | ○ | ○ | ○ | ○ | ○ | ○ | ○ | — | — | — |
| S0604 | ○ | ○ | ○ | ○ | ○ | ○ | ○ | × | ○ | — | — |
| S0507 | ○ | ○ | ○ | ○ | ○ | ○ | ○ | ○ | ○ | ○ | — |
| S0705 | ○ | ○ | ○ | ○ | ○ | ○ | ○ | ○ | ○ | × | ○ |

FIG. 10

222

| SEGMENT | S11 | S12 | S13 | | |
|---|---|---|---|---|---|
| TYPE | EXIST | NOT EXIST | NOT EXIST | | |

404

| SEGMENT | TRAIN PERMITTED TO USE SEGMENT (TRAIN ID) | | | |
|---|---|---|---|---|
| S21 | T2 | | | |
| S22 | T1(EXIST ON TRACK) | T2 | | |
| S23 | T3 | | | |
| S25 | | | | |
| S26 | | | | |
| S27 | | | | |

FIG. 22

| SEGMENT | S0001a | S0001b | S0102 | S0203 | S0402 | S0204 | S0205 | S0502 | S0406a | S0406b | S0604a | S0604b | S0507a | S0507b | S0705a | S0705b |
|---|---|---|---|---|---|---|---|---|---|---|---|---|---|---|---|---|
| S0001a | × | — | — | — | — | — | — | — | — | — | — | — | — | — | — | — |
| S0001b | ○ | × | — | — | — | — | — | — | — | — | — | — | — | — | — | — |
| S0102 | ○ | ○ | × | — | — | — | — | — | — | — | — | — | — | — | — | — |
| S0203 | ○ | ○ | × | × | — | — | — | — | — | — | — | — | — | — | — | — |
| S0402 | ○ | ○ | ○ | ○ | × | — | — | — | — | — | — | — | — | — | — | — |
| S0204 | ○ | ○ | ○ | ○ | × | × | — | — | — | — | — | — | — | — | — | — |
| S0205 | ○ | ○ | ○ | ○ | × | × | × | — | — | — | — | — | — | — | — | — |
| S0502 | ○ | ○ | ○ | ○ | × | × | × | × | — | — | — | — | — | — | — | — |
| S0406a | ○ | ○ | ○ | ○ | ○ | ○ | ○ | ○ | × | — | — | — | — | — | — | — |
| S0406b | ○ | ○ | ○ | ○ | ○ | ○ | ○ | ○ | ○ | × | — | — | — | — | — | — |
| S0604a | ○ | ○ | ○ | ○ | ○ | ○ | ○ | ○ | × | ○ | × | — | — | — | — | — |
| S0604b | ○ | ○ | ○ | ○ | ○ | ○ | ○ | ○ | ○ | × | ○ | × | — | — | — | — |
| S0507a | ○ | ○ | ○ | ○ | ○ | ○ | ○ | ○ | ○ | ○ | ○ | ○ | × | — | — | — |
| S0507b | ○ | ○ | ○ | ○ | ○ | ○ | ○ | ○ | ○ | ○ | ○ | ○ | ○ | × | — | — |
| S0705a | ○ | ○ | ○ | ○ | ○ | ○ | ○ | ○ | ○ | ○ | ○ | ○ | × | ○ | × | — |
| S0705b | ○ | ○ | ○ | ○ | ○ | ○ | ○ | ○ | ○ | ○ | ○ | ○ | ○ | × | ○ | × |

FIG. 27

| SEGMENT STRING | TYPE | SEGMENT | | | | |
|---|---|---|---|---|---|---|
| R0001 | INSIDE | S0102 | S0205 | S0507 | | |
| R0002 | INSIDE | S0102 | S0204 | S0406 | | |
| R0101 | DEPARTURE | S0705 | S0502 | S0203 | | |
| R0102 | DEPARTURE | S0604 | S0402 | S0203 | | |

FIG. 28

902

| SEGMENT STRING | R0001 | R0002 | R0101 | R0102 |
|---|---|---|---|---|
| R0001 | ○ | — | — | — |
| R0002 | ○ | ○ | — | — |
| R0101 | × | × | ○ | — |
| R0102 | × | × | ○ | ○ |

FIG. 29

223

| SEGMENT STRING | R11 | R12 | | |
|---|---|---|---|---|
| USE-SCHEDULED CLOCK TIME | hh:mm:ss | hh:mm:ss | | |

903

| SEGMENT STRING | USE-NOTICING TRAIN (TRAIN ID) / CLOCK TIME | | | |
|---|---|---|---|---|
| R0001 | T1 | | | |
| | 08:30:00 | | | |
| R0002 | | | | |
| | | | | |
| R0101 | | | | |
| | | | | |
| R0102 | T2 | | | |
| | 08:35:00 | | | |

TRAIN OPERATION CONTROL SYSTEM

TECHNICAL FIELD

The present invention relates to a train operation control system that controls operations of a plurality of trains existing on tracks (in other words, a railway network).

BACKGROUND ART

A train control system is classified into two main systems, namely, a fixed block system and a moving block system. The fixed block system controls the interval between trains by means of physically fixed blocking. The moving block system controls the interval between trains by continuously moving a block section in accordance with the relative speeds and positions of the trains.

One example of conventional techniques for the moving block system is the technique disclosed in Patent Document 1. In the technique disclosed in Patent Document 1, each car requests allocation of a dynamic occupied section (which means a travel range in which the car is allowed to freely travel in both directions such as up and down directions, and this travel range changes with traveling of the car) based on the position of the car. Then, the allocation request from each car is checked against a travel path occupation status management table, and based on a result of the check, a dynamic occupied section is allocated to each car. The dynamic occupied section thus allocated is transmitted to each car. Each car controls the speed of the car in accordance with the dynamic occupied section thus allocated.

Another example of the conventional techniques for the moving block system is a technique disclosed in Non-Patent Document 1. In the technique disclosed in Non-Patent Document 1, as for a control of the interval between trains, a base unit on the ground receives train position information detected by a train, and configures a course necessary for the traveling of the train based on the received train position information. Then, the base unit searches for conditions that cause obstructions (such as a train traveling ahead, a system boundary, and the end of the path) in the traveling to the terminal of the course. Then, the base unit calculates the farthest position (stop limit) that the train can travel to, and transmits a result of the calculation to the train. As for a control of the course within a station yard, the train position information is associated with a section that is equivalent to a track circuit (corresponding to a unit for the detection of the presence of a train on a track in the fixed block system). Thus, a logic of the conventional fixed block system is adopted. As a method for preparing the logic of the conventional fixed block system, for example, a technique disclosed in Patent Document 2 may be mentioned.

PRIOR-ART DOCUMENTS

Patent Documents

Patent Document 1: Japanese Patent Application Laid-Open No. 2000-108903

Patent Document 2: Japanese Patent Application Laid-Open No. 2003-81090

Non-Patent Documents

Non-Patent Document 1: Atsushi Kuroiwa, Tomofumi Umezu, Tetsuri Ito, Akira Morii, Yuichi Baba, Hisashi Nakayama, and Shinzo Konno, "Practical Application of ATACS in Senseki Line", JR EAST Technical Review, East Japan Railway Company, 2009, Volume 28 (No. 28), pp. 41-46

SUMMARY OF THE INVENTION

Problems to be Solved by the Invention

In the technique disclosed in Patent Document 1, in order to determine the dynamic occupied section of a control object train, the allocation request given from the control object train is checked against the dynamic occupied section of another train described in the travel path occupation status management table. The travel path occupation status management table describes the dynamic occupied section of each train by using the positions f a start point and an end point of the occupied section (see FIG. 8 of Patent Document 1).

In the station yard, however, the start points and the end points of different travel paths overlap. This complicates a process of the checking. Additionally, in order to determine the dynamic occupied section of the control object train, it is necessary to check the dynamic occupied section against the dynamic occupied sections of all cars. Therefore, a processing time increases as the number of cars increases.

Here, problems arising when a dynamic occupied section that is requested to be allocated to the control object train is checked against a dynamic occupied section that has been already allocated to another train will be described with reference to an example illustrated in FIG. 45.

FIG. 45 shows a situation where trains Ta, Tb, and Tc already exist on track Nos. 1 and 2 of a station A, and a train Td is traveling toward a track No. 3 of the station A. In FIG. 45, the reference signs Z1, Z2, and Z3 denote dynamic occupied sections that have been already allocated to the trains Ta, Tb, and Tc. The reference sign Z4 denotes a dynamic occupied section allocation range requested by the train Td. The reference sign Z5 denotes a dynamic occupied section allocated to the train Td. Here, the start point and the end point of a dynamic occupied section are expressed by a travel path name and a distance in kilometer, after the fashion adopted in FIG. 8 of Patent Document 1. The distance in kilometer means an extension of the track starting from the beginning of a line and is set so as to extend from the beginning to the end of the track.

Here, a case will be assumed in which the train Td requests, as its dynamic occupied section, the range Z4 extending from a location of 12345 m of a main track to a location of 2000 m of a track No. 3 of the station A. The dynamic occupied section is managed with respect to each train. Therefore, in order to determine the dynamic occupied section of the train Td, it is necessary that the allocation range Z4 requested by the train Td is checked against the dynamic occupied sections of all the other trains Ta, Tb, and Tc.

In FIG. 45, the dynamic occupied section Z1 of the train Ta is located ahead of the end point (location of 2000 m of track No. 3) of the dynamic occupied section allocation range Z4 requested by the train Td. Accordingly, the dynamic occupied section Z1 of the train Ta does not overlap the allocation range Z4 requested by the train Td.

The dynamic occupied section Z2 (location of 1500 m of track No. 1 to location of 2000 m of track No. 1) of the train Tb overlaps the allocation range Z4 requested by the train Td with respect to the distance in kilometer, but the track No. (track No. 1) used by the train Tb is different from the track No. (track No. 3) used by the train Td. Accordingly, the dynamic occupied section Z2 of the train Tb does not overlap the allocation range Z4 requested by the train Td.

The dynamic occupied section Z3 (location of 1750 m of track No. 2 to location of 2000 m of track No. 2) of the train Tc overlaps the allocation range Z4 requested by the train Td with respect to the distance in kilometer, but the track No. (track No. 2) used by the train Tc is different from the track No. (track No. 3) used by the train Td. Accordingly, the dynamic occupied section Z3 of the train Tc should not overlap the allocation range Z4 requested by the train Td. However, a rear position of the train Tc (at a location of 1750 m) is included in a point-switch protection section Z6. Thus, in order to avoid derailment and collision of the trains, it is necessary that the point-switch protection section Z6 is excluded from the dynamic occupied section of the train Td.

As a result, among the allocation range Z4 requested by the train Td, a portion located at the rear side of the point-switch protection section Z6 is allocated as the dynamic occupied section Z5 of the train Td.

Thus, in the example shown in FIG. 45, and in other words, in the technique disclosed in Patent Document 1, for the allocation of a dynamic occupied section, it is necessary to compare the dynamic occupied section against dynamic occupied sections of all the other trains and thereby confirm that the distances in kilometer do not overlap. Since the dynamic occupied section is set with respect to each train, the amount of processing performed for the confirmation of the distance in kilometer increases by the square of the number of trains.

Moreover, a process for confirming that the tracks do not overlap and a process for confirming that the point-switch protection sections do not overlap need to be performed.

Furthermore, since information (the travel path name and the distance in kilometer) about the dynamic occupied section constantly changes with the traveling of the car, it is necessary that the various processes mentioned above are performed in real time with use of such information that keeps changing.

From the above, the technique disclosed in Patent Document 1 involves the problem that a process of competition for an occupied section among trains is complicated and the problem that the amount of processing required in such a competition process increases by the square of the number of trains to be managed.

In this respect, the technique disclosed in Non-Patent Document 1, which adopts the logic of the conventional fixed block system, does not cause the above-described problems.

However, a problem arises that the operation is inefficient as a whole because an efficient train operation enabled by the moving block system is not performed in the station yard.

Additionally, the logic of the conventional fixed block considers a competitive relationship among the courses including a plurality of track circuits (each track circuit corresponds to the unit for the detection of the presence of a train on a track in the fixed block system) and a competitive relationship among signalers that control the entry of a train into the course. Therefore, preparing a control logic requires a large amount of effort (see Patent Document 2).

An object of the present invention is to provide a train operation control system that enables a process concerning a course competition to be simplified.

Means for Solving the Problems

A train operation control system according to an aspect of the present invention is a train operation control system that controls operations of a plurality of trains existing on tracks of a railway network and that includes a train control device, a segment competition information storage part, a use segment request device, a segment use permission status information storage part, and a segment use permission setting part. The train control device is mounted on each train and configured to obtain information of a current position of an own train. The segment competition information storage part stores segment competition information prepared by: defining in advance a plurality of segments with respect to the railway network in accordance with a predetermined segment definition rule based on a point-switch protection section, a control direction of a point switch, and an advancing direction of a train; and setting in advance a competitive relationship between the plurality of segments. The use segment request device is configured to, based on information of the current position, select a use-requested segment that is a segment for which a use permission is requested in order to operate a train, and prepare a use-requested segment information. The segment use permission status information storage part stores segment use permission status information in which a use permission status of each segment is registered. The segment use permission setting part is configured to: obtain the use-requested segment information from each train; in accordance with a predetermined competition determination process using the segment competition information and the segment use permission status information, determine whether or not a competition for the use-requested segment in terms of the train operation occurs between the plurality of trains; cause the use-requested segment for which it is determined that no competition occurs to be incorporated, as a use permission segment, into use permission segment information of the corresponding train; and update the segment use permission status information in accordance with a result of a competition determination.

Effects of the Invention

In the above-mentioned aspect, the "segment" defined based on the point-switch protection section, the control direction of the point switch, and the advancing direction of the train is introduced, and a competition for the segment used by each train is determined, to thereby control the operation of the train. A complicated calculation using a train position is not required for defining the segment, setting the segment competition information, managing the train operation based on the segment, and the like. Thus, a process concerning a course competition can be simplified.

These and other objects, features, aspects and advantages of the present invention will become more apparent from the following detailed description of the present invention when taken in conjunction with the accompanying drawings.

BRIEF DESCRIPTION OF THE DRAWINGS

FIG. 1 A diagram schematically illustrating segments according to embodiments 1 to 5.

FIG. 2 A diagram schematically illustrating the segments according to the embodiments 1 to 5.

FIG. 3 A diagram schematically illustrating segments according to the embodiments 1 to 5.

FIG. 6 A diagram schematically illustrating a segment competition table according to the embodiments 1 to 5.

FIG. 10 A diagram schematically illustrating a use-requested segment list according to the embodiment 1.

FIG. 22 A diagram schematically illustrating a segment competition table according to the embodiment 5.

FIG. 27 A diagram schematically illustrating the segment strings according to the embodiment 6.

FIG. 28 A diagram schematically illustrating a segment-string competition table according to the embodiment 6.

FIG. 29 A diagram schematically illustrating a use-noticed segment string list according to the embodiment 6.

EMBODIMENT FOR CARRYING OUT THE INVENTION

Embodiment 1

Figures 4, 5:
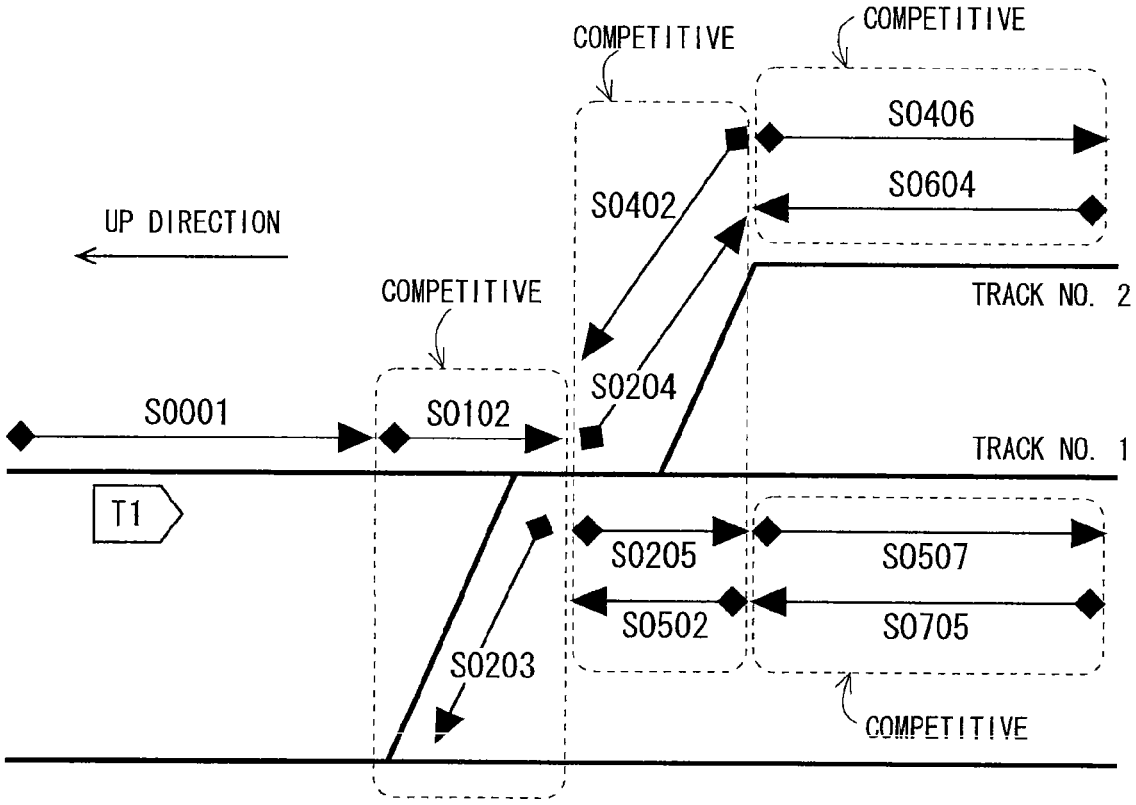
FIG. 4 A diagram schematically illustrating the segments according to the embodiments 1 to 5.
FIG. 5 A diagram schematically illustrating segments according to the embodiments 1 to 5.

Firstly, a description will be given to a segment and a segment competition table, which form the basis of an embodiment 1 and embodiments 2 to 5, which will be described later, of the present invention.

A segment is a concept under which a track (in other words, a railway network) is recognized in accordance with a predetermined rule (which will be called a segment definition rule) based on a point-switch protection section, a control direction of a point switch, and an advancing direction of a train.

More specifically, it can be recognized that a track in the point-switch protection section forms a plurality of courses in accordance with a combination of the control direction of the point switch and the advancing direction of the train. Each one of such plurality of courses is defined as the segment. In the same manner, as for a track in a section other than the point-switch protection section, a plurality of segments are defined in accordance with the advancing direction of the train.

Even when a plurality of segments can be defined for one section, only part of those segments may be actually used because of, for example, train operation planning, as will be mentioned later. However, at least one segment is defined for each of the sections that are actually in practical use.

Actually, a railway network includes a plurality of sections (broadly classified into the point-switch protection section and sections other than the point-switch protection section), and therefore a plurality of segments are defined for the railway network.

The point switch is a device that controls the state of branching of a track. The control direction of the point switch includes a normal direction and a reverse direction. Switching between these control directions can change the advancing direction at a branch.

The point-switch protection section is set for the point switch, for the purpose of preventing derailment and contact of the train. To be specific, when a train exists in the point-switch protection section, a switchover control for switching the point switch is prohibited. While the switchover control is being performed on a point switch, a train is prohibited from entering the point-switch protection section that is provided for this point switch.

FIG. 1 is a diagram schematically showing a first example of the segment. FIG. 1 illustrates a branch of a track. A point switch 10 (whose specific structure is not shown) is installed in the branch. In the example shown in FIG. 1, the point switch 10 selectively forms either one of a path connecting points Da and Db and a path connecting points Da and Dc. In FIG. 1, the normal direction is a control direction adopted in a case of selecting a path besides the three short oblique lines indicated by the reference sign 11, that is, in a case of connecting the points Da and Db, and the reverse direction is a control direction adopted in a case of selecting a path without the reference sign 11 attached thereto, that is, in a case of connecting the points Da and Dc.

As illustrated in FIG. 1, a point-switch protection section 12 is set in a predetermined range (which, in FIG. 1, is enclosed by the broken line and has its section end-points indicated by separator lines) from the point switch 10. Distances from the point switch 10 to the section end-points corresponding to the directions toward Da, Db, and Dc may be equal to or different from one another.

In general, the advancing direction of the train is classified into an up direction and a down direction. In the example shown in FIG. 1, the direction from left to right of FIG. 1 is defined as the down direction, while the direction from right to left in FIG. 1 is defined as the up direction. In the drawings which will be referred to, the up direction and the down direction are defined in the same manner.

In the example shown in FIG. 1, four segments S1 to S4 are defined for the track in the point-switch protection section 12, depending on a combination of the control direction of the point switch 10 and the advancing direction of the train. More specifically, a combination of the normal direction and the down direction defines the segment S1; a combination of the normal direction and the up direction defines the segment S2; a combination of the reverse direction and the down direction defines the segment S3; and a combination of the reverse direction and the up direction defines the segment S4.

Here, information concerning the definition of each segment (which herein will be called segment definition information) can be collected into data in the form of a table, for example (see FIG. 2). Here, the form of the data is not limited to a table.

In a case where the advancing direction of the train is restricted for operational reasons or the like, for example, in a case where a down train is not operated under a state where the control direction of the point switch is the normal direction, the segment S1 does not need to be defined.

In FIG. 1, the segments S1 to S4 are illustrated schematically with arrows. In this illustration, the direction indicated by the arrow is the advancing direction of the train. The base of the arrow (with a black square) indicates the beginning of the segment, and the point of the arrow (with a black triangle) indicates the end of the segment. That is, the train advances from the beginning to the end of the segment.

FIG. 3 is a diagram schematically showing a second example of the segment. FIG. 3 illustrates a railway network in which a track once diverges and then converges again.

In the example shown in FIG. 3, the point-switch protection section 12 is provided in each of the two branches. The segment is defined for each of the point-switch protection sections 12 in the same manner as in the example shown in FIG. 1.

Herein, as for a section (this section does not include any branch) other than the point-switch protection section 12, a section connecting two point-switch protection sections 12 (in other words, a section between two point-switch protection sections 12) is handled as a single section, and the segment is defined for this single section. FIG. 3 illustrates two segments S5 and S6 in accordance with the advancing direction of the train. More specifically, the segment S5 is defined for the down direction, and the segment S6 is defined for the up direction (see FIG. 4).

In a case where the advancing direction of the train is restricted for operational reasons or the like, for example, in a case where a down train is not operated, the segment S5 does not need to be defined.

<Segment Competition Table>

The segment competition table means data in the form of a table, in which information concerning a competitive relationship among segments (which herein will be called segment competition information) are collected. However, it may be acceptable that the segment competition information is managed in a data form other than a table format.

FIG. 5 is a diagram (which herein will be called a segment definition diagram) that defines the segments in a more specific track distribution (in other words, a railway network). FIG. 6 illustrates a segment competition table corresponding to the segment definition diagram shown in FIG. 5. In FIG. 5, part of the segments is not shown.

In FIG. 6, a combination of segments having no competitive relationship with each other is given the mark "○", and a combination of segments having a competitive relationship with each other is given the mark "x". In an example shown in FIG. 6, the segment competition table is a symmetric matrix, and therefore illustration of the upper half is omitted.

The competitive relationship between segments is set in accordance with a predetermined rule (which herein will be called a segment competitive relationship setting rule). To be more specific, the example shown in FIGS. 5 and 6 is based on a rule that a competitive relationship is set in different segments that share the same track section. Here, the track section means each of the point-switch protection section 12 and the section connecting the point-switch protection sections 12 (see FIGS. 1 and 3).

The rule illustrated above can be translated as setting a competitive relationship in segments that satisfy both a condition (a) that the segments to be compared with each other share the same track section and a condition (b) that the segments to be compared with each other are different segments.

In the example shown in FIG. 5, for example, segments S0102 and S0203 share the same point-switch protection section and the segments S0102 and S0203 are different segments. Therefore, both of the conditions (a) and (b) are satisfied. Thus, a competitive relationship is set between the segment S0102 and the segment S0203 (see FIG. 6).

Under the above-described rule, no competitive relationship is set between the same segment even when the same track section is shared. This is because the condition (b) is not satisfied. For example, the segment S0102 does not compete with the segment S0102 itself (see FIG. 6).

The segment competitive relationship setting rule may include, in addition to the conditions (a) and (b) or instead of the conditions (a) and (b), another condition such as a condition concerning the operation of the train or a condition concerning the shape of the track.

In this manner, an operation for preparing the segment competition table can be considerably simplified as compared with the preparation of a conventional interlocking table.

<Train Operation Control System 90>

Figure 7:
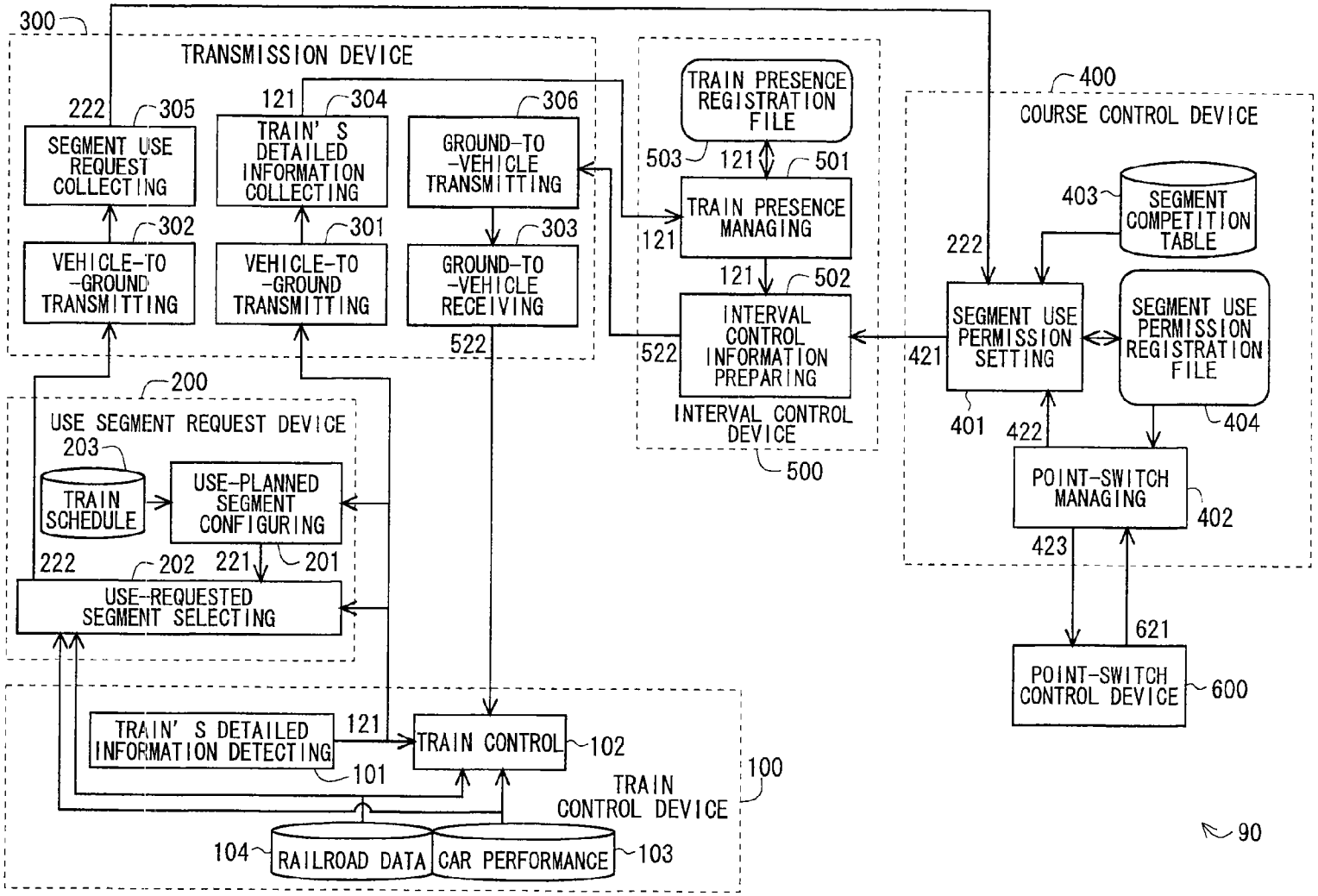
FIG. 7 A block diagram illustrating a configuration of a train operation control system according to the embodiment 1.

FIG. 7 is a block diagram illustrating a configuration of a train operation control system 90 according to the embodiment 1. In the drawing, the name of a member is sometimes abbreviated. In an example shown in FIG. 7, the train operation control system 90 includes a train control device 100, a use segment request device 200, a transmission device 300, a course control device 400, an interval control device 500, and a point-switch control device 600.

In the example shown in FIG. 7, the train control device 100 includes a train's detailed information detecting part 101, a train control part 102, a car performance data storage part 103, and a railroad data storage part 104. In the following description, the reference sign 103 may be also used to refer to car performance data stored in the storage part 103. Likewise, the reference sign 104 may be also used to refer to railroad data stored in the storage part 104. The two storage parts 103 and 104 may be configured as a single storage device, or may be configured as separate storage devices.

In the example shown in FIG. 7, the use segment request device 200 includes a use-planned segment configuring part 201, a use-requested segment selecting part 202, and a train schedule data storage part 203. In the following description, the reference sign 203 may be also used to refer to train schedule data stored in the storage part 203.

In the example shown in FIG. 7, the transmission device 300 includes a vehicle-to-ground transmitting part 301, a vehicle-to-ground transmitting part 302, a ground-to-vehicle receiving part 303, a train's detailed information collecting part 304, a segment use request collecting part 305, and a ground-to-vehicle transmitting part 306.

In the example shown in FIG. 7, the course control device 400 includes a segment use permission setting part 401, a point-switch managing part 402, a segment competition table storage part (in other words, a segment competition information storage part) 403, and a segment use permission registration file storage part (in other words, a segment use permission status information storage part) 404. In the following description, the reference sign 403 may be also used to refer to segment competition table (in other words, segment competition information) stored in the storage part 403. Likewise, the reference sign 404 may be also used to refer to segment use permission registration file (in other words, segment use permission status information) stored in the storage part 404. The two storage parts 403 and 404 may be configured as a single storage device, or may be configured as separate storage devices.

In the example shown in FIG. 7, the interval control device 500 includes a train presence managing part 501, an interval control information preparing part 502, and a train presence registration file storage part 503. In the following description, the reference sign 503 may be also used to refer to a train presence registration file stored in the storage part 503.

In the train operation control system 90, the train control device 100 and the use segment request device 200 are mounted on the train. Moreover, in the transmission device 300, the vehicle-to-ground transmitting parts 301 and 302 and the ground-to-vehicle receiving part 303 are mounted on the train, too. The elements 100, 200, and 301-303 mounted on the train will be sometimes collectively referred to as "on-vehicle device".

The course control device 400, the interval control device 500, and the point-switch control device 600 are installed on the ground. Moreover, in the transmission device 300, the train's detailed information collecting part 304, the segment use request collecting part 305, and the ground-to-vehicle transmitting part 306 are installed on the ground, too. The elements 303-306, 400, 500, and 600 installed on the ground will be sometimes collectively referred to as "on-ground device".

A more specific description of each of the elements will be given below.

<Train Control Device 100>

The train control device 100 performs a control concerning traveling of the train. More specifically, the elements of the train control device 100 operate as follows.

The train's detailed information detecting part 101 detects various information concerning traveling of the train, and outputs the detected information as train's detailed information 121. The train's detailed information 121 is outputted to the train control part 102, the use-planned segment configuring part 201, the use-requested segment selecting part 202, and the vehicle-to-ground transmitting part 301.

The train's detailed information 121 includes information of, for example, a current position, an advancing direction, and a traveling speed. In other words, train's detailed information detecting part 101 is a general term for means for detecting the kinds of information. For example, the current position can be detected by accumulating a travel distance with use of a tachometer generator mounted on the train (see Non-Patent Document 1). The other kinds of information are also detectable by various existing methods.

The train's detailed information detecting part 101 may output the train's detailed information 121 having the same content to all of output destinations (train control part 102 and the like), or may output, as the train's detailed information 121, only information necessary for each output destination.

The train's detailed information 121 of each train is collected by the train's detailed information collecting part 304 via the vehicle-to-ground transmitting part 301. Therefore, the train's detailed information 121 directed to the train's detailed information collecting part 304 includes a number (so-called train ID) for identifying a source train. The train ID is added by, for example, the train's detailed information detecting part 101 or the vehicle-to-ground transmitting part 301.

The train control part 102 obtains the train's detailed information 121 from the train's detailed information detecting part 101, and control traveling of the train based on the train's detailed information 121. Here, a control of a brake output (in other words, a brake operation) will be illustrated. For controlling the brake output, the train control part 102 obtains stop limit information 522 from the interval control information preparing part 502 via the transmission device 300. The train control part 102 obtains the car performance data from the storage part 103, and obtains the railroad data from the storage part 104.

The stop limit information 522 is information for ensuring an interval with a preceding train that is traveling ahead of the own train, and is information concerning the farthest position (stop limit position) that the train can travel to.

The stop limit information 522 is constituted by, for example, information of a specific position at which the train should stop. Alternatively, the stop limit information 522 may be constituted by multiple information including information of a reference position for determining a stop position and information indicating the type of the reference, position (for example, a flag therefor is provided). In the latter example, the train control part 102 obtains a position that is closer to the train than the reference position is and that is distant from the train by a security allowance distance based on the type of a reference position, and handles the obtained position as a specific position at which the train should stop.

The car performance data 103 includes data of the performance of the train such as brake performance. The railroad data 104 is data concerning a railroad, and includes, for example, data concerning physical conditions such as a gradient resistance and a curve resistance of the track and data concerning operation conditions such as a speed limit provided for a specific section.

Based on the train's detailed information 121, the stop limit information 522, the car performance data 103, and the railroad data 104 that have been obtained, the train control part 102 determines whether or not the train will be beyond the position indicated by the stop limit information 522 if no brake output is performed. Upon a determination that the train will be beyond the position, the train control part 102 performs the brake output.

<Use Segment Request Device 200>

The use segment request device 200 obtains a segment that is used by the train (own train) on which the use segment request device 200 itself is mounted, and outputs a use request for the obtained segment to the course control device 400. More specifically, the elements of the use segment request device 200 operate as follows.

The use-planned segment configuring part 201 obtains the train's detailed information 121 (in more detail, the information of the current position and the advancing direction) from the train's detailed information detecting part 101, and obtains the train schedule data (which describes a travel plan) from the storage part 203. Then, based on the train's detailed information 121 and the train schedule data 203 thus obtained, the use-planned segment configuring part 201 prepares a use-planned segment list (in other words, use-planned segment information) 221 including a segment where the train currently exists and a segment where the train is scheduled to travel in future. The use-planned segment list 221 is, for example, prepared with respect to each part of an operating railroad during the operation of the train, as appropriate. The use-planned segment list 221 thus prepared is outputted toward the use-requested segment selecting part 202.

In the example shown in FIG. 5 described above, a train T1 in the down direction exists in the segment S0001. In a case of a travel plan toward a track No. 1, the use-planned segment list 221 includes segments S0001, S0102, S0205, and S0507.

The segment definition information (see FIGS. 2 and 4) has been supplied in advance to the use segment request device 200. For example, a storage part storing the segment definition information is provided in the use-planned segment configuring part 201. Alternatively, the train schedule data is described with use of segments.

The use-requested segment selecting part 202 obtains the use-planned segment list 221 from the use-planned segment configuring part 201. Then, the use-requested segment selecting part 202 selects, from the use-planned segment list 221, a segment for which a use request should be transmitted to the course control device 400. Then, the use-requested segment selecting part 202 incorporates the selected segment into a use-requested segment list (in other words, use-requested segment information) 222. For the selection of the segment, the use-requested segment selecting part 202 obtains the train's detailed information 121 (in more detail, information of the current position, the traveling speed, and the advancing direction) from the train's detailed information detecting part 101, and obtains the car performance data 103 and the railroad data 104 from the train control device 100. Based on the information 121, 103, and 104, the use-requested segment selecting part 202 prepares the use-requested segment list 222. The use-requested segment list 222 thus prepared is outputted toward the vehicle-to-ground transmitting part 302.

Figure 8:
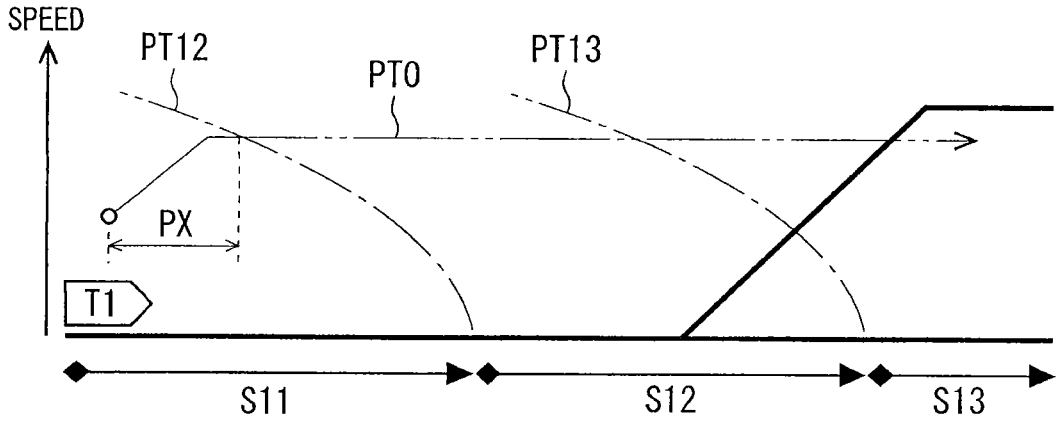
FIG. 8 A diagram schematically showing an outline of a process performed by a use-requested segment selecting part according to the embodiment 1.
Figure 9:
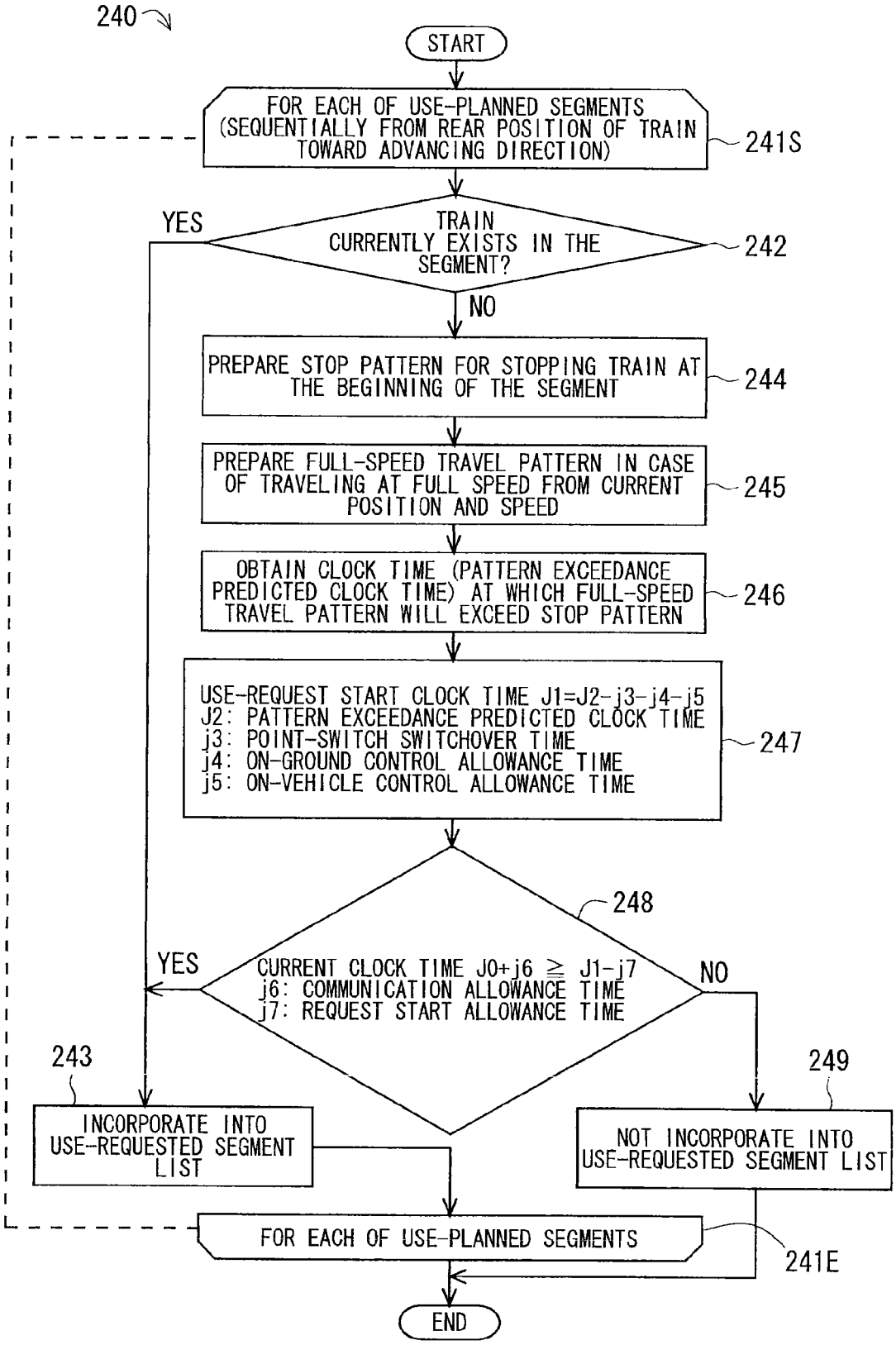
FIG. 9 A flowchart illustrating the process performed by the use-requested segment selecting part according to the embodiment 1.

FIG. 8 is a diagram schematically showing an outline of a process performed by the use-requested segment selecting part 202. FIG. 9 is a flowchart illustrating the process performed by the use-requested segment selecting part 202. In an example shown in FIG. 8, use-planned segments of the train T1 (that is, segments included in the use-planned segment list 221) are segments S11, S12, and S13.

In a use-requested segment selection process 240 illustrated in FIG. 9, use-planned segments included in the use-planned segment list 221 are sequentially selected in the order from the rear position of the train toward the advancing direction (steps 241S, 241E). Thereby, whether or not each of the use-planned segments should be included in the use-requested segment list 222 is determined.

Firstly, whether or not the selected segment (that is, a processing object segment) is a segment where the own train currently exists, is determined (step 242). Upon a determination that the selected segment is a segment where the own train currently exists, the selected segment is incorporated into the use-requested segment list 222 (step 243), and the process moves to the next segment (steps 241E, 241S). In the example shown in FIG. 8, a segment S11 corresponds to the segment where the own train currently exists.

Upon a determination, in step 242, that the selected segment is not a segment where the own train currently exists, a travel pattern (which hereinafter will be called a stop pattern) for stopping the train at the beginning (that is, the end at the side from which the train enters) of the selected segment is prepared based on the car performance data 103 (step 244). The stop pattern is expressed by, for example, the relationship between the position of the train and the speed of the train, and in FIG. 8, illustrated in the form of a speed graph PT12, PT13. In the example shown in FIG. 8, PT12 represents the stop pattern for the segment S12, and PT13 represents the stop pattern for the segment S13.

Then, a travel pattern (which hereinafter will be called a full-speed travel pattern) in a case of traveling at a full speed from the current position and speed, is prepared based on the current position, the train speed, the car performance data 103, and the railroad data 104 (step 245). The current position and the train speed are obtained as the train's detailed information 121 from the train's detailed information detecting part 101. The full-speed travel pattern is, similarly to the stop pattern mentioned above, expressed by the relationship between the position of the train and the speed of the train, for example. In FIG. 8, the full-speed travel pattern is illustrated in the form of a speed graph PT0. It may be acceptable that step 245 is performed prior to step S44.

Then, a clock time (which hereinafter will be called a pattern exceedance predicted clock time) at which the full-speed travel pattern will exceed the stop pattern, is obtained (step 246). For example, referring to FIG. 8, the pattern exceedance predicted clock time can be obtained by adding, to the current clock time, a length of time spent traveling through a section PX that extends from the current position to a point where the full-speed travel pattern PT0 crosses the stop pattern PT12.

In a case where the stop pattern is already exceeded under the current position and speed, the current clock time is set as the pattern exceedance predicted clock time.

Then, a use-request start clock time is obtained (step 247). The use-request start clock time obtained here is a clock time at which an output of the use request for the corresponding segment is started. Additionally, the use-request start clock time obtained here is the latest clock time that can satisfy the condition that a brake output caused by exceeding the stop pattern does not occur. The use-request start clock time is calculated based on, for example, the following expression 1.

use-request start clock time $J1$=pattern exceedance predicted clock time $J2$−point-switch switchover time $j3$−on-ground control allowance time $j4$−on-vehicle control allowance time $j5$ (Expression 1)

The point-switch switchover time j3 means a standard time period required for performing the switchover control on the point switch. With respect to a segment including no point switch, j3=0 is established. In the example shown in FIG. 8, the segment S12 includes a point switch. Therefore, to make a use request for the segment S12, a time period required for performing the switchover control is set to be j3. In the example shown in FIG. 8, the segment S13 includes no point switch. Therefore, to make a use request for the segment S13, j3=0 is set.

The on-ground control allowance time j4 means a standard time period from when the course control device 400 and the interval control device 500 obtain the use-requested segment list 222 and the train's detailed information 121 to when a predetermined process is completed.

The on-vehicle control allowance time j5 means a standard time period from when the use-requested segment selecting part 202 obtains the train's detailed information 121 to when the use-requested segment list 222 is transmitted to the vehicle-to-ground transmitting part 302.

Then, based on the expression 2, whether or not a corresponding segment should be incorporated into the use-requested segment list 222 is determined (step 248).

{current clock time $J0$+communication allowance time $j6$}≥{use-request start clock time $J1$−request start allowance time $j7$} (expression 2)

The communication allowance time j6 means a standard time period required for the transmission and reception of information between the train and the on-ground device.

The request start allowance time j7, which is a parameter for bringing forward the use-request start clock time J1, has a value equal to or greater than zero. The request start allowance time j7 having a smaller value postpones the segment use request from the corresponding train. This can consequently prevent the corresponding train from occupying the on-ground device for a longer time than necessary. On the other hand, when an unexpected situation such as a delay in the operation of the point switch and a delay in the communication occurs, the possibility of occurrence of the brake output in the train increases. Accordingly, increasing the request start allowance time j7 can lower the possibility of occurrence of the brake output in the train. The request start allowance time j7 is set to be an appropriate value in accordance with the degree of congestion on the railroad and the performance of devices and facilities.

When the expression 2 is satisfied in step 248, in other words, when the current clock time is equal to or past a limit clock time that causes a brake output because of exceedance of the stop pattern unless the use request output is started with a margin for the communication allowance time j6, the currently processed segment is incorporated into the use-requested segment list 222 (step 243). Then, the process moves to the next segment (steps 241E, 241S).

When the expression 2 is not satisfied, on the other hand, the currently processed segment is not incorporated into the use-requested segment list 222 (step 249), and the process 240 is terminated.

The use-requested segment selection process 240 is repeatedly performed with a cycle of, for example, about every fifty milliseconds. The latest versions of the various information available at a time of the start of each cycle, are used.

In this manner, the use-requested segment selecting part 202 does not incorporate, among the use-planned segments, a segment (which herein will be called an unpermitted segment) for which no use permission has been obtained, into the use-requested segment list 222, until the limit clock time from which the brake operation for preventing an entry into the unpermitted segment is necessary. Therefore, no use request is outputted until the limit clock time. This eliminates an unnecessary use of the on-ground device by the train. Thus, an efficient use of the on-ground device is enabled.

FIG. 10 is a diagram schematically illustrating the use-requested segment list 222. In an example shown in FIG. 10, the use-requested segment list 222 sequentially describes segments for which use requests are outputted, in the order from the rear position of the train toward the advancing direction. The use-requested segment list 222 also describes whether or not each of the segments is a segment where the train currently exists.

<Transmission Device 300>

The transmission device 300 performs communication between the on-vehicle device and the on-ground device.

To be more specific, the vehicle-to-ground transmitting part 301 transmits, to the train's detailed information collecting part 304, the train's detailed information 121 inputted from the train's detailed information detecting part 101. The train's detailed information collecting part 304 outputs, toward the train presence managing part 501, the train's detailed information 121 received from each train. The train's detailed information collecting part 304 collects the train's detailed information 121 from each train, though the illustration thereof is simplified in FIG. 7.

The vehicle-to-ground transmitting part 302 transmits, to the segment use request collecting part 305, the use-requested segment list 222 inputted from the use-requested segment selecting part 202. The segment use request collecting part 305 outputs, toward the segment use permission setting part 401, the received use-requested segment list 222. The segment use request collecting part 305 collects the use-requested segment list 222 from each train, though the illustration thereof is simplified in FIG. 7.

The ground-to-vehicle transmitting part 306 transmits, to the ground-to-vehicle receiving part 303 of a corresponding train, the stop limit information 522 inputted from the interval control information preparing part 502. The ground-to-vehicle receiving part 303 outputs the received stop limit information 522 toward the train control part 102.

It may be possible that the vehicle-to-ground transmitting part 301, the vehicle-to-ground transmitting part 302, and the ground-to-vehicle receiving part 303 are implemented by a physically single device provided on the train. It may be possible that the train's detailed information collecting part 304, the segment use request collecting part 305, and the ground-to-vehicle transmitting part 306 are implemented by a physically single device provided on the ground.

It may be also possible that the use-requested segment list 222 and the train's detailed information 121 are unified into one kind of information and transmitted. In such a case, the vehicle-to-ground transmitting part 301 and the vehicle-to-ground transmitting part 302 may be integrated and achieved as one vehicle-to-ground information transmitting part, and the train's detailed information collecting part 304 and the segment use request collecting part 305 may be integrated and achieved as one on-vehicle information collecting part.

<Course Control Device 400>

The course control device 400 obtains the use-requested segment list 222 via the transmission device 300 from all the trains currently existing on the tracks, and obtains point-switch state information 621 from the point-switch control device 600. Then, based on the use-requested segment list 222 and the point-switch state information 621 thus obtained, the course control device 400 controls the course of each train. More specifically, the elements of the course control device 400 operate as follows.

<Segment Use Permission Setting Part 401>

The segment use permission setting part 401 obtains the use-requested segment list 222 with respect to all the trains existing on the tracks, and obtains segment travelable state information 422 from the point-switch managing part 402. Based on the use-requested segment list 222 and the segment travelable state information 422 thus obtained, the segment use permission setting part 401 prepares a use permission segment list (in other words, use permission segment information) 421. The use permission segment list 421 is a list describing segments that are permitted to be used by each train. In preparing the use permission segment list 421, the segment use permission setting part 401 refers to the segment competition table in the storage part 403. In preparing the use permission segment list 421, the segment use permission setting part 401 refers to and updates a use permission status of each segment registered in the segment use permission registration file (in other words, segment use permission status information) stored in the storage part 404. The use permission segment list 421 thus obtained is outputted toward the interval control information preparing part 502.

Figure 11:
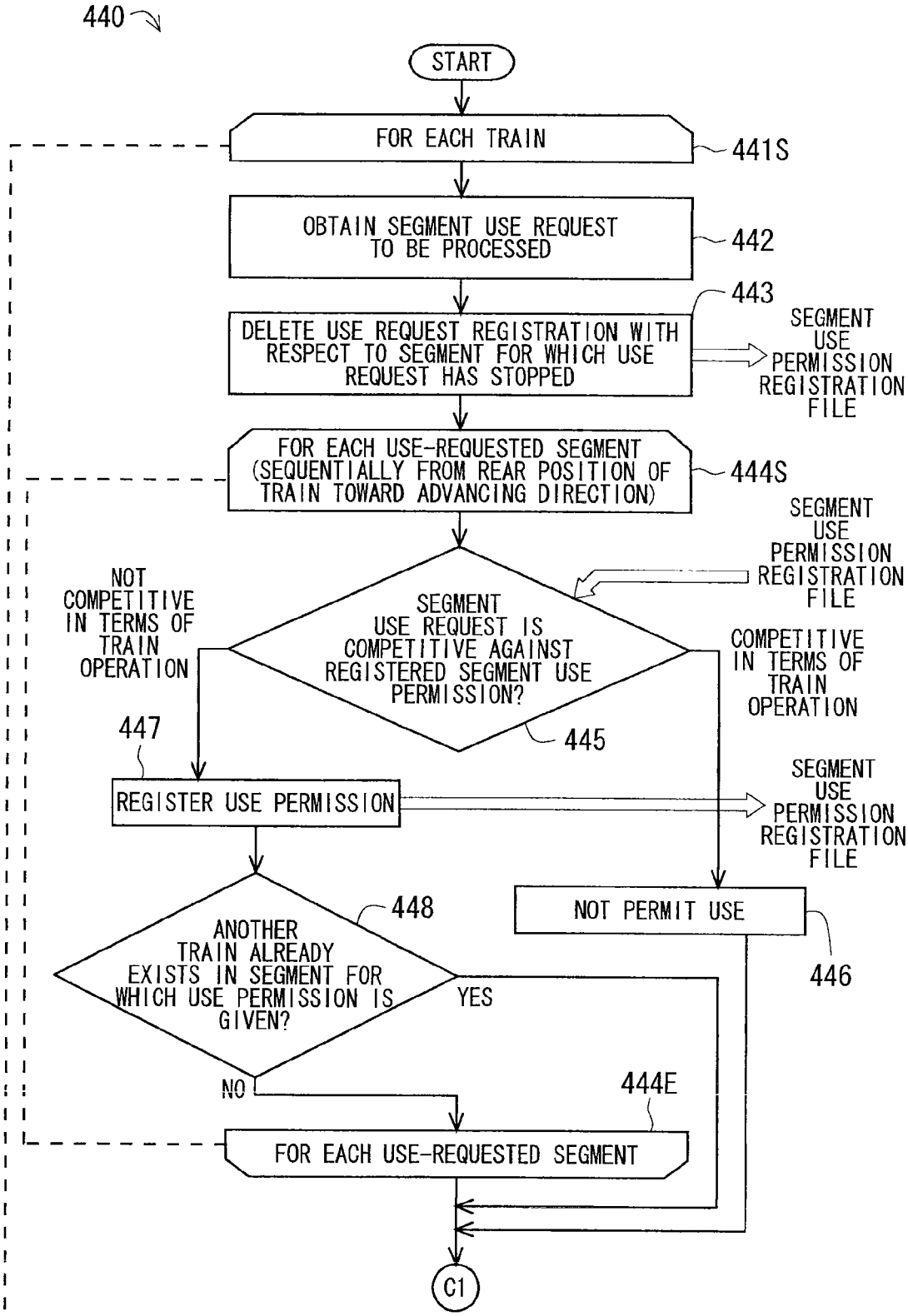
FIG. 11 A flowchart illustrating a process performed by a segment use permission setting part according to the embodiment 1.
Figures 12, 13:
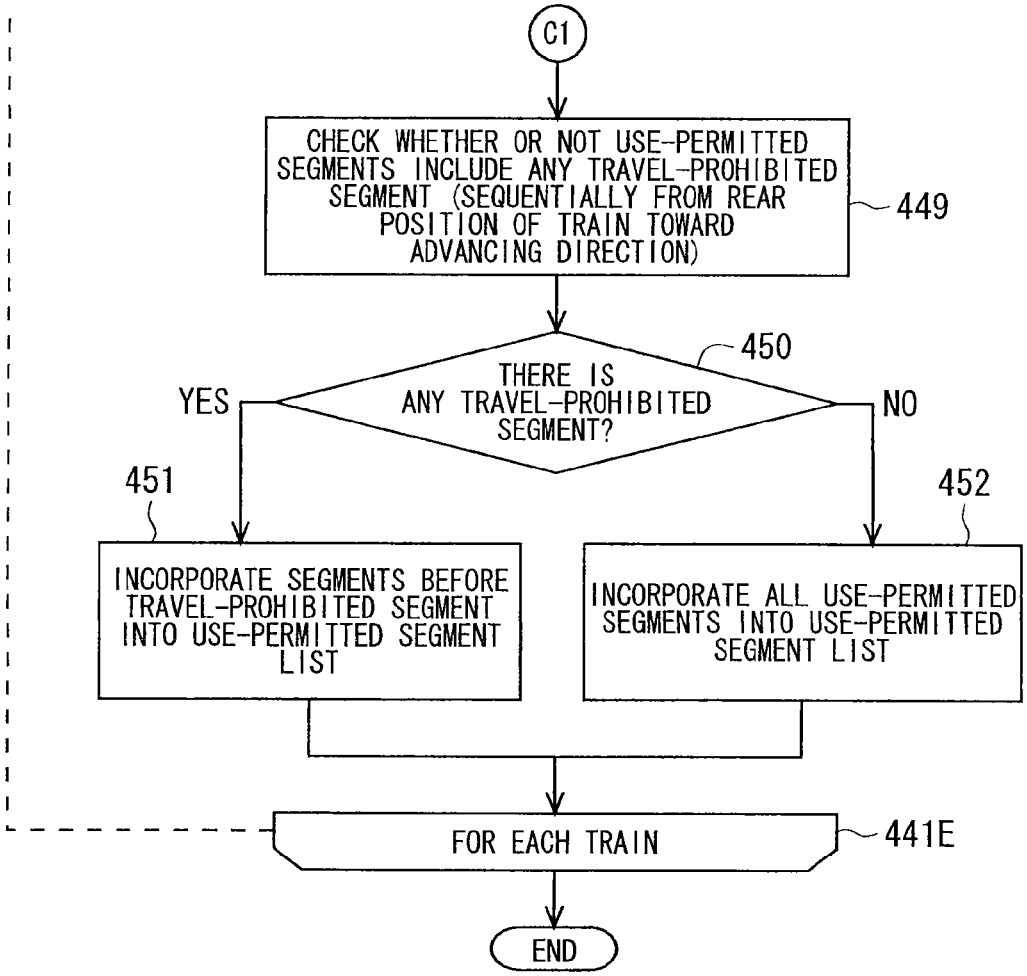
FIG. 12 A flowchart illustrating the process performed by the segment use permission setting part according to the embodiment 1.
FIG. 13 A diagram schematically illustrating a use permission registration file according to the embodiment 1.

FIGS. 11 and 12 show a flowchart illustrating a segment use permission process performed by the segment use permission setting part 401. A flow of FIG. 11 and a flow of FIG. 12 are connected via a connector C1.

In a use permission segment list preparation process 440 illustrated in FIGS. 11 and 12, the use-requested segment list 222 obtained from each train is processed on a train basis (steps 441S, 441E). Firstly, the use-requested segment list 222 to be processed is selected in a predetermined order (for example, in the order of being inputted to the segment use permission setting part 401) (step 442).

The use-requested segment list 222 selected in step 442 is compared against the previous use-requested segment list 222 of the corresponding train (which is recorded on the segment use permission registration file 404). When, as a result of the comparison, it is determined that there is any segment for which the use request has stopped this time, the segment for which the use request has stopped is deleted from the segment use permission registration file 404 (step 443).

FIG. 13 is a diagram schematically illustrating the segment use permission registration file 404. In an example shown in FIG. 13, the use permission for a segment S21 is given to a train T2, the use permission for a segment S22 is given to trains T1 and T2, and the use permission for a segment S23 is given to a train T3. In the example shown in FIG. 13, it is also recorded that the segment S22 is a segment where the train T1 currently exists. The segment use permission registration file 404 records segments in such a manner that the order in which the use permissions therefor have been given can be seen. In the example shown in FIG. 13, a train in a column that is more to the left is given the use permission at an earlier clock time. In other words, a train in a column that is more to the right is given the use permission at a later clock time. In the example shown in FIG. 13, the use permission for the segment S22 is given to train T1, and then given to the train T2.

Referring to FIG. 11 again, after step 443, the use-requested segments included in the use-requested segment list 222 are sequentially selected in the order from the rear position of the train toward the advancing direction (steps 444S, 444E). Thereby, whether or not the use permission for each of the use-requested segments is given is determined.

The use-requested segment selected in step 444S is checked against a registered content of the segment use permission registration file 404 (step 445). That is, whether or not giving the use permission for a use-requested segment causes a competition, in terms of the train operation, against the segment use permission registered in the segment use permission registration file 404, is determined (step 445). In this determination, the segment competition table 403 is referred to. The segment competition table 403 is configured in the same manner as in the example shown in FIG. 6, and stored in advance in the storage part 403.

Figure 14:
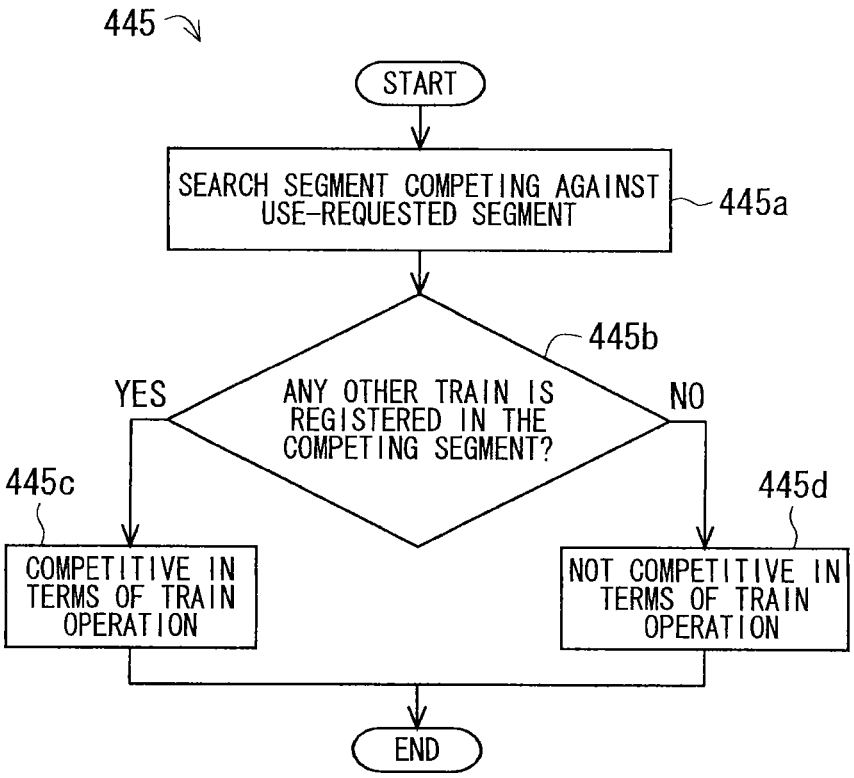
FIG. 14 A diagram schematically illustrating a segment competition determination process according to the embodiment 1.

FIG. 14 is a flowchart illustrating the determination of a competition in step 445. In a segment use competition determination process 445 illustrated in FIG. 14, firstly, the segment competition table 403 is searched, so that a segment competing against the use-requested segment that is currently processed is extracted (step 445*a*). In the example shown in FIG. 6, in a case where the use-requested segment is S0203, a competing segment is the segment S0102 that is given "x".

Then, the segment use permission registration file 404 is referred to, to determine whether or not there is any train that has been given the use permission for the competing segment extracted in step 445*a* (step 445*b*). When another train that has been given the use permission for the competing segment is registered, it is determined that a competition for the use of this competing segment is caused in terms of the train operation (step 445*c*). When no other train that has been given the use permission for the competing segment is registered, it is determined that a competition for the use of this competing segment is not caused in terms of the train operation (step 445*d*).

Referring to FIG. 11 again, when, as a result of the determination in step 445, a competition is caused in terms of the train operation, the use of this segment is not permitted (step 446), and the process for each use-requested segment is terminated (step 444E).

When a competition in terms of the operation is not caused, the use permission for the use-requested segment that is currently processed is given to the train that is currently processed (step 447). To be more specific, this use permission is registered in the segment use permission registration file 404.

Then, the segment use permission registration file 404 is referred to, to check whether or not another train already exists in the segment for which the use permission is given in step 447 (step 448).

When, as a result of the check, another train is already registered in the segment for which the use permission is given and the segment for which the use permission is given is a segment where the registered another train currently exists, the processing for the currently processed train is terminated, and the process for each use-requested segment is terminated (step 444E).

When no other train is registered in the segment for which the use permission is given, or when another train is already registered but the segment for which the use permission is given is not a segment where the registered another train currently exists, the process moves to the next use-requested segment (steps 444E, 444S).

Figure 15:
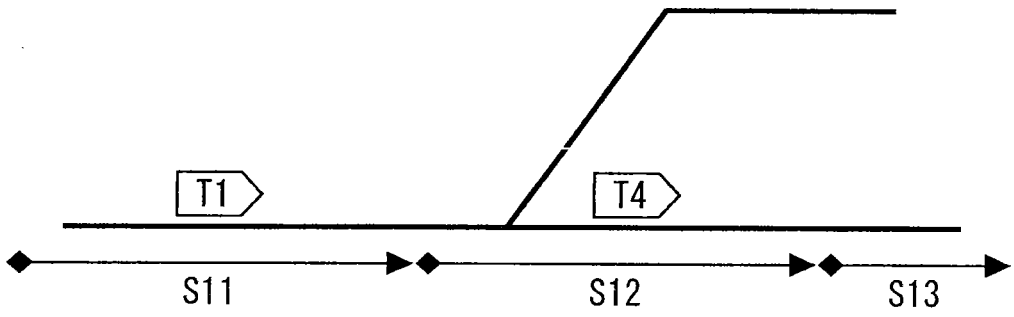
FIG. 15 A diagram schematically showing an outline of the process performed by the segment use permission setting part according to the embodiment 1.

Here, the significance of the process in the determine step 448 will be described with reference to a schematic diagram of FIG. 15. An example shown in FIG. 15 assumes that a train T1 that is a current processing object exists in the segment S11 and a train T4 traveling ahead of the train T1 exists in the segment S12. The use-requested segments requested by the train T1 are segments S11 to S13.

As already described, the competitive relationship is not set between the same segment (see FIG. 6). Therefore, no segment competes against the segment S11, and no segment competes against the segment S12. Therefore, according to steps 445 and 447, the use permissions for the segments S11 and S12 are given to the train T1.

However, the segment S12 is already registered as a segment where the preceding train T4 currently exists. Therefore, according to step 448, the train T1 escapes a processing loop of steps 444S to 444E. That is, the determination about the use permission for the segment S13 located ahead of the segment S12 is not made with respect to the train T1.

In the first place, the train T1 cannot pass the preceding train T4 while traveling on the track. Therefore, it is impossible that the train T1 uses the segment S13 beyond the preceding train T4. Accordingly, for the segment S13 located ahead of the segment S12 where the preceding train T4 currently exists, whether or not the use permission is given to the train T1 does not need to be determined. Thus, providing step 448 can prevent a situation where the use permission for a segment is registered under an unpredictable state.

In a case where the train T4 is the processing object, a competition check is performed with respect to the next segment S13, because another train T1, which is registered in the segment S12, does not exist in the segment S12.

After the train T1 enters the segment S12, both of the trains T1 and T4 are supposed to exist in the segment S12. However, the use permission is given to the preceding train T4 earlier. Therefore, in a case where the train T1 is the processing object, it is determined in step 448 that another train exists earlier, while in a case where the train T4 is the processing object, it is determined in step 448 that no other train exists earlier.

In this manner, adoption of step 448 eliminates an unnecessary use of the on-ground device, thus achieving an efficient use of the on-ground device.

Termination of the processing loop of steps 444S to 444E shown in FIG. 11 completes the registration of the use permission segment for the processing object train. Then, the process proceeds to the flow shown in FIG. 12. The segment travelable state information 422 obtained from the point-switch managing part 402 is referred to (see FIG. 7), to check whether or not, with respect to the processing object train, the use permission segments registered in the segment use permission registration file 404 include a segment (which hereinafter will be called a travel-prohibited segment) that has been set into a travel-prohibited state (step 449). In this process, the use permission segments are sequentially checked in the order from the rear position of the train toward the advancing direction.

When there is a travel-prohibited segment as a result of the check (step 450), the segments before the travel-prohibited segment, among the registered use permission segments, are incorporated into the use permission segment list 421 of the corresponding train (step 451). When there is no travel-prohibited segment (step 450), all the registered use permission segments are incorporated into the use permission segment list 421 (step 452). The use permission segment list 421 prepared is outputted toward the interval control information preparing part 502.

Completion of steps 451 and 452 terminates a processing loop of steps 441S to 441E with respect to the currently processed train. When there is any train for which the use permission segment list 421 has not been prepared, the process moves to the next train. When the use permission segment lists 421 for all the trains have been prepared, the use permission segment list preparation process 440 is terminated.

The selection process 440 is repeatedly performed with a cycle of, for example, about every fifty milliseconds. The latest versions of the various information available at a time of the start of each cycle, are used.

<Point-Switch Managing Part 402>

The point-switch managing part 402 obtains the point-switch state information 621 from the point-switch control device 600, and manages the point switch based on the obtained point-switch state information 621. For example, the point-switch managing part 402 outputs the segment travelable state information 422 and the outputs a point switch control command 423. The segment travelable state information 422 is outputted toward the segment use permission setting part 401. The point switch control command 423 is outputted toward the point-switch control device 600.

The point-switch state information 621 is information concerning the state of the point switch (in the normal direction, in the reverse direction, or during the switchover control). The segment travelable state information 422 is information concerning whether or not each segment is in a travelable state. The point switch control command 423 is a command for controlling the switchover of the point switch into the normal direction or the reverse direction.

For the management of the point switch, the point-switch managing part 402 refers to the segment use permission registration file stored in the storage part 404. The segment definition information is given in advance to the point-switch managing part 402 (for example, a storage part storing the segment definition information is provided in the point-switch managing part 402), so that the point-switch managing part 402 also refers to the segment definition information to perform a point switch management process.

Figure 16:
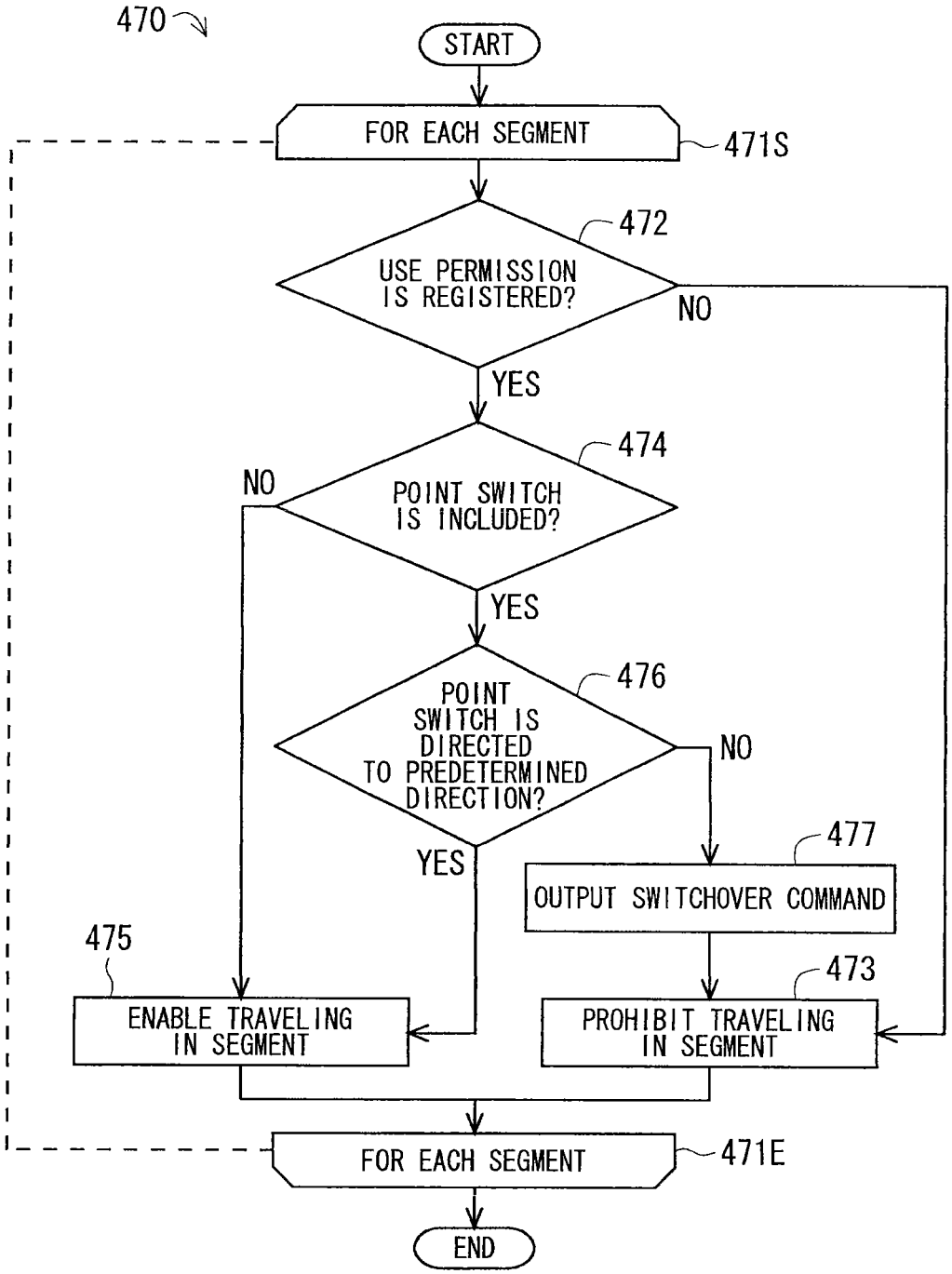
FIG. 16 A flowchart illustrating a process performed by a point-switch managing part according to the embodiment 1.

FIG. 16 is a flowchart illustrating a point switch management performed by the point-switch managing part 402. In a point switch management process 470 illustrated in FIG. 16, the process is performed for each segment (steps 471S, 471E).

Firstly, whether or not, for a segment selected as the processing object, the use permission is registered in the segment use permission registration file 404, is checked (step 472). When the use permission is not registered, the segment that is the current processing object is set into the travel-prohibited state in the segment travelable state information 422 (step 473).

When the use permission is registered, whether or not the currently processed segment includes a point switch is checked (step 474). This step 474 is implemented by, for example, determining whether or not the segment definition information includes information of the control direction of the point switch. Alternatively, step 474 may be implemented by, for example, determining whether or not there is any point-switch state information 621 corresponding to the currently processed segment. Alternatively, for example, so-called "NULL" data may be set as a content of the point-switch state information 621 corresponding to a segment including no point switch, and thereby whether or not the segment includes a point switch can be checked based on the content of the point-switch state information 621.

When it is determined in step 474 that no point switch is included, the currently processed segment is set into a travelable state in the segment travelable state information 422 (step 475). When it is determined that a point switch is included, whether or not the point switch is directed to a predetermined control direction is checked (step 476). This step 476 can be implemented by, for example, comparing the segment definition information with the point-switch state information 621.

In a case where the point switch is directed to the predetermined direction, the currently processed segment is set into a travelable state (step 475). When the point switch is not directed to the predetermined direction, the point switch control command 423 is outputted to the point-switch control device 600 in order to cause a switch over into the predetermined direction (step 477). The point switch control command 423 brings the point switch into a state where the direction is being switched. Accordingly, the corresponding segment, that is, the segment that is the current processing object, is set into a travel-prohibited state (step 473).

After steps 473 and 475, the process moves to the next segment (steps 471E, 471S). After the setting of the travelable state or the travel-prohibited state is completed for all the segments, the process 470 is terminated.

The point switch management process 470 is repeatedly performed with a cycle of, for example, about every fifty milliseconds. The latest versions of the various information available at a time of the start of each cycle, are used. The point switch management process 470 is performed after the use permission segment list preparation process 440 (see FIGS. 11 and 12) is completed. In this case, the point switch management process 470 is, for example, performed alternately with the use permission segment list preparation process 440. Thereby, the segment use permission registration file 404 updated by the use permission segment list preparation process 440 is provided to the point switch management process 470, and the segment travelable state information 422 updated by the point switch management process 470 is provided to the use permission segment list preparation process 440. Alternatively, the point switch management process 470 may be, for example, performed in a time period from when a loop of steps 441S, 441E is terminated to when step 449 is performed in the use permission segment list preparation process 440.

<Interval Control Device 500>

The interval control device 500 obtains the use permission segment list 421 from the segment use permission setting part 401, and obtains train's detailed information 121 via the transmission device 300 from all the trains currently existing on the tracks. Then, based on the use permission segment list 421 and the train's detailed information 121 thus obtained, the interval control device 500 prepares information (here, the stop limit information 522) for controlling the interval with the preceding train, and delivers the prepared stop limit information 522 to the trains via the transmission device 300. More specifically, the elements of the interval control device 500 operate as follows.

<Train Presence Managing Part 501>

The train presence managing part 501 obtains the train's detailed information 121 of all the trains currently existing on the tracks, which has been collected by the train's detailed information collecting part 304. Then, the train presence managing part 501 records it on the train presence registration file 503. The train presence managing part 501 provides the train's detailed information 121 to the interval control information preparing part 502.

<Interval Control Information Preparing Part 502>

The interval control information preparing part 502 obtains the train's detailed information 121 and the use permission segment list 421, and prepares the stop limit information 522 of each train based on the train's detailed information 121 and the use permission segment list 421.

Figure 17:
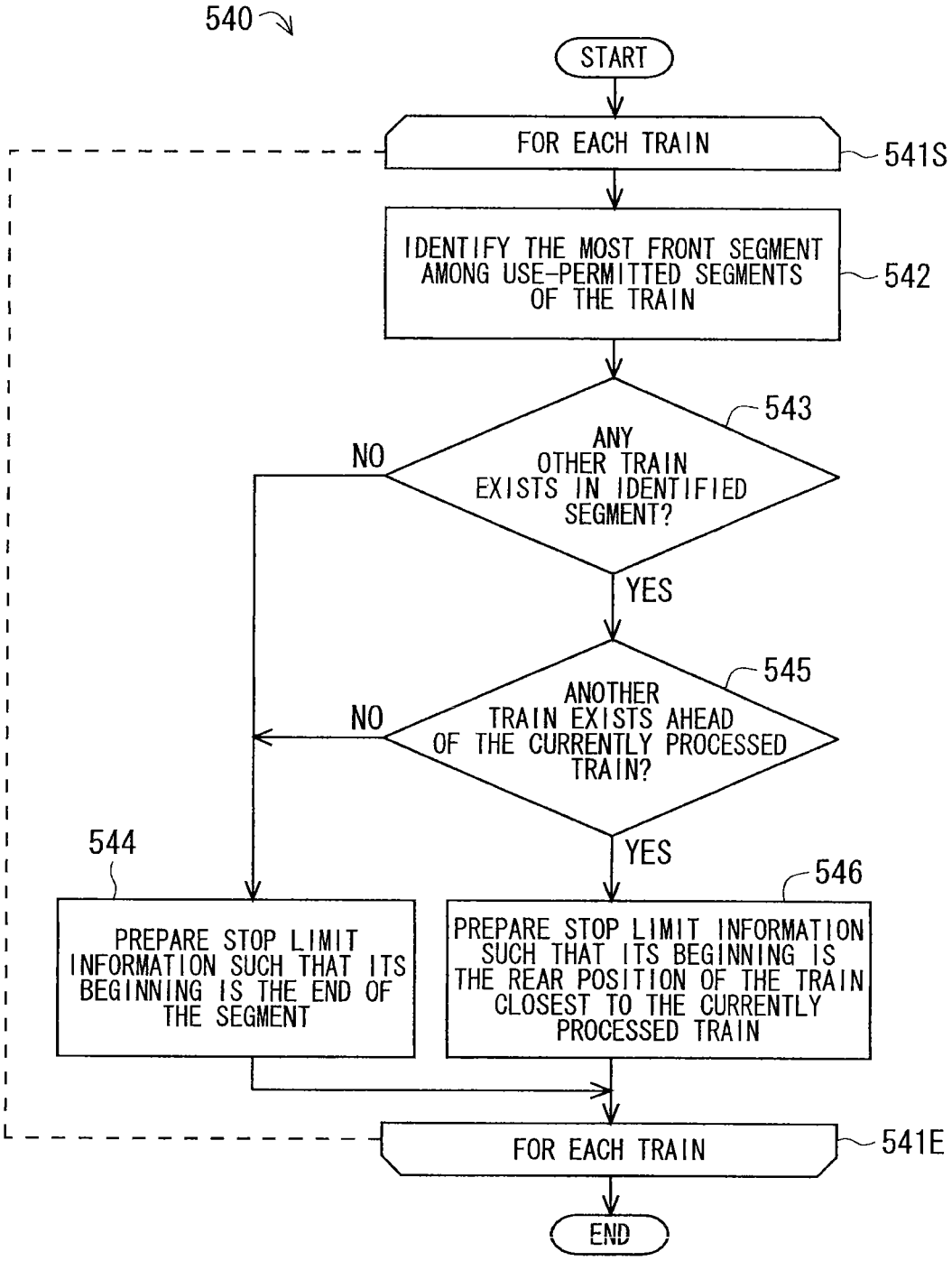
FIG. 17 A flowchart illustrating a process performed by an interval control information preparing part according to the embodiment 1.

FIG. 17 is a flowchart illustrating a stop limit information preparation process performed by the interval control information preparing part 502. In a stop limit information preparation process 540 illustrated in FIG. 17, the process is performed for each train (steps 541S, 541E).

Firstly, the use permission segment list 421 is referred to, to identify a segment located farthest in the advancing direction (in other words, the most front segment) among the use permission segments of the train selected as the processing object (step 542).

Then, whether or not any other train different from the currently processed train exists in the identified segment, is checked (step 543). When it is determined that no other train exists, the stop limit information 522 is prepared such that its beginning is the position of the end (the end closer to the advancing direction) of the segment identified in step 542 (step 544).

In a case where the stop limit information 522 is information of the position at which the train should stop, the position that is shifted from the above-described segment end position toward the current position of the train and that is distant therefrom by a predetermined security allowance distance is set as the stop limit information 522. In a case where the predetermined security allowance distance is zero, the position indicated by the stop limit information 522 and the segment end position are coincident with each other.

In a case where the stop limit information 522 is constituted by multiple information including the reference position for determining the stop position and a flag indicating the type of the reference position, the reference position is set to the segment end position, and the flag indicating the type of the reference position is set to a flag indicating that the reference position is the segment end position.

When, as a result of step 543, it is determined that another train exists in the segment identified in step 542, whether or not this another train exists ahead of the currently processed train, is checked (step 545).

When it is determined in step 545 that the above-described another train does not exist ahead of the currently processed train, the stop limit information 522 is prepared such that its beginning is the end position of the identified segment (step 544).

When it is determined in step 545 that the above-described another train exists ahead of the currently processed train, the stop limit information 522 is prepared such that its beginning is the rear position of the train ahead of and closest to the currently processed train (step 546).

The processing of steps 545, 544, and 546 is particularly effective in a case where the number of use permission segments of the train that is the current processing object is only one. This is because, in such a case, the segment where the processing object train currently exists corresponds to the segment identified in step 542, that is, the use permission segment located at the most front. Since not only the processing object train but also another train exists in the same segment, it is necessary that the position of the beginning of the stop limit information 522 is varied depending on whether this another train is ahead of the processing object train or behind the processing object train (see steps 544 and 546).

After steps 544 and 546, the process moves to the next train (steps 541E, 541S). Upon preparation of the stop limit information 522 for all the trains, the process 540 is terminated.

The stop limit information preparation process 540 is repeatedly performed with a cycle of, for example, about every fifty milliseconds. The latest versions of the various information available at a time of the start of each cycle, are used.

The interval control device 500 prepares the stop limit information 522 by using the use permission segment list 421 prepared by the course control device 400. As already described, the use permission segment list 421 is prepared so as not to include the travel-prohibited segment, that is, so as to include only the travelable segment (see steps 449 to 452 in FIG. 12). Therefore, when preparing the stop limit information 522, it is not necessary for the interval control device 500 to consider the travel-prohibited segment (for example, the travel-prohibited state is set because the direction of the point switch is being switched, though a competition in terms of the train operation is not caused). This can simplify the process performed by the interval control device 500.

According to steps 522 and 523, a search range for the preceding train of the processing object train is limited to the most front segment. The reason therefor is as follows.

To be more specific, in step 448 (see FIG. 11) of the use permission segment list preparation process 440 described above, the registration of the use permission segment is terminated at the segment for which the use permission is simultaneously registered with respect to another train. Therefore, the use permission segment where another train may possibly exist is the segment for which the use permission has been registered lastly, that is, the segment located at the most front among the segments for which the use permissions have been registered. In other words, the processing of step 448 makes sure that no other trains exist in the registered use permission segments other than the most front segment. This enables the search range for preceding another train to be limited to the registered use permission segments located at the most front.

Limiting the search range for preceding another train in this manner can reduce the amount of processing required for searching for another train. Thus, the process performed by the interval control device 500 can be simplified.

<Effects Provided by Train Operation Control System 90>

In the train operation control system 90, as described above, the "segment" is introduced that is defined based on the point-switch protection section, the control direction of the point switch, and the advancing direction of the train, and a competition for the segment used by each train is determined, to thereby control the operation of the train. A complicated calculation using the train position is not required for defining the segment, setting the segment competition information, managing the train operation based on the segment, and the like. Thus, the process concerning the course competition can be simplified.

In the segment competition table (see FIG. 6) illustrated for the train operation control system 90, even when the same track section is shared, the competitive relationship is not set between the same segment. This enables a plurality of trains traveling in the same direction to simultaneously travel on the same track section. Accordingly, a train control based on the moving block system can be adopted in a station yard. The adoption can improve the efficiency of the operation.

Embodiment 2

Figure 18:
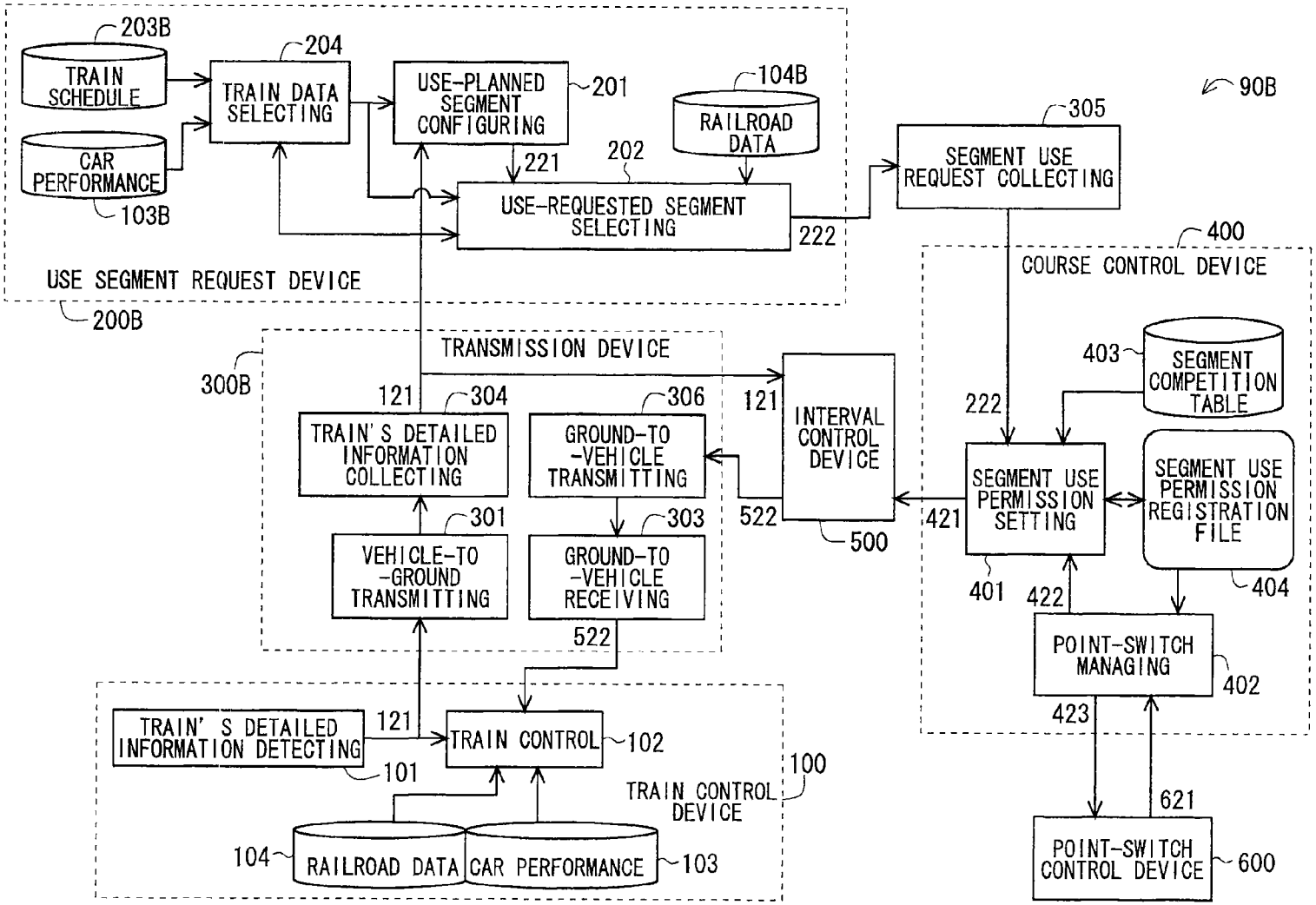
FIG. 18 A block diagram illustrating a configuration of a train operation control system according to the embodiment 2.

FIG. 18 is a block diagram illustrating a configuration of a train operation control system 90B according to an embodiment 2. The train operation control system 90B is basically configured in the same manner as the train operation control system 90 (see FIG. 7) according to the embodiment 1, except for the following points. In the illustration shown in FIG. 18, the same elements as those in the embodiment 1 may be simplified.

The train operation control system 90B includes a use segment request device 200B instead of the use segment request device 200 (see FIG. 7). Although the use segment request device 200 is mounted on the train, the use segment request device 200B is installed on the ground and included in the on-ground device. The use segment request device 200B which will be described later.

The train operation control system 90B includes a transmission device 300B instead of the transmission device 300 (see FIG. 7). The configuration of the transmission device 300B is different from the configuration of the transmission device 300, in that the vehicle-to-ground transmitting part 302 and the segment use request collecting part 305 are not provided. Here, the segment use request collecting part 305 is provided separately from the transmission device 300. The train's detailed information collecting part 304 of the transmission device 300B outputs the collected train's detailed information 121 of each train not only to the interval control device 500 but also to the use segment request device 200B.

The use segment request device 200B is common to the use segment request device 200 in that the use-requested segment list 222 is prepared. However, the on-vehicle use segment request device 200 prepares only the use-requested segment list 222 of the corresponding train, but the on-ground use segment request device 200B prepares the use-requested segment list 222 of all the trains currently existing on the tracks. Accordingly, the use segment request device 200B includes, in addition to the use-planned segment configuring part 201 and the use-requested segment selecting part 202, a train schedule data storage part 203B, a car performance data storage part 103B, a railroad data storage part 104B, and a train data selecting part 204. In the following description, the reference signs 203B, 103B, and 104B may be also used to refer to data stored in the storage parts 203B, 103B, and 104B.

The train schedule data 203B, the car performance data 103B, and the railroad data 104B include contents concerning all the trains for which the use-requested segment list 222 is to be prepared. In other words, in the embodiment 1, the use segment request device 200 and the train control device 100 are mounted on the train, and therefore it is acceptable that the train schedule data 203, the car performance data 103, and the railroad data 104 include the content concerning the corresponding train.

The train data selecting part 204 obtains the train's detailed information 121 of each train collected by the train's detailed information collecting part 304, and based on the train 1D included in the train's detailed information 121, reads out train schedule data 203B and car performance data 103B of the corresponding train from the storage parts 203B and 103B. Then, the train data selecting part 204 supplies the data 203B and 103B thus read out, to the use-planned segment configuring part 201 and the use-requested segment selecting part 202.

Based on the data data 203B and 103B of each train, the use-planned segment configuring part 201 and the use-requested segment selecting part 202 prepare the use-planned segment list 221 and the use-requested segment list 222 for each train. For the preparation of the use-planned segment list 221 and the use-requested segment list 222 of each train, the use-planned segment configuring part 201 and the use-requested segment selecting part 202 obtain the train's detailed information 121 of each train from the train's detailed information collecting part 304. The use-requested segment list 222 of each train is collected by the segment use request collecting part 305, and supplied to the course control device 400.

In the train operation control system 90B, the use segment request device 200 which, in the embodiment 1, is mounted on each train is gathered on the ground as the use segment request device 200B, and the need for providing the vehicle-to-ground transmitting part 302 for each train is eliminated. This achieves simplification of the entire system.

Embodiment 3

Figure 19:
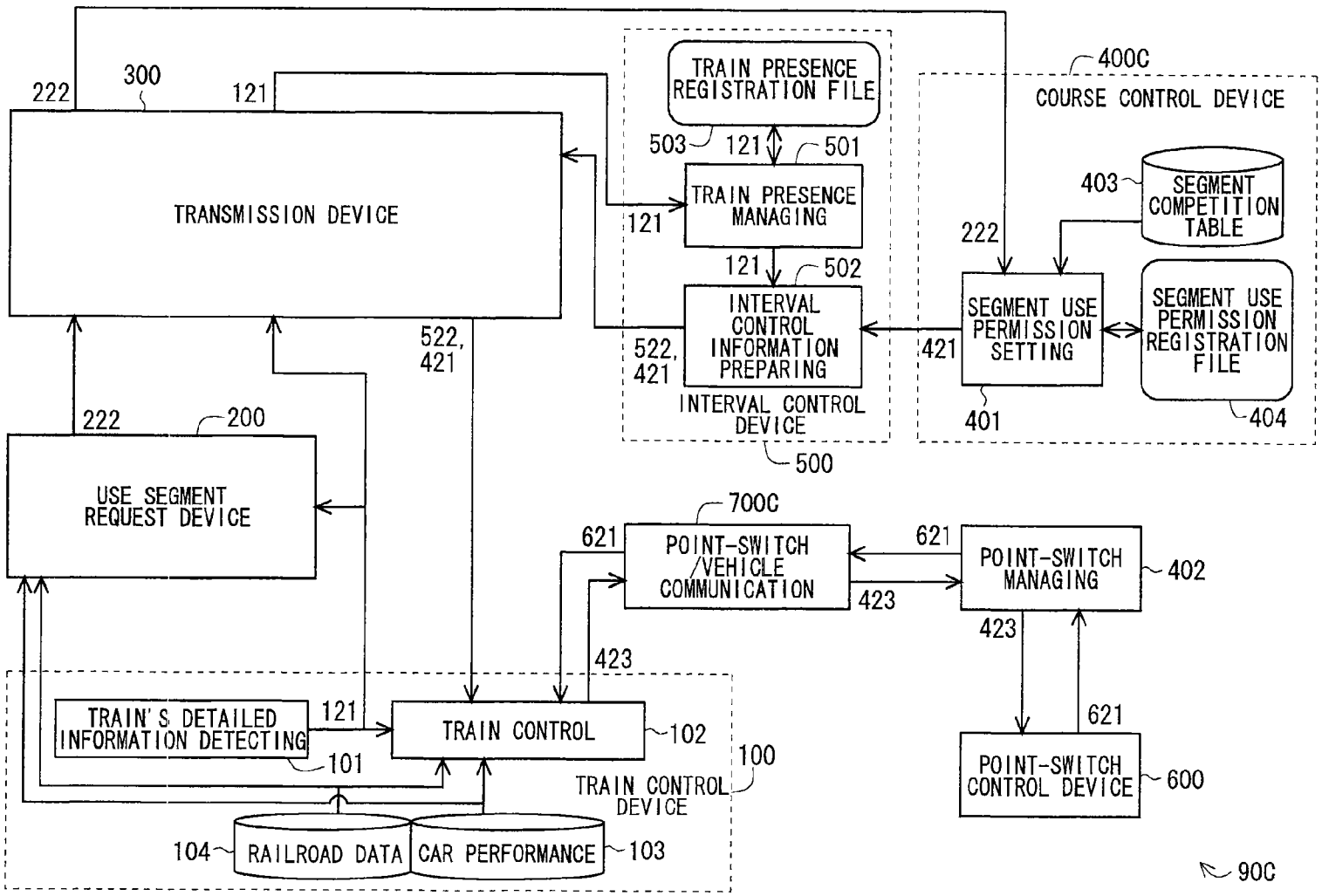
FIG. 19 A block diagram illustrating a configuration of a train operation control system according to the embodiment 3.

FIG. 19 is a block diagram illustrating a configuration of a train operation control system 90C according to an embodiment 3. The train operation control system 90C is basically configured in the same manner as the train operation control system 90 (see FIG. 7) according to the embodiment 1, except for the following points. In the illustration shown in FIG. 19, the same elements as those in the embodiment 1 may be simplified.

The train operation control system 90C includes a course control device 400C instead of the course control device 400 (see FIG. 7). The configuration of the course control device 400C is different from the configuration of the course control device 400, in that the point-switch managing part 402 is not provided. The point-switch managing part 402 is provided separately from the course control device 400C. The segment travelable state information 422 is not supplied from the point-switch managing part 402 to the segment use permission setting part 401. That is, in the train operation control system 90C, the point-switch managing part 402 is isolated from the course control device 400C.

As described above, the segment use permission setting part 401 does not obtain the segment travelable state information 422 from the point-switch managing part 402. Therefore, in a case where the segment use permission setting part 401 operates in the same manner as in the embodiment 1 (see FIGS. 11 and 12), a result of the determination made in step 450 (see FIG. 12) for determining whether or not there is a travel-prohibited segment is always NO (there is no travel-prohibited segment).

The use permission segment list 421 prepared in the segment use permission setting part 401 is, similarly to the embodiment 1, outputted to the interval control information preparing part 502, and used for the preparation of the stop limit information 522 in the interval control information preparing part 502. Particularly in the embodiment 3, the interval control information preparing part 502 transmits the use permission segment list 421 as well as the prepared stop limit information 522 to the train control part 102.

When the received use permission segment list 421 includes any segment including a point switch, the train control part 102 sends an inquiry about the state of the point switch directly to the point-switch managing part 402 via the point-switch/vehicle communication part 700C. Thus, in the train operation control system 90C, the train control part 102 obtains the point-switch state information 621 from the point-switch managing part 402 via the point-switch/vehicle communication part 700C.

Upon a determination, based on the obtained point-switch state information 621, that it is necessary to cause a switchover of the point switch, the train control part 102 outputs the point switch control command 423 to the point-switch managing part 402 via the point-switch/vehicle communication part 700C. Then, the point-switch managing part 402 having obtained the point switch control command 423 instructs to switch the direction of the point switch.

Thus, in the train operation control system 90C, the train control part 102 controls the direction of the point switch.

Until the switchover of the direction of the point switch is completed, the train control part 102 sets the stop limit position to a position before the corresponding segment (that is, a position at the train side), thus preventing the train from entering the corresponding segment.

In the train operation control system 90C, the course control device 400C does not have to perform the switch control. Therefore, the process performed by the course control device 400C is simplified.

Since the course control device 400C does not have to control the point switch provided in a predetermined position of the track, it is possible that the course control device 400C is installed at a position distant from a station facility. Accordingly, for example, the course control devices corresponding to all the stations can be gathered to one location, which can simplify the entire system.

Embodiment 4

Figure 20:
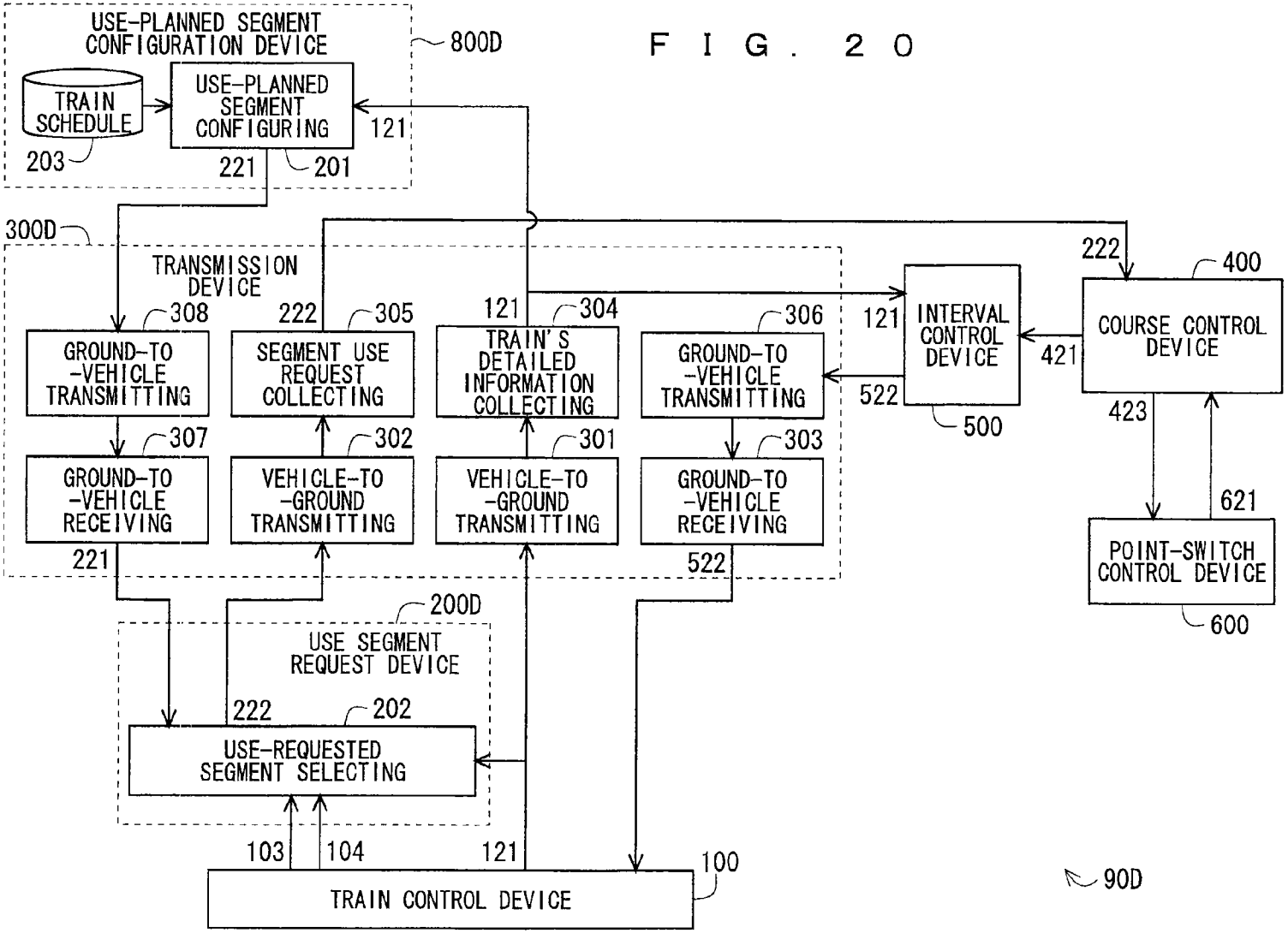
FIG. 20 A block diagram illustrating a configuration of a train operation control system according to the embodiment 4.

FIG. 20 is a block diagram illustrating a configuration of a train operation control system 90D according to an embodiment 4. The train operation control system 90D is basically configured in the same manner as the train operation control system 90 (see FIG. 7) according to the embodiment 1, except for the following points. In the illustration shown in FIG. 20, the same elements as those in the embodiment 1 may be simplified.

The train operation control system 90D includes a use segment request device 200D and a transmission device 300D instead of the use segment request device 200 and the transmission device 300 (see FIG. 7). The train operation control system 90D further includes a use-planned segment configuration device 800D. The use-planned segment configuration device 800D is installed on the ground, and included in the on-ground device.

The configuration of the use segment request device 200D is different from the configuration of the use segment request device 200 (see FIG. 7), in that the use-planned segment configuring part 201 and the train schedule data storage part 203 are not provided. Accordingly, the use-planned segment configuration device 800D includes the use-planned segment configuring part 201 and the train schedule data storage part 203. That is, the use-planned segment configuring part 201 and the train schedule data storage part 203, which are mounted on the vehicle in the embodiment 1, are installed on the ground.

The transmission device 300D has the same configuration as that of the transmission device 300 (see FIG. 7), except that a ground-to-vehicle receiving part 307 and a ground-to-vehicle transmitting part 308 are additionally provided.

In the train operation control system 90D, the use-planned segment configuring part 201 installed on the ground obtains the train's detailed information 121 of each train from the train's detailed information collecting part 304, and prepares the use-planned segment list 221 for each train in the same manner as in the embodiment 1. The use-planned segment configuring part 201 outputs the prepared use-planned segment list 221 to the ground-to-vehicle transmitting part 308, and the ground-to-vehicle transmitting part 308 delivers, to each train, the corresponding use-planned segment list 221. The ground-to-vehicle receiving part 307 mounted on each train receives the use-planned segment list 221 of the own train, and transfers it to the use-requested segment selecting part 202. Based on the obtained use-planned segment list 221, the use-requested segment selecting part 202 prepares the use-requested segment list 222 in the same manner as in the embodiment 1.

In the train operation control system 90D, the train does not possess the train schedule data 203. Therefore, it is not necessary that a data update caused by, for example, changing a schedule is performed for all the trains. This eliminates the need for a facility that changes the train schedule data mounted on the train. Additionally, a system operation can be performed simply and flexibly.

In the train operation control system 90D, the use-requested segment selecting part 202 is mounted on the train. This can shorten a time required for the use-requested segment selecting part 202 to obtain the train's detailed information 121 from the train's detailed information detecting part 101, as compared with the train operation control system 90B (see FIG. 18) in which the use-requested segment selecting part 202 is installed on the ground. That is, in the train operation control system 90D, the transmission device 300 is not interposed when the use-requested segment selecting part 202 obtains the train's detailed information 121, and therefore an influence concerning a communication delay does not occur. This enables the use-requested segment list 222 to be prepared and outputted at an appropriate timing. The same effect is true for the train operation control system 90, too.

Embodiment 5

Figure 21:
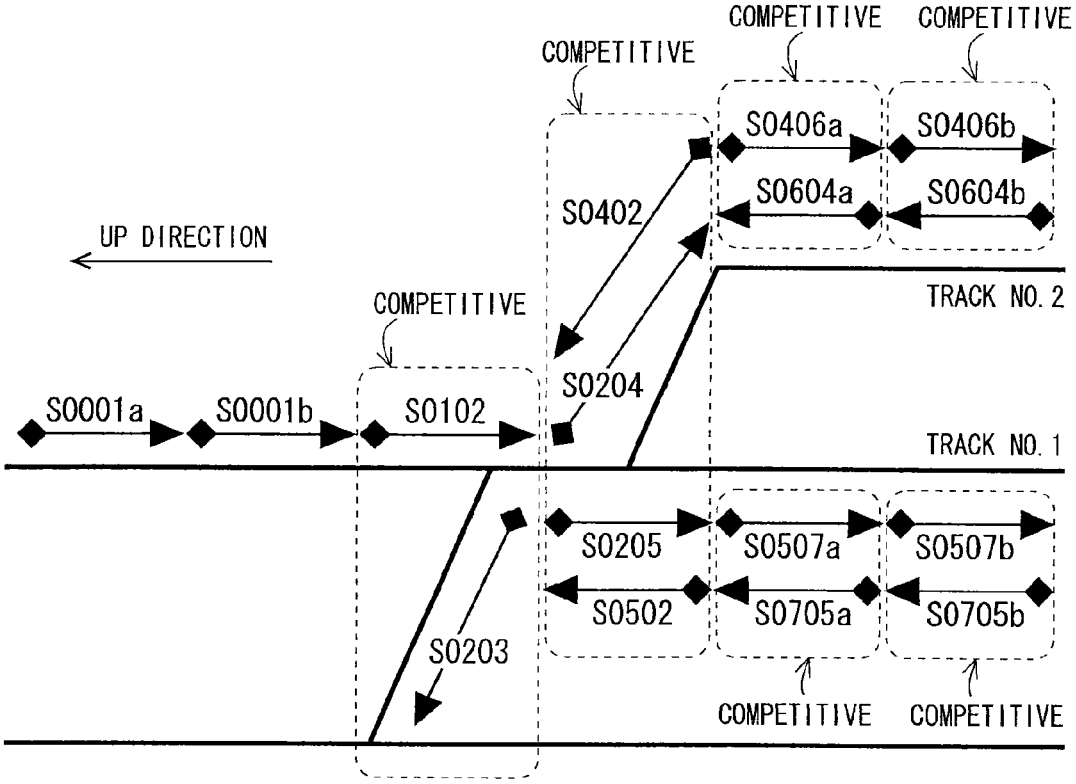
FIG. 21 A diagram schematically illustrating a definition of a segment according to the embodiment 5.

FIGS. 21 and 22 are diagrams schematically illustrating a segment definition diagram and a segment competition table according to an embodiment 5.

The segment definition diagram illustrated in FIG. 21 is different from that in FIG. 5, in that a segment other than the point-switch protection section is divided into a plurality of segments.

The segment competition table shown in FIG. 22 corresponds to the segment definition diagram shown in FIG. 22. The segment competition table illustrated in FIG. 22 is different from that in FIG. 6, in that the marks "x" are given to diagonal components. That is, the segment competition table shown in FIG. 22 is based on a rule that the competitive relationship is set between all the segments that share the same track section. In other words, only condition (a) of the conditions (a) and (b) described in FIG. 6 is applied. As a result, in the embodiment 5, the use permission for one segment is obtained by only one train. Thus, a train operation control method that is similar to the fixed block system is adopted.

Figure 23:
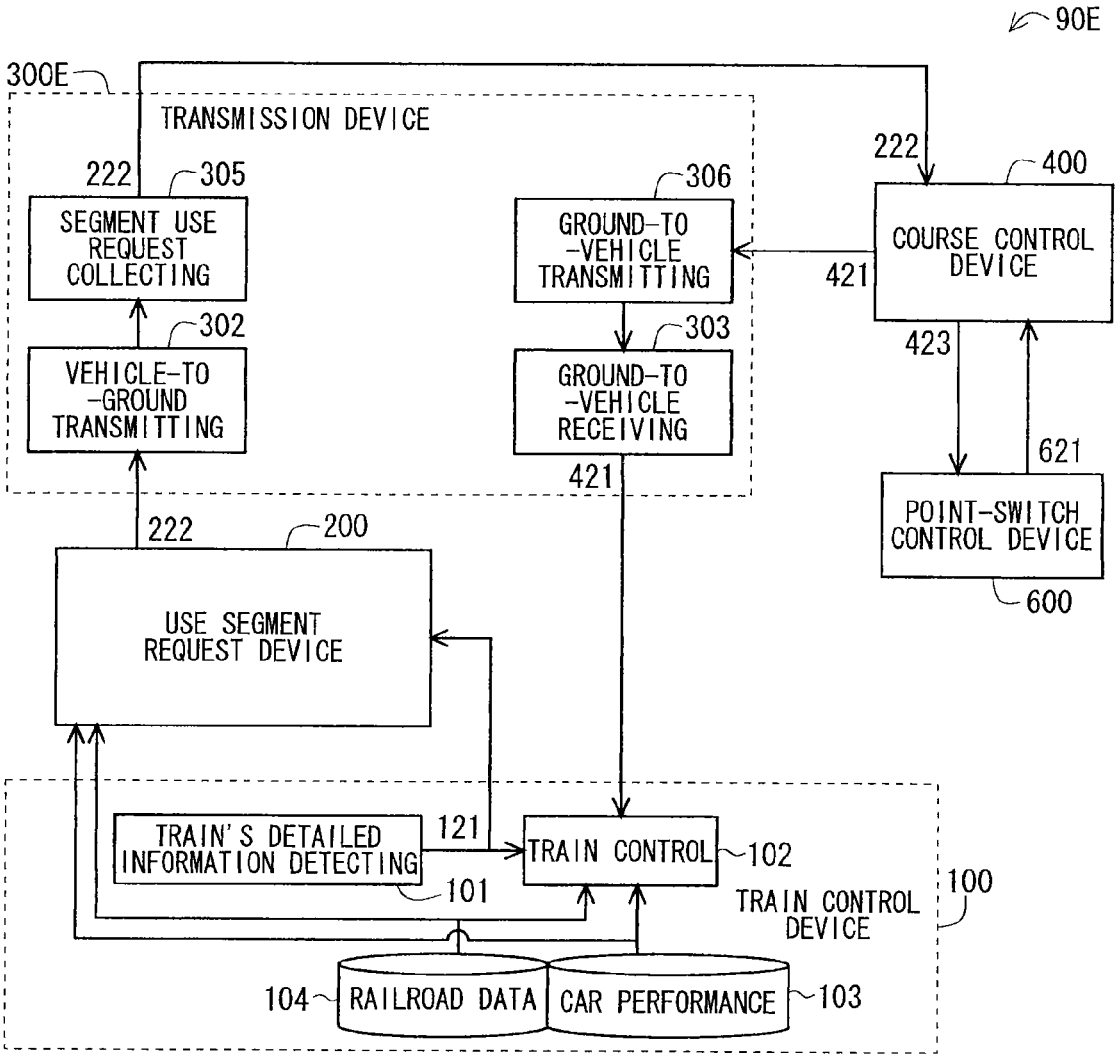
FIG. 23 A block diagram illustrating a configuration of a train operation control system according to the embodiment 5.

FIG. 23 is a block diagram illustrating a configuration of a train operation control system 90E according to the embodiment 5. The train operation control system 90E is basically configured in the same manner as the train operation control system 90 (see FIG. 7) according to the embodiment 1, except for the following points. In the illustration shown in FIG. 23, the same elements as those in the embodiment 1 may be simplified.

The train operation control system 90E does not include the interval control device 500 (see FIG. 7). Accordingly, a transmission device 300E is provided instead of the transmission device 300. The configuration of the transmission device 300E is different from the configuration of the transmission device 300, in that the vehicle-to-ground transmitting part 301 and the train's detailed information collecting part 304 are not provided.

The use permission segment list 421 prepared in the segment use permission setting part 401 is transmitted to the train control part 102 via the ground-to-vehicle transmitting part 306 and the ground-to-vehicle receiving part 303. Based on the received use permission segment list 421, the train control part 102 sets the stop limit position of the own train. That is, since the interval control device 500 that transmits the stop limit information 522 (see FIG. 7) is not provided, the train control part 102 instead of the interval control device 500 prepares the stop limit information.

For example, the train control part 102 identifies the most front segment (in other words, the segment located farthest in the advancing direction) among the segments for which the use permission is given to the own train, and sets the stop limit position such that its beginning is the position of the end (the end at the advancing side) of the most front segment. For example, the position that is shifted from the end position of the most front segment toward the current position of the train and that is distant therefrom by a predetermined security allowance distance is set as the stop limit position. The train control part 102 controls traveling of the own train based on the stop limit information that the train control part 102 itself has prepared.

In the train operation control system 90E, the interval control device 500 (see FIG. 7) is not provided, and therefore the entire system can be simplified.

Additionally, increasing the number of division of the segment as necessity allows the operation to be performed under a state where the train is closer, unlike a case of using a physically fixed block. Thus, the efficiency of the operation can be improved.

Embodiment 6

<Oncoming Course and Deadlock>

A problem that may arise when two trains travel in opposite directions will be described with reference to FIG. 24, before a description of a specific example according to an embodiment 6. In an example shown in FIG. 24, a railway network similar to that of FIG. 5 is illustrated, the segment is defined in the same manner as in FIG. 5, and the competitive relationship between segments is defined in the same manner as in FIG. 6.

Figure 24:
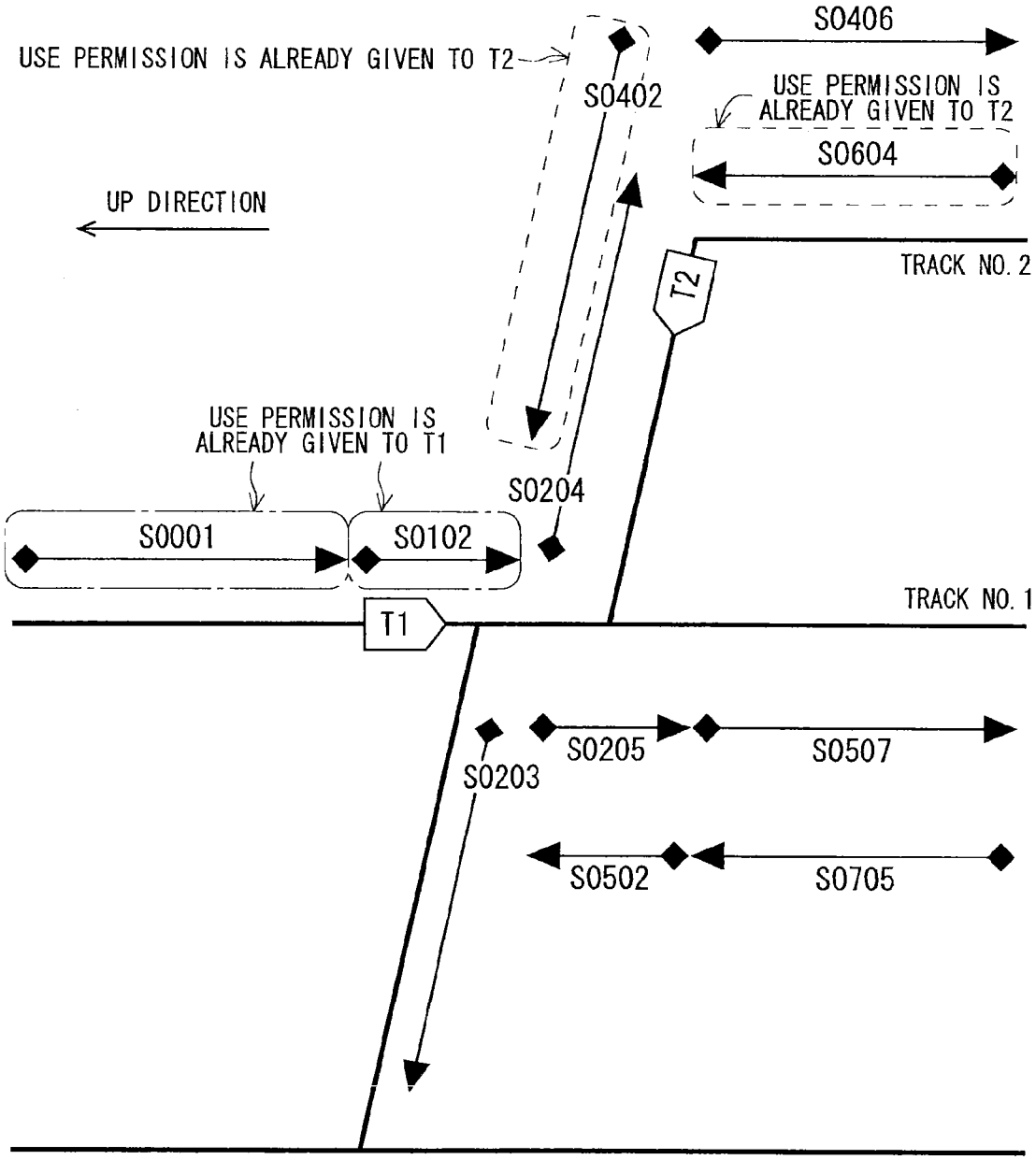
FIG. 24 An explanatory diagram illustrating a situation where a deadlock occurs between two opposing trains in a station yard.

In FIG. 24, it is assumed that: the train T1 travels in the down direction and stops on the track No. 1; and the train T2 travels in the up direction from the track No. 2, and leaves for the next station. In this case, in order that the train T1 can arrive at the track No. 1, it is necessary to obtain the use permissions for a sequence of segments starting from the current position toward the down direction (herein, S0001→S0102→S0205→S0507). In order that the train T2 can travel from the track No. 2 toward the next station, it is necessary to obtain the use permissions for a sequence of segments starting from the current position toward the up direction (herein, S0604→S0402→S0203→(skip the rest)).

In the segment competition table shown in FIG. 6, no competitive relationship is established between the segment S0102 and the segment S0402. Therefore, the train T1 is able to obtain the use permission for the segment S0102, and the train T2 is able to obtain the use permission for the segment S0402. Accordingly, depending on timings at which the two trains T1 and T2 request the segments, a situation may occur in which the train T1 obtains the use permissions for the segments S0001 and S0102 and the train T2 obtains the use permission for the segments S0604 and S0402, as shown in FIG. 24.

Under such a situation, the train T1 has to obtain the use permission for the segment S0205 next, but in the segment competition table shown in FIG. 6, the use permission for the segment S0402 that is in the competitive relationship with the segment S0205 is obtained by the train T2. On the other hand, the train T2 has to obtain the use permission for the segment S0203 next, but in the segment competition table shown in FIG. 6, the use permission for the segment S0102 that is in the competitive relationship with the segment S0203 is obtained by the train T1. Accordingly, both of the trains T1 and T2 can obtain the use permissions for their desired segments.

The stop limit information prepared by the interval control device 500 causes the train T1 to stop at the position whose beginning is the end of the segment S0102, and causes the train T2 to stop at the position whose beginning is the end of the segment S0402. Thereafter, both of the trains T1 and T2, which are facing each other, cannot travel toward their destination points.

In such a state, either one of the trains has to travel backward. A state where the need for the backward traveling arises will be referred to as "deadlock". Occurrence of the deadlock may significantly reduce the efficiency of the operation of the train.

In the track distribution shown in FIG. 5 and the segment competition table shown in FIG. 6, there is a possibility that the deadlock occurs but the deadlock may not occur when the track distribution has a simple configuration including only an up line and a down line, or may not occur depending on operation conditions.

Example According to Embodiment 6

Figure 25:
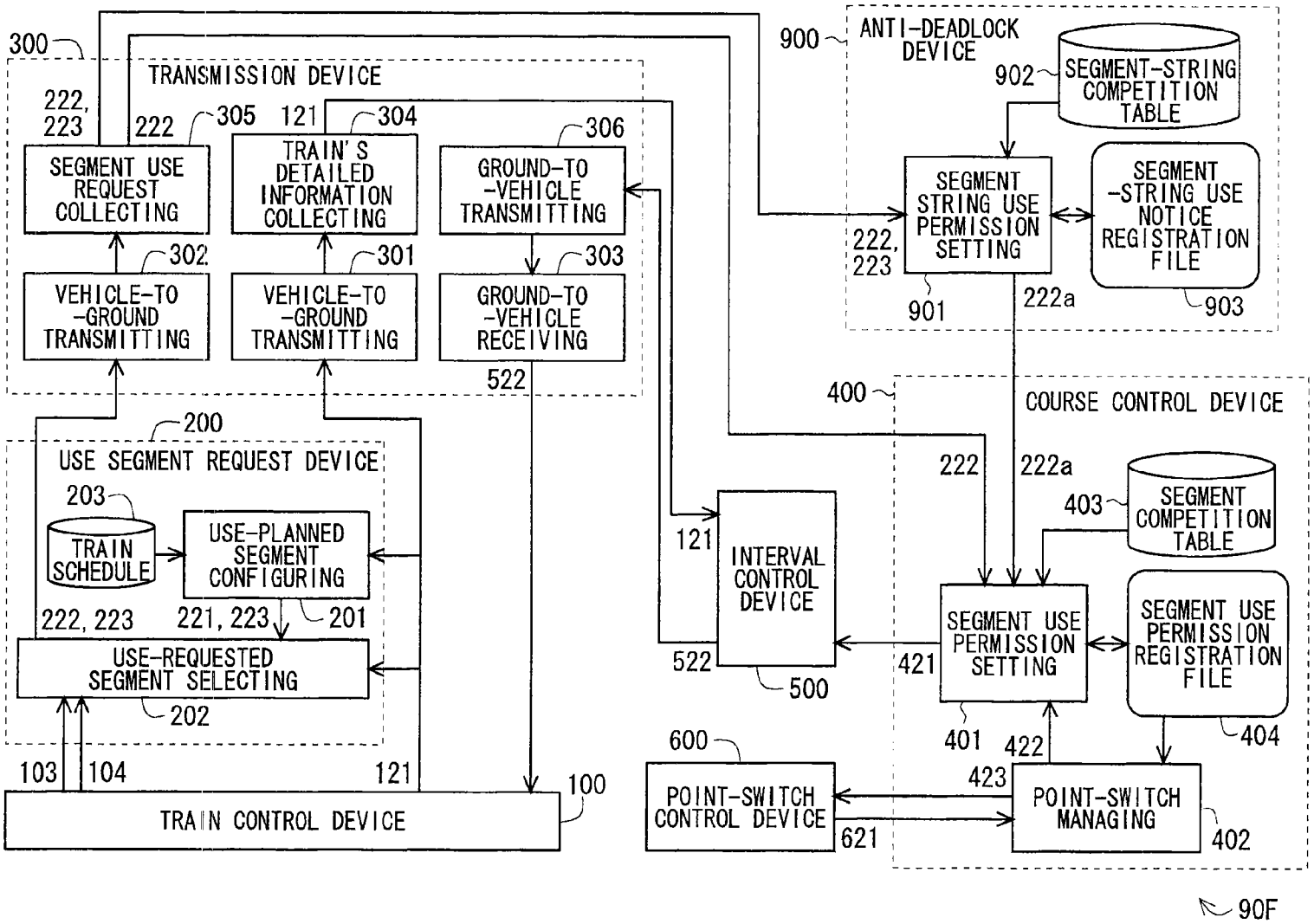
FIG. 25 A block diagram illustrating a configuration of a train operation control system according to an embodiment 6.

FIG. 25 is a block diagram illustrating a configuration of a train operation control system 90F according to the embodiment 6. The train operation control system 90F is basically configured in the same manner as the train operation control system 90 (see FIG. 7) according to the embodiment 1, except for the following points. In the illustration shown in FIG. 25, the same elements as those in the embodiment 1 may be simplified.

The configuration of the train operation control system 90F is different from the configuration of the train operation control system 90 according to the embodiment 1, in that an anti-deadlock device 900 is additionally provided. The train operation control system 90 is modified as appropriate in accordance with the addition of the anti-deadlock device 900.

<Anti-Deadlock Device 900>

The anti-deadlock device 900 is, similarly to the course control device 400, installed on the ground. In the example shown in FIG. 25, the anti-deadlock device 900 includes a segment string use permission setting part 901, a segment-string competition table storage part (in other words, a segment-string competition information storage part) 902, and a segment-string use notice registration file storage part (in other words, a segment-string use notice information storage part) 903.

In the following description, the reference sign 902 may be also used to refer to the segment-string competition table (in other words, segment-string competition information) stored in the storage part 902. Likewise, the reference sign 903 may be also used to refer to the segment-string use notice registration file (in other words, segment-string use notice information) stored in the storage part 903. The two storage parts 902 and 903 may be configured as a single storage device, or may be configured as separate storage devices. An operation of the anti-deadlock device 900 will be detailed later.

<Segment String>

Figure 26:
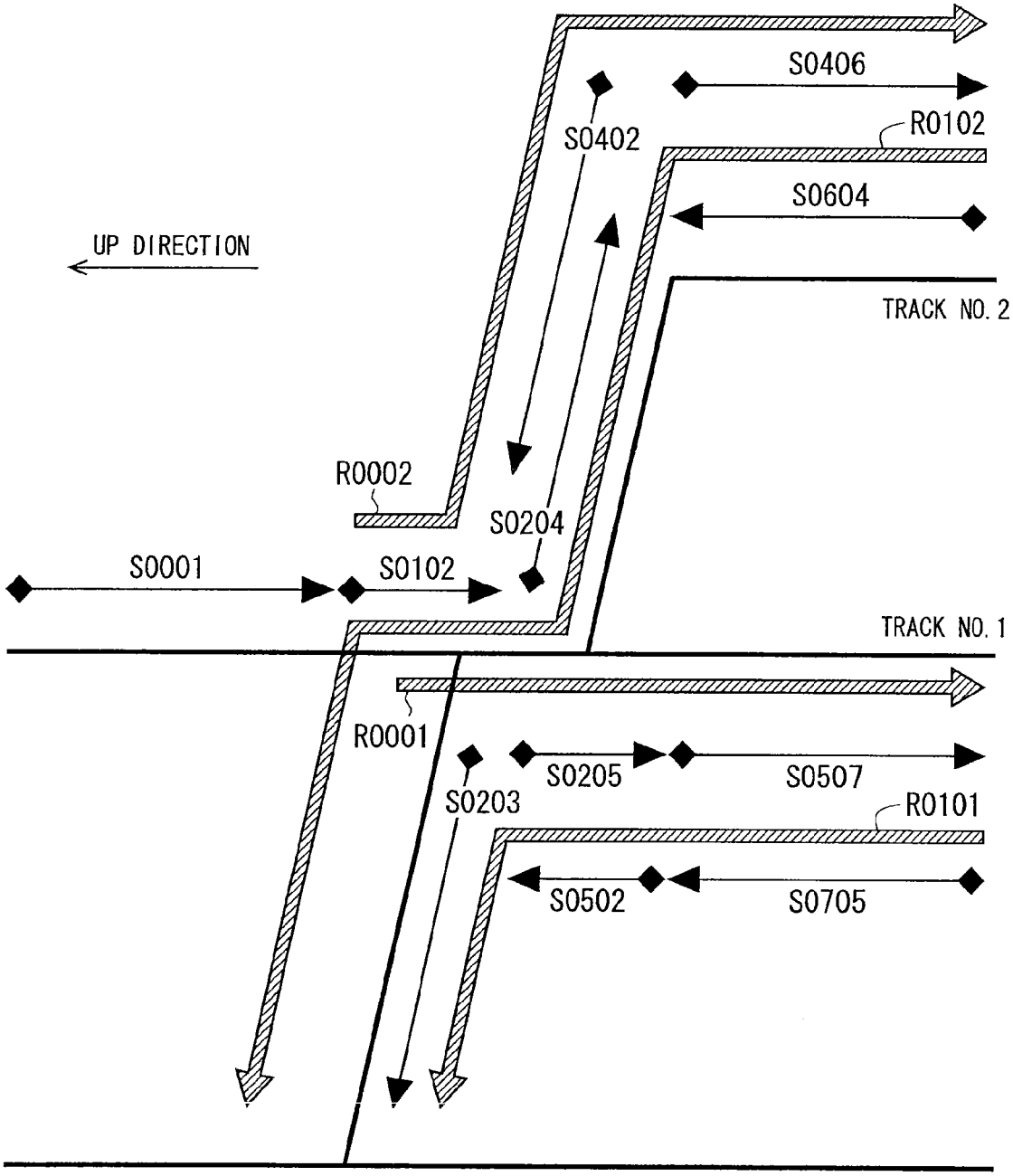
FIG. 26 A diagram schematically illustrating segment strings according to the embodiment 6.

The segment string is a concept under which a plurality of segments directed to the same direction is handled as a group. FIGS. 26 and 27 illustrate segment strings. FIG. 26 shows an example of defining the segment string with respect to the segment definition diagram of FIG. 5.

In the example shown in FIGS. 26 and 27, segment strings R0001, R0002, R0101, and R0102 are illustrated. For example, the segment string R0001 includes three segments S0102, S0205, and S0507 in the down direction. Herein, it is assumed that segments included in a segment string are arranged in accordance with the order in which the train travels on the track distribution (see FIG. 27).

In the example shown in FIGS. 26 and 27, the type "inside" or the type "departure" is set to each of the segment strings R0001, R0002, R0101, and R0102. The type "inside" indicates that the train enters a certain track No. of the station yard. The type "departure" indicates that the train leaves a certain track No. of the station yard for the next station. Another type may be set in addition to or instead of "inside" and "departure". For example, the type "shunting" indicating that track No. is changed in the station yard may be defined, and the type "shunting" may be set to a segment string.

As shown in FIG. 27, information (which herein will be called a segment-string definition information) concerning the definition of each segment string can be collected into data in the form of a table, for example. However, the form of the data is not limited to a table.

The segment string is defined for a segment string in which there is a possibility that the deadlock occurs between two trains traveling in opposite directions. Accordingly, it is not necessary to define the segment string in a case where, for example, the track distribution, an operation method, or the like, does not include segments in opposite directions.

In addition to the segment definition information (see FIGS. 2 and 4), the segment-string definition information shown in FIGS. 26 and 27 is supplied in advance to the anti-deadlock device 900. Likewise, the segment-string definition information is supplied in advance to the use segment request device 200, too.

<Segment-String Competition Table>

The segment-string competition table is information (which will be called segment-string competition information) concerning the competitive relationship between segment strings being collected into data in the form of a table. However, it may be acceptable that the segment-string competition information is managed in a data form other than a table format.

FIG. 28 illustrates a segment-string competition table 902 corresponding to the segment definition diagram shown in FIG. 5 and the segment string definition diagram shown in FIG. 26. In FIG. 28, a combination of segment strings having no competitive relationship with each other is given the mark "○", and a combination of segment strings having a competitive relationship with each other is given the mark "x". In an example shown in FIG. 28, the segment-string competition table 902 is a symmetric matrix, and therefore illustration of the upper half is omitted.

In the segment-string competition table, a competitive relationship is set between such segment strings that there is a possibility that the deadlock occurs, in a case where the directions of the segment string (in other words, the train advancing directions in the segment string) are opposite to each other and trains travel in these segment strings. To be more specific, in a case where trains travel in the segment strings R0001 and R0102, as described with reference to FIG. 24, there is a possibility that the deadlock occurs. Therefore, the competitive relationship is set between these segment strings R0001 and R0102. Likewise, the competitive relationship is set for a combination of R0001 and R0101, a combination of R0002 and R0101, and a combination of R0002 and R0102.

<Segment String Use Notice>

Referring to FIG. 25 again, in the embodiment 6, the use segment request device 200 prepares the use-requested segment list 222 and then prepares a use-noticed segment string list (in other words, use-noticed segment string information) 223. In this embodiment 7, not only the segment definition information (see FIGS. 2 and 4) but also the segment-string definition information (see FIG. 27) is supplied in advance to the use segment request device 200.

The use-noticed segment string list 223 thus prepared is, at the same timing as that for the use-requested segment list 222, transmitted to the anti-deadlock device 900 via the transmission device 300. More specifically, the elements of the use segment request device 200 operate as follows.

As described in the embodiment 1, the use-planned segment configuring part 201 prepares the use-planned segment list 221. In a case where the train is scheduled to turn back in a station, the use-planned segment list 221 is prepared so as to include segments having different directions. More specifically, in the example shown in FIG. 5, in a case where the train T1 that is directed to the down direction and existing in the segment S0001 has a plan to stop on the track No. 1 and then leave for a station located in the opposite direction, the use-planned segment list 221 includes segments S0705, S0502, and S0203 in addition to the segments S0001, S0102, S0205, and S0507. Moreover, the use-planned segment configuring part 201 prepares the use-noticed segment string list 223 corresponding to the use-planned segment list 221.

FIG. 29 is a diagram schematically illustrating the use-noticed segment string list 223. In an example shown in FIG. 29, the use-noticed segment string list 223 describes segment strings R11 and R12 for which a use notice is given, sequentially from the rear position of the train toward the advancing direction, and also describes a clock time at which the train is scheduled to use the segment string R11, R12.

The clock time herein means a use-scheduled clock time at which any of the segments included in the segment string is scheduled to be used. For example, in a case where the type of the segment string is "inside", a clock time at which the train is scheduled to stop at the segment corresponding to the track No. where the train will arrive, that is, at the last segment in the segment string, is described. In a case where the type of the segment string is "departure", a clock time at which the train is scheduled to exit the segment corresponding to the track No. where the train currently exists, that is, the first segment of the segment string, is described.

Figure 30:
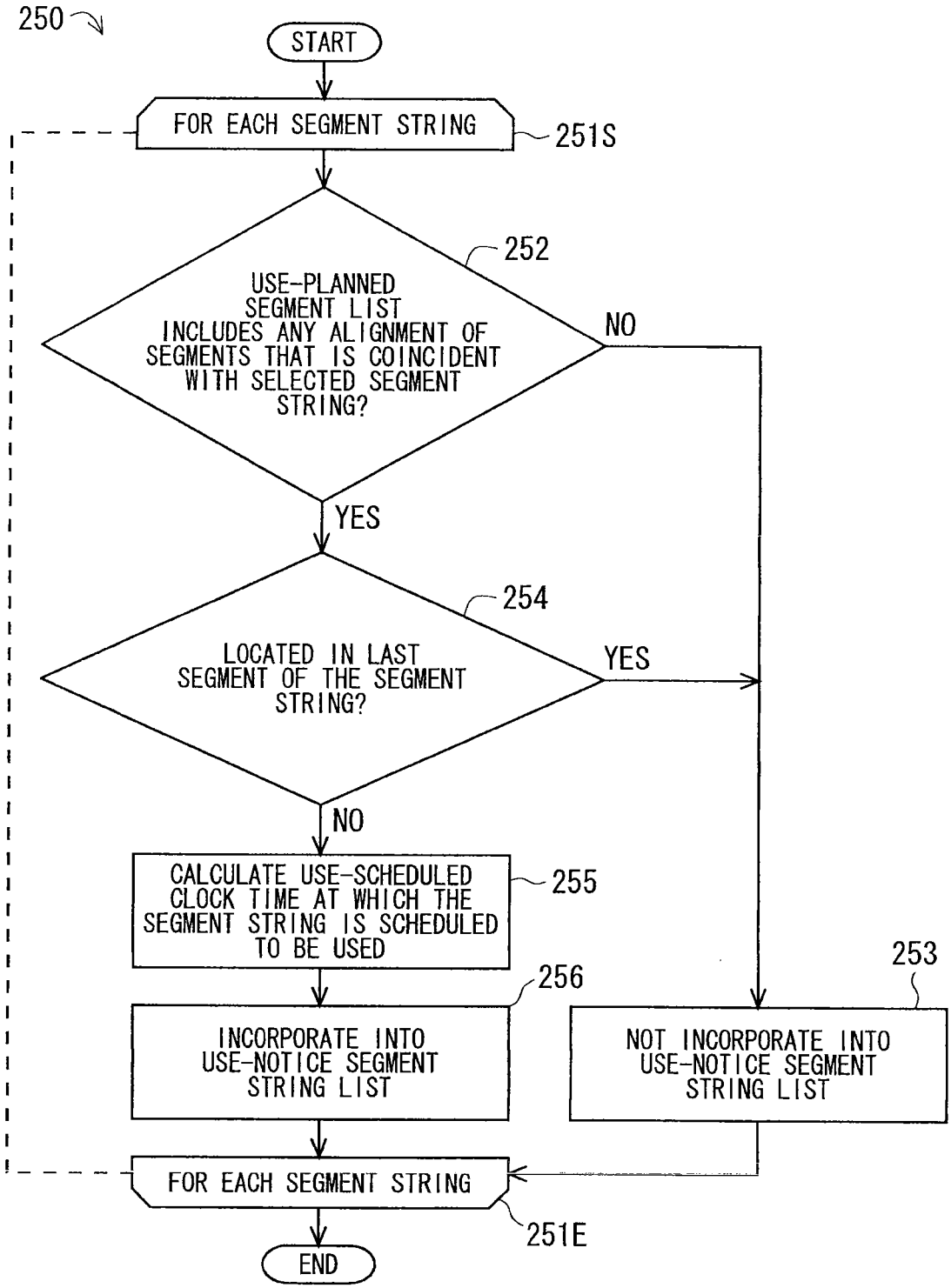
FIG. 30 A flowchart illustrating a use-noticed segment string selection process performed by a use-planned segment configuring part according to the embodiment 6.

FIG. 30 is a flowchart illustrating a use-noticed segment string selection process performed by the use-planned segment configuring part 201.

In a use-noticed segment string selection process 250 illustrated in FIG. 30, a use-noticed segment string is selected based on the use-planned segment list 221 that is prepared for each train. More specifically, one segment string is selected from the segment-string definition information (see FIG. 27) held by the use segment request device 200, and the selected segment string is compared against the use-planned segment list 221 (steps 251S, 251E). Thereby, whether or not each segment string should be incorporated into the use-noticed segment string list 223 is determined.

Firstly, whether or not the use-planned segment list 221 includes any alignment of segments that is coincident with the selected segment string (that is, the processing object segment string), is determined (step 252). Here, an alignment of segments being coincident with a segment string means that the use-planned segment list 221 includes all (or part) of the segments of the segment string and additionally the order in which they are aligned is also coincident. In a case where the coincidence of the alignment is achieved only in part of the segment string, the determination of the coincidence of the alignment of the segments is made if the last segment of the segment string is included in the use-planned segment list 221.

When there is no alignment of segments that is coincident, the processing object segment string is not incorporated into the use-noticed segment string list 223 (step 253), and the process moves to the next segment string (steps 251E, 251S).

When there is any alignment of segments that is coincident, whether or not the train has arrived at an end point of the processing object segment string is determined. To be more specific, whether or not a rear position of the train is located within the last segment among the segments that form the processing object segment string (step 254).

When the train has arrived at the end point of the processing object segment string, the processing object segment string is not incorporated into the use-noticed segment string list (step 253), the process moves to the next segment string (steps 251E, 251S).

When the train has not arrived at the end point of the processing object segment string, a use-scheduled clock time at which the processing object segment string is scheduled to be used is calculated (step 255).

Here, the use-scheduled clock time is described in the schedule data 203, or alternatively the schedule data 203 is described with use of a segment string.

Although the term of use-scheduled clock time is used, the clock time is similarly obtained from the schedule data 203 also in a case where the train has already entered the processing object segment string. In this case, the clock time is a clock time previous to the current clock time.

Then, the processing object segment string is incorporated into the use-noticed segment string list 223 (step 256), and the use-scheduled clock time is set. Then, the process moves to the next segment string (steps 251E, 251S).

The above-described process is performed with respect to all the segment strings included in the segment-string definition information. Thereby, the use-planned segment configuring part 201 prepares the use-noticed segment string list 223.

In the case illustrated herein, the use-planned segment list 221 is firstly prepared, and then, based on the use-planned segment list 221, the use-noticed segment string list 223 is prepared. However, it may be also possible that the lists 221 and 223 are prepared in the reverse order. For example, in a case where the schedule data 203 is described with use of the segment string, the use-planned segment list 221 may be prepared through a process of preparing the segment string list 223 corresponding to currently traveling or travel-scheduled, and then developing a segment from each segment string.

The use-planned segment list 221 and the use-noticed segment string list 223 thus prepared are outputted toward the use-requested segment selecting part 202. As described in the embodiment 1, the use-requested segment selecting part 202 prepares the use-requested segment list 222 based on the use-planned segment 221, and outputs the use-requested segment list 222 as well as the use-noticed segment string list 223 to the transmission device 300.

Similarly to the embodiment 1, the transmission device 300 (more specifically, the vehicle-to-ground transmitting part 302 and the segment use request collecting part 305) outputs the use-requested segment list 222 to the course control device 400. The transmission device 300 outputs the use-requested segment list 222 and the use-noticed segment string list 223 to the anti-deadlock device 900. Although, herein, the use-planned segment list 221 and the use-noticed segment string list 223 are outputted as separate kinds of data, it may be acceptable that the lists 221 and 223 are collected into a single kind of data, and outputted.

<Use Permission for Segment String>

In the anti-deadlock device 900, the segment string use permission setting part 901 refers to the segment-string competition table 902 for the use-requested segment list 222 and the use-noticed segment string list 223 obtained from each train, and thereby modifies the use-requested segment list 222 such that no deadlock occurs against another train. Then, the segment string use permission setting part 901 outputs the use-requested segment list 222 thus modified to the course control device 400. In some case, the use-requested segment list 222 is not modified. Hereinafter, irrespective of whether or not it is modified, the reference sign 222*a* is basically used to refer to the use-requested segment list 222 that the anti-deadlock device 900 outputs to the course control device 400.

Figure 31:
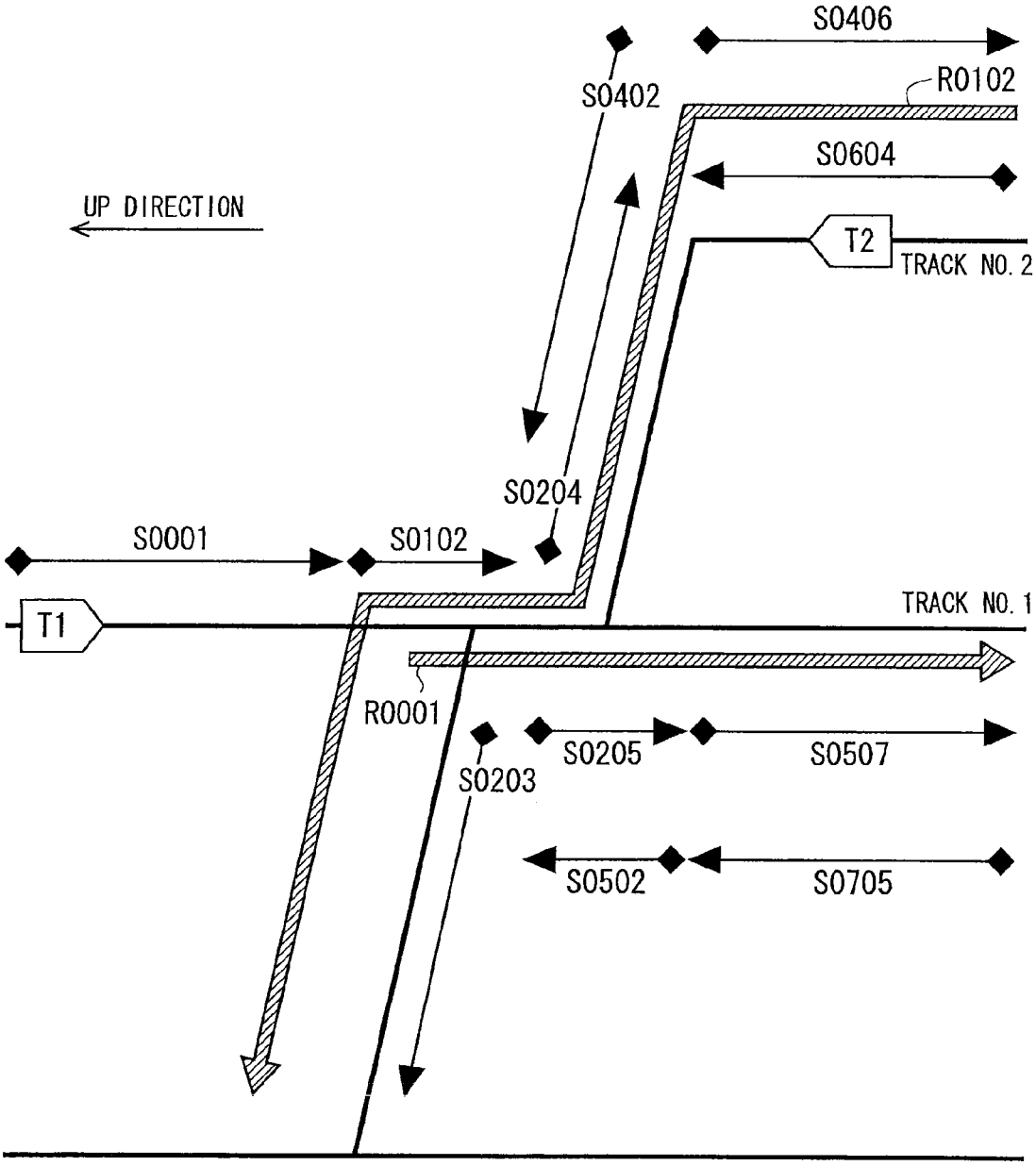
FIG. 31 A diagram schematically showing an outline of a process performed by an anti-deadlock device according to the embodiment 6.
Figure 32:
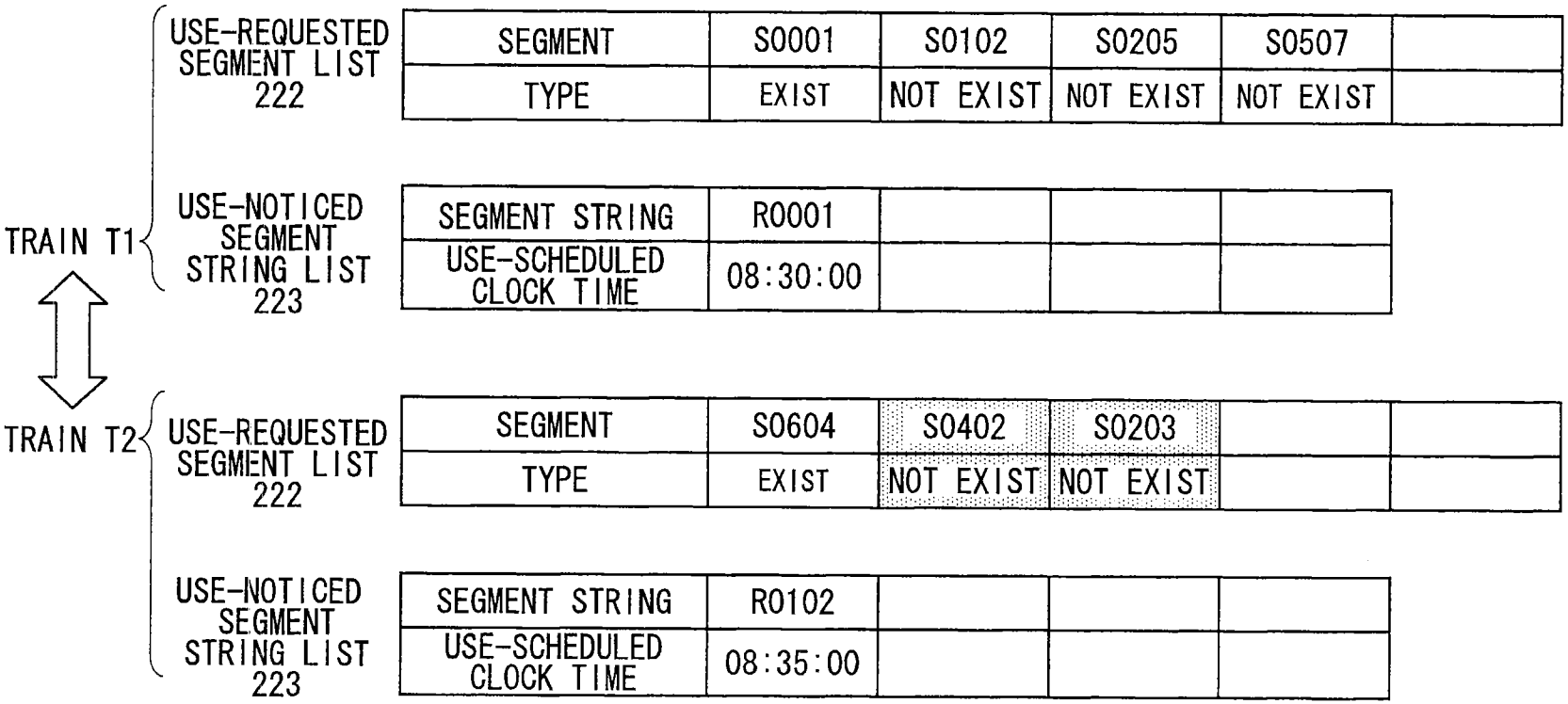
FIG. 32 A diagram schematically showing an outline of the process performed by the anti-deadlock device according to the embodiment 6.

FIGS. 31 and 32 show an image of the operation of the anti-deadlock device 900. The segment string definition and the segment-string competition table are the ones shown in FIGS. 27 and 28, respectively.

In an example shown in FIGS. 31 and 32, the train T1 is scheduled to arrive at the track No. 1 at clock time 8:30. The use segment request device 200 operates to store the four segments S0001, S0102, S0205, and S0507 in the use-requested segment list 222. The segment string R0001 is stored in the use-noticed segment string list 223. Although the segment string may include a segment corresponding the next stop station at the down side of the track No. 1, it is omitted herein.

The train T2 is scheduled to depart from the track No. 2 at clock time 8:35. The three segments S0604, S0402, and S0203 are stored in the use-requested segment list 222. The segment string R0102 is stored in the use-noticed segment string list 223.

In the situation as described with reference to FIG. 24, when the use permission for the segment S0102 is given to the train T1, the use permission for the segment S0402 is given to the train T2, and the trains travel into these segments; a deadlock occurs.

The anti-deadlock device 900 firstly refers to the segment-string competition table 902 for the use-noticed segment string list 223 obtained from each train, and checks the competitive relationship among segment strings. The segment-string competition table 902 shown in FIG. 28 indicates that there is a competitive relationship between the segment string R0001 for which the train T1 gives a use notice and the segment string R0102 for which the train T2 gives a use notice.

Then, in each train use-noticed segment string list 223, the use-scheduled clock time of the segment string is checked, resulting in that the train T1 is scheduled to arrive earlier. Thus, it is necessary that the use permission for the segment is given to each train such that priority is placed on the entry of the train T1.

More specifically, in consideration of prevention of the deadlock, the use permissions for the four segments S0001, S0102, S0205, and S0507 are given to the train T1 as requested, and the use permission for the two segments S0402 and S0203 must not be given to the train T2 until the train T1 arrives at the track No. 1.

In the example shown in FIGS. 31 and 32, the anti-deadlock device 900 deletes the above-mentioned two segments S0402 and S0203 from the use-requested segment list 222 of the train T2, and outputs the use-requested segment list obtained after the deletion, as the use-requested segment list 222*a*, to the course control device 400. As for the train T1, on the other hand, the anti-deadlock device 900 outputs the use-requested segment list 222 with no change, as the use-requested segment list 222*a*, to the course control device 400.

Figure 33:
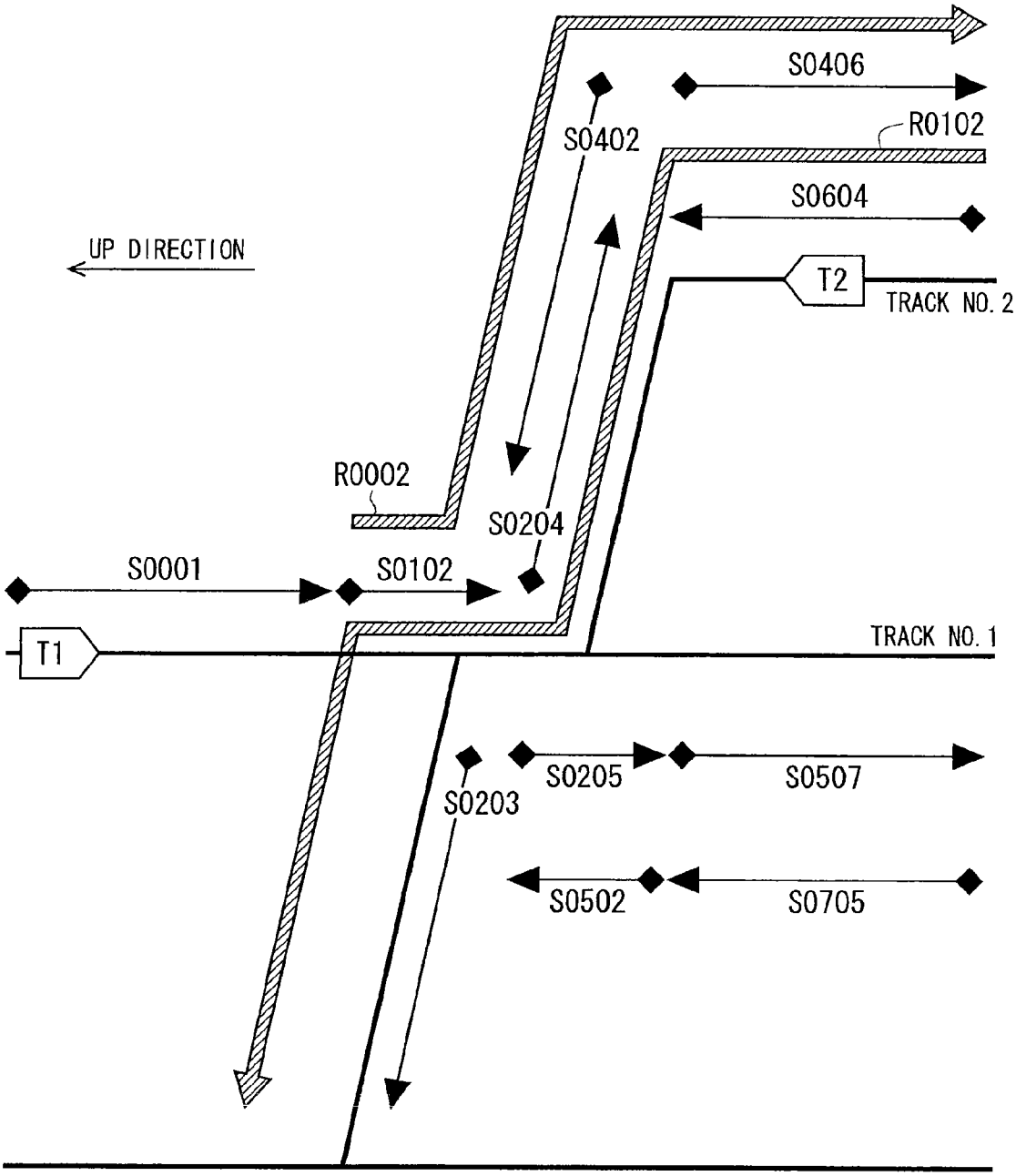
FIG. 33 A diagram schematically showing an outline of the process performed by the anti-deadlock device according to the embodiment 6.
Figure 34:
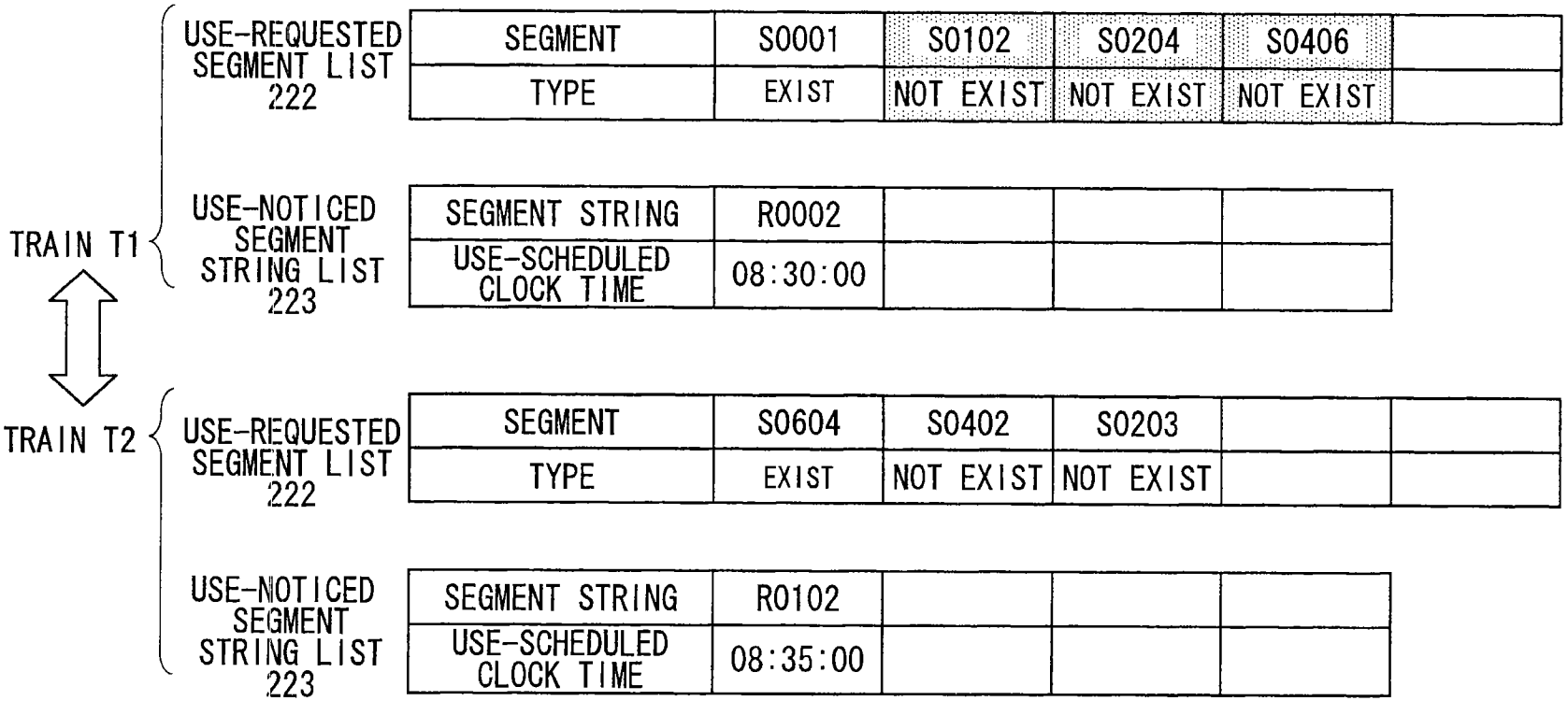
FIG. 34 A diagram schematically showing an outline of the process performed by the anti-deadlock device according to the embodiment 6.

FIGS. 33 and 34 show, with respect to oncoming trains using the same track No, an image of the operation of the anti-deadlock device 900. A track distribution shown in FIG. 33 is the same as that shown in FIG. 31, and the segment string definition and the segment competition table shown in FIG. 33 are also the same as those shown in FIG. 32.

In an example shown in FIGS. 33 and 34, the train T1 is scheduled to arrive at the track No. 2 at clock time 8:30. The use segment request device 200 operates to store the four segments S0001, S0102, S0204, and S0406 in the use-requested segment list 222. The segment string R0002 is stored in the use-noticed segment string list 223.

In the example shown in FIGS. 33 and 34, the departure of the train T2 is delayed due to, for example, disturbance of the train operation, and the train T2 is existing in the track No. 2 where the train T1 is scheduled to arrive. In order that the train T1 can arrive at the track No. 1 as scheduled, it is necessary that the use permission for the segment is given to each train such that priority is placed on the departure of the train T2.

The last segment S0406 of the segment string R0002 noticed by the train T1 is in the competitive relationship with the segment S0604 where the train T2 currently exists. The segment string R0102 noticed by the train T2 is in the competitive relationship with the segment string R0002 noticed by the train T1. Besides, the train T2 exists in the segment S0604 of the segment string R0002 that is noticed. Under such a situation, when the use permission for the segment S0102 is given to the train T1, the use permission for the segment S0402 is given to the train T2, and the trains travel into these segments; a deadlock occurs. Furthermore, as described above, in consideration of the priority on the departure-side train, the use permissions for the three segments S06041, S0402, and S0203 are given to the train T2 as requested, and the use permissions for the three segments S0102, S0204, and S0406 must not be given to the train T1 until the departure of the train T2 from the track No. 2 is completed.

In the example shown in FIGS. 31 and 32, in a case where a competition occurs between segment strings, the segment string use-scheduled clock time of each train is referred to, to determine which of the segment strings is to be prioritized. In the example shown in FIGS. 33 and 34, on the other hand, in a case where another train is going to depart from the track No. at which a train entering the station will arrive, the type of the segment string for which each train is given the use notice is referred to, to determine which of the segment strings is to be prioritized. In the example shown in FIGS. 33 and 34, it is determined that the segment string R0102 having a type of "departure" is to be prioritized.

Accordingly, the anti-deadlock device 900 deletes the above-mentioned three segments S0102, S0204, and S0406 from the use-requested segment list 222 of the train T1, and outputs the use-requested segment list obtained after the deletion, as the use-requested segment list 222*a*, to the course control device 400. As for the train T2, the anti-deadlock device 900 outputs the use-requested segment list 222 with no change, as the use-requested segment list 222*a*, to the course control device 400.

<Process Flow>

Figure 35:
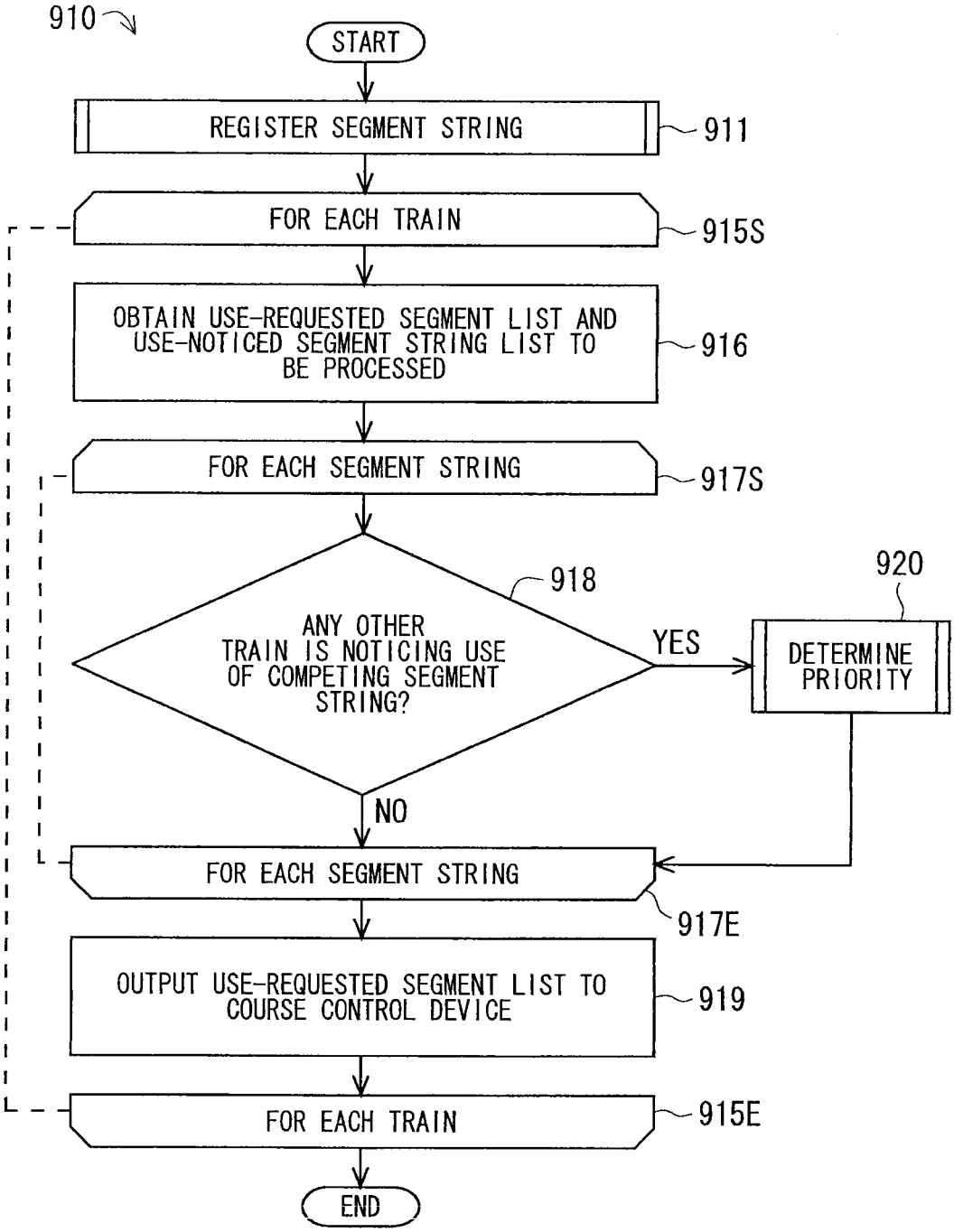
FIG. 35 A flowchart illustrating a use-noticed segment string permission setting process performed by a segment string use permission setting part according to the embodiment 6.

FIG. 35 is a flowchart illustrating a use-noticed segment string permission setting process performed by the segment string use permission setting part 901. In a use-noticed segment string permission setting process 910 illustrated in FIG. 35, firstly, a registration process 911 is performed for registering a segment string noticed by each train.

Figures 36, 37:
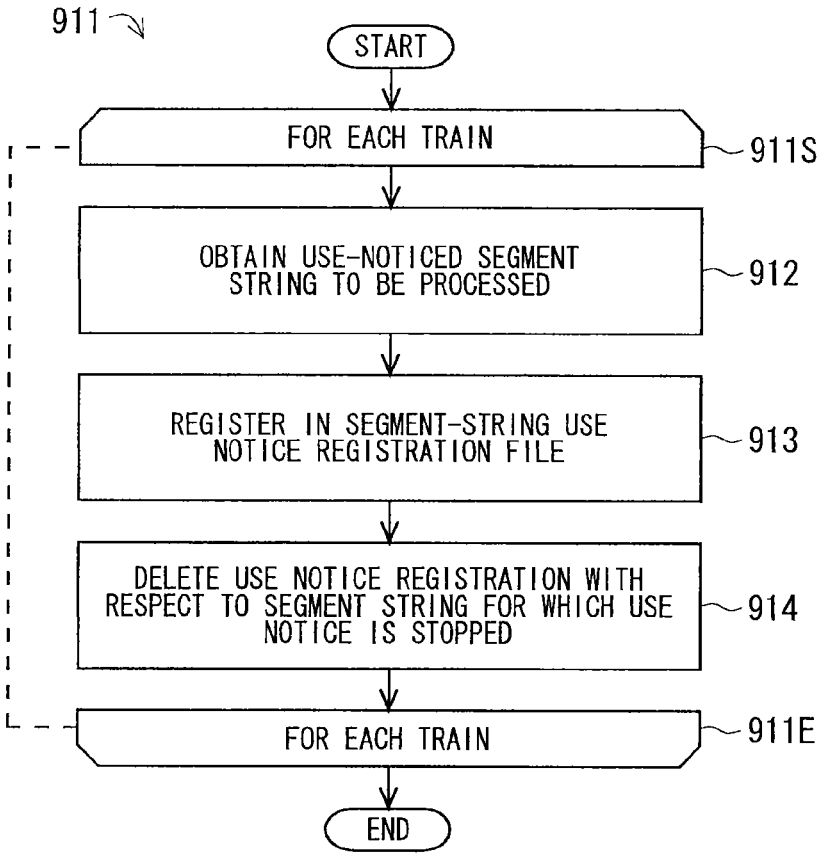
FIG. 36 A flowchart illustrating a segment string registration process performed by the segment string use permission setting part according to the embodiment 6.
FIG. 37 A diagram schematically illustrating a segment-string use notice registration file according to the embodiment 6.

FIG. 36 is a flowchart illustrating details of the segment string registration process 911. FIG. 37 is a diagram schematically illustrating a segment-string use notice registration file 903.

In the segment string registration process 911, a content of the use-noticed segment string list 223 of each train is registered in the segment-string use notice registration file 903 (steps 911S, 911E). Firstly, the use-noticed segment string 223 of a processing object train is obtained (step 912). Then, the content of the use-noticed segment string list 223 is registered in the segment-string use notice registration file 903 (step 913).

Here, the segment-string use notice registration file 903 registers, for an individual segment string stored in the segment-string definition information, a train (train ID) that has given a use notice and a use-scheduled clock time of the train. In an example shown in FIG. 37, information indicating that the train T1 is scheduled to use the segment string R0001 at 8:30 is registered with the segment string R0001, and information indicating that the train T2 is scheduled to use the segment string R0102 at 8:35 is registered with the segment string R0102.

Then, with respect to the segment string for which the train has stopped the use notice, the use notice registration is deleted (step 914). In other words, the train ID and the use-scheduled clock time are deleted with respect to a segment string that has been registered in the segment-string use notice registration file 903 but is not longer included in the use-noticed segment string list 223 of the processing object.

Referring to FIG. 35 again, after the segment string registration process 911 is completed, a priority determination for determining priority of the use-noticed segment string is performed with respect to each train (steps 915S, 915E). Firstly, the use-requested segment list 222 and the use-noticed segment string list 223 of the processing object train are obtained (step 916).

Then, the following process is performed with respect to each segment string in the use-noticed segment string list 223 (steps 917S, 917E). Firstly, whether or not there is any other train that is noticing the use of a segment string that competes with the selected processing object segment string, is checked (step 918). To be more specific, the segment-string competition table 902 and the segment-string use notice registration file 903 are referred to, to determine whether or not another train that is noticing the use of a segment string that competes with the processing object segment string is registered in the segment-string use notice registration file 903. When, as a result of the determination, no such train exists, the process moves to selection of the next segment string (steps 917E, 917S).

Figure 38:
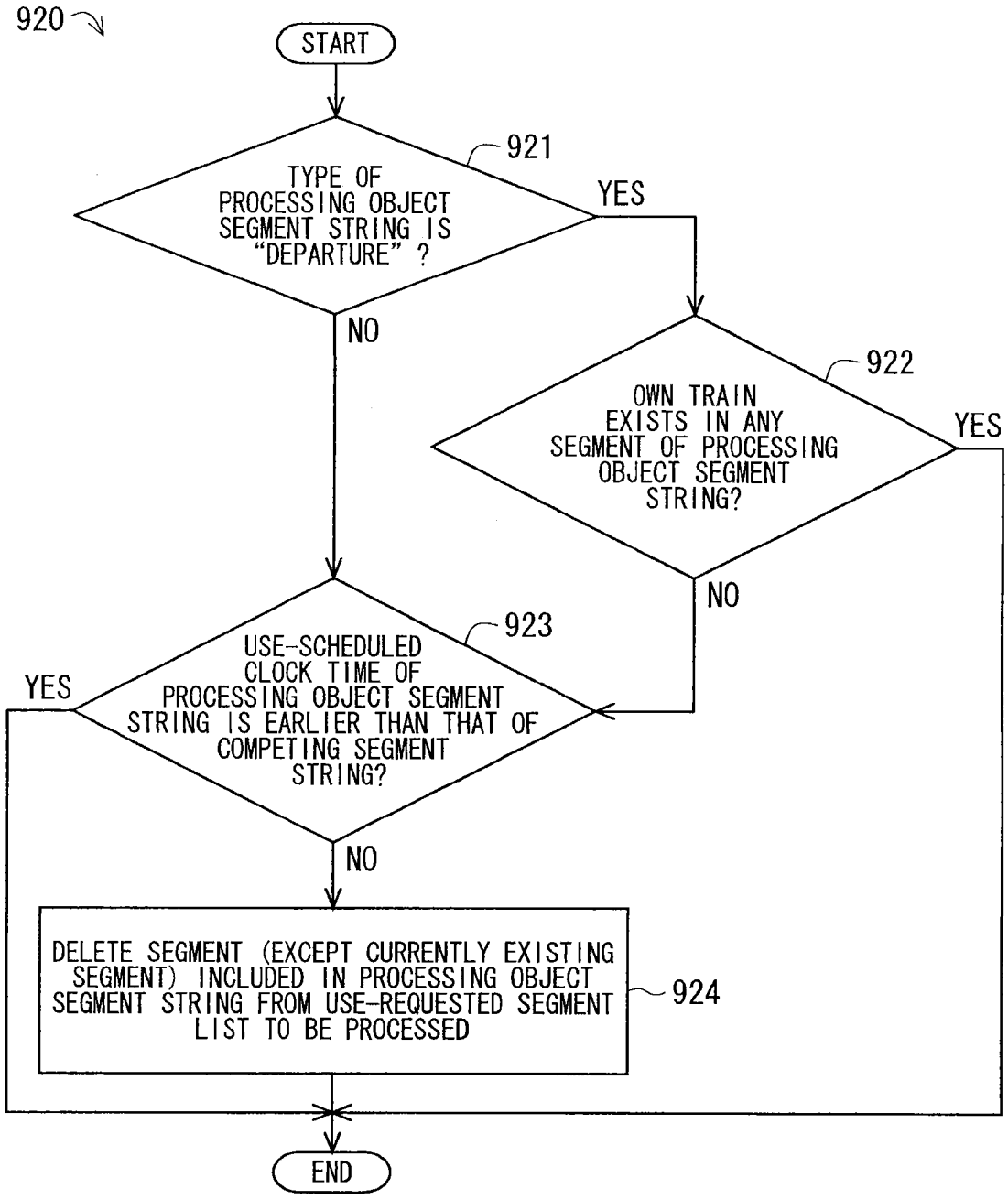
FIG. 38 A flowchart illustrating a priority determination process performed by the segment string use permission setting part according to the embodiment 6.

On the other hand, when it is determined that such a train exists in step 918 (in other words, a segment string competition determination process 918), a priority determination process 920 is performed. FIG. 38 is a flowchart illustrating details of the priority determination process 920. In the priority determination process 920, firstly, the type of the selected processing object segment string is checked (step 921). In a case where the type of the segment string is "departure", whether or not the own train, that is, the train selected in step 915S (see FIG. 35), exists in any segment in the processing object segment string, is checked (step 922). More specifically, the use-requested segment list 222 selected in step 916 (see FIG. 35) is checked, to determine whether or not a segment having a type of "inside" is included in the segment string.

When it is determined that the train exists, the priority determination process 920 on the processing object segment string is terminated (step 917E (see FIG. 35)), and the process moves to selection of the next segment string (step 917S (see FIG. 35)).

When it is determined in step 922 that the train does not exist, and when it is determined in step 921 that the type of the processing object segment string is different from "departure", a use-scheduled clock time of the processing object segment string and a use-scheduled clock time of the competing segment string found in step 918 (see FIG. 35) are checked (step 923).

In a case where the use-scheduled clock time of the processing object segment string is earlier than (or the same clock time as) the use-scheduled clock time of the competing segment string found in step 918 (see FIG. 35), the priority determination process 920 on the processing object segment string is terminated (step 917E (see FIG. 35)), and the process moves to selection of the next segment string (step 917S (see FIG. 35)).

On the other hand, in a case where the use-scheduled clock time of the competing segment string is earlier, a segment whose type is different from "inside" and that is included in the processing object segment string is deleted from the use-requested segment list 222 selected in step 916 (see FIG. 35). Thus, the priority determination process 920 is terminated.

Referring to FIG. 35 again, after the process (steps 917S, 917E) for each segment string is terminated, the use-requested segment list 222*a* obtained as a result of the process is outputted to the course control device 400 (see FIG. 25).

Next, an operation of the course control device 400 in this embodiment 6 will be described. As shown in FIG. 25, the course control device 400 obtains the use-requested segment list 222 from the transmission device 300, and also obtains the use-requested segment list 222*a* from the anti-deadlock device 900.

Figure 39:
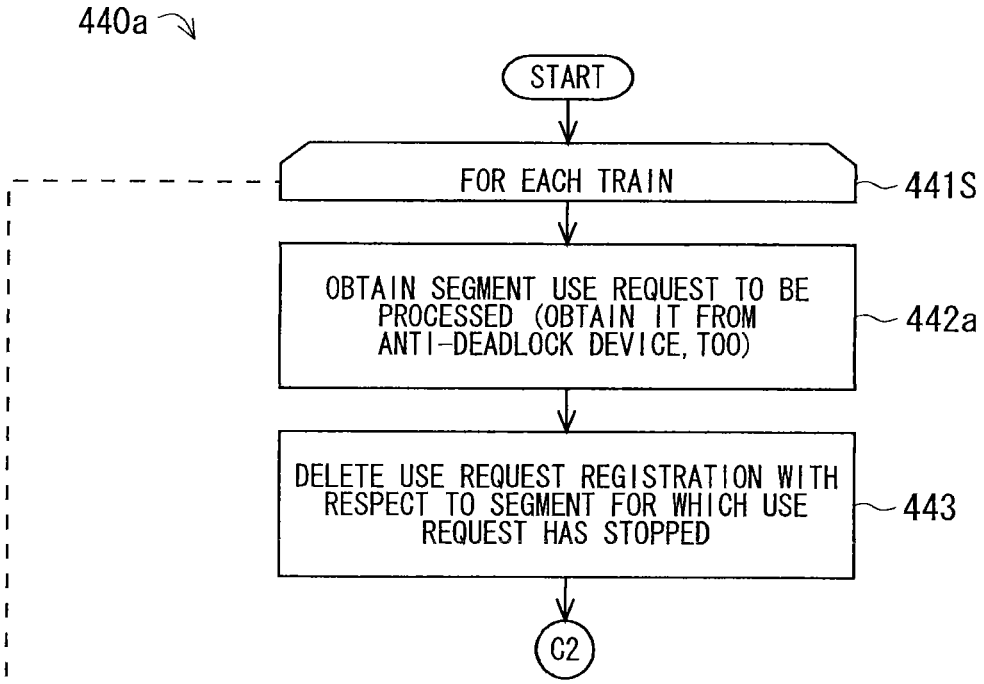
FIG. 39 A flowchart illustrating a process performed by a segment use permission setting part according to the embodiment 6.
Figure 40:
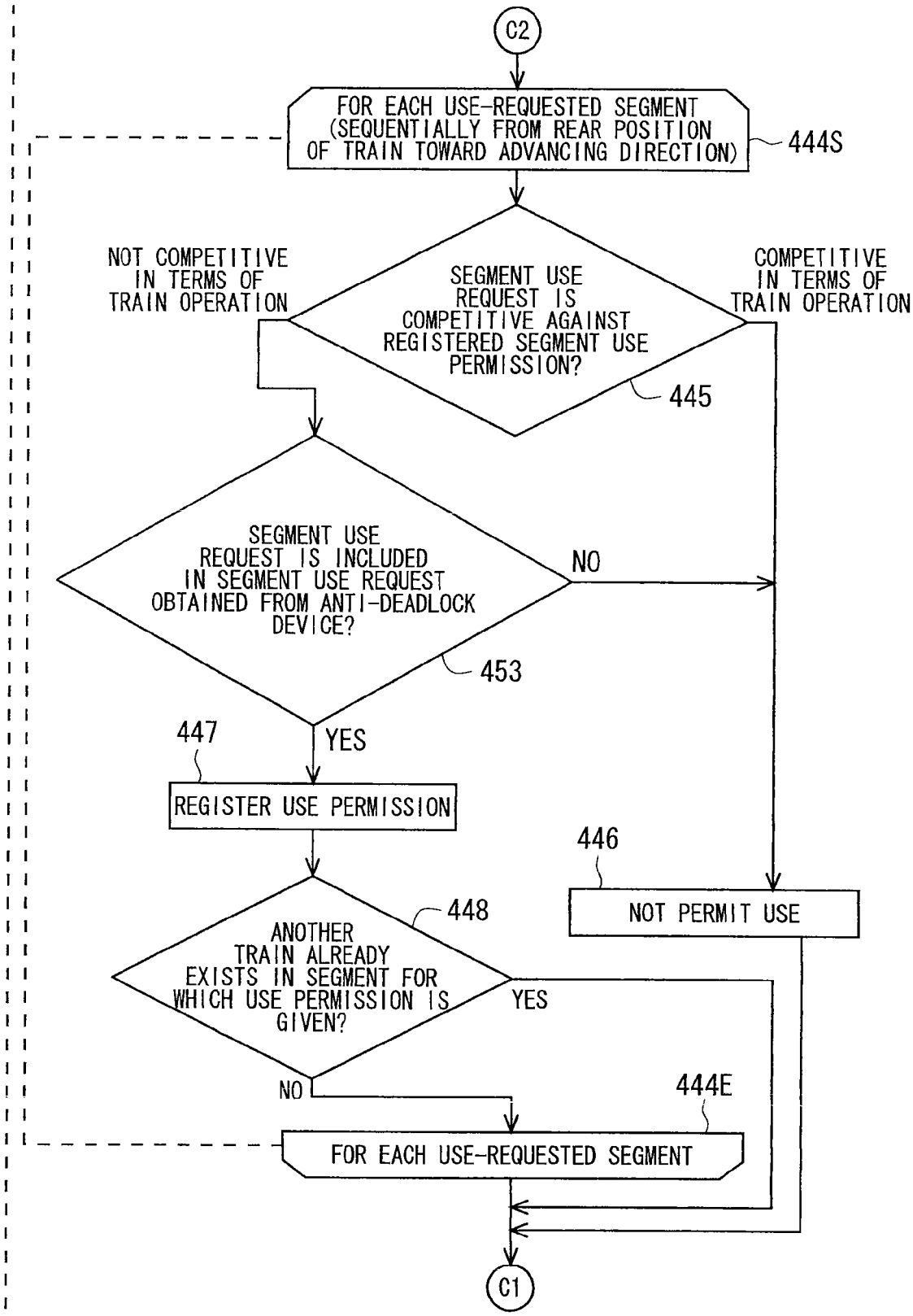
FIG. 40 A flowchart illustrating the process performed by the segment use permission setting part according to the embodiment 6.

FIGS. 39 and 40 show a flowchart illustrating a use permission segment list preparation process 440*a* performed by the segment use permission setting part 401 according to this embodiment 6. A flow shown in FIG. 39 and a flow shown in FIG. 40 are connected via a connector C2, and a flow shown in FIG. 40 and a flow shown in FIG. 12 are connected via a connector C1.

The use permission segment list preparation process 440*a* is basically configured in the same manner as the use permission segment list preparation process 440 (see FIGS. 11 and 12) according to the embodiment 1, except for the following points.

Firstly, in the process (steps 441S, 441E) for each train, step 422*a* (see FIG. 39) is performed instead of step 422 shown in FIG. 11. In step 442*a* of this embodiment 6, as the processing object segment use request, the use-requested segment list 222 is obtained from the transmission device 300 in the same manner as in the embodiment 1, and the use-requested segment list 222*a* is also obtained from the anti-deadlock device 900. Hereinafter, in the process (steps 444S, 444E) for each use-requested segment, similarly to the embodiment 1, a segment is selected from the use-requested segment list 222 obtained from the transmission device 300.

Secondly, step 453 (see FIG. 40) is additionally provided between steps 445, 447 of FIG. 11. That is, when it is determined in step 445 that the use request for the selected segment is not competing in terms of the operation, step 453 that is additionally provided is performed. In step 453, whether or not the corresponding segment is included in the use-requested segment list 222*a* obtained from the anti-deadlock device 900 is determined. When it is determined that the corresponding segment is included, the use permission for the corresponding segment is registered (step 447), while when it is determined that the corresponding segment is not included, the use permission is not given (step 446).

Thus, as a result of the addition of step 453, the use-requested segment that satisfies a condition that the use-requested segment is determined as not competing in terms of the train operation based on the use-requested segment list 222 obtained from each train and a condition that the use-requested segment is included in the use-requested segment list 222*a* obtained from the anti-deadlock device 900, is registered in the segment use permission registration file 404 (step 447). Then, the use-requested segment that satisfies the above-mentioned two conditions is, through step 448 to 452 (see FIGS. 40 and 12) already described, incorporated into the use permission segment list 421.

The subsequent process is the same as the process (see FIGS. 11 and 12) described in the embodiment 1, and a description thereof is omitted.

The operations of an interval control device 5500 and a point-switch control device 600 are the same as those of the embodiment 1, and thus a description thereof is omitted.

In the train operation control system 90F, even when a timing of the segment use request from the train is not in a normal state because of disturbance of the train operation or the like, a deadlock can be prevented.

The anti-deadlock device 900 is provided separately from the course control device 400. That is, in a configuration adopted herein, the output of the transmission device 300 is supplied separately to the anti-deadlock device 900 and to the course control device 400, and the output of the anti-deadlock device 900 is supplied to the course control device 400. In such a configuration, even when the anti-deadlock device 900 breaks down, the course control device 400 is able to implement the train control function. Additionally, even if, due to breakdown or the like, the anti-deadlock device 900 erroneously outputs a use-requested segment list including a segment not requested by the train, the course control device 400 can exclude it. Therefore, even though the anti-deadlock device 900 is attached, an abnormal value is not put into the use permission segment list 421 that will be sent back to the train. Thus, the train can be smoothly controlled.

Embodiment 7

Figure 41:
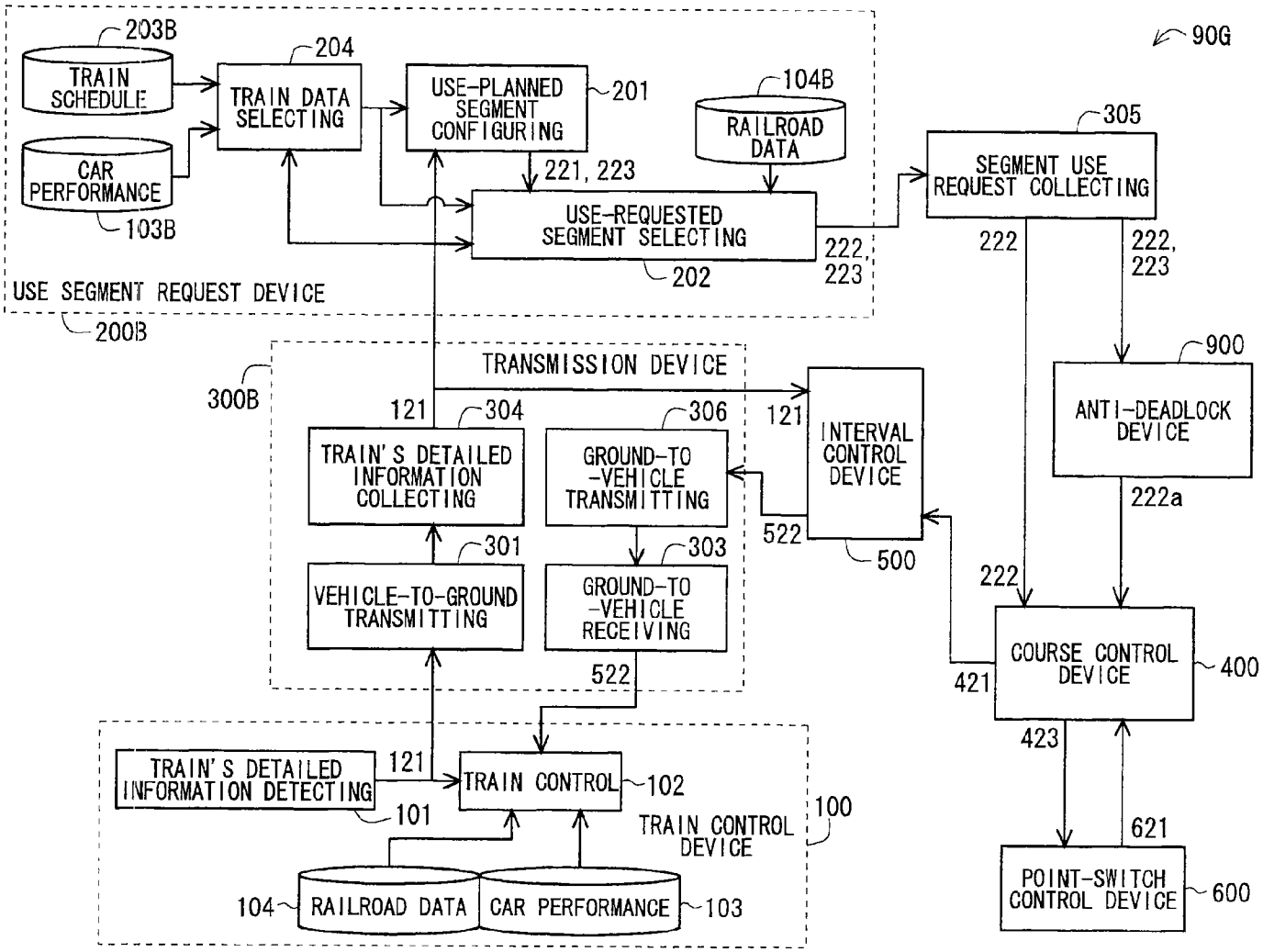
FIG. 41 A block diagram illustrating a configuration of a train operation control system according to an embodiment 7.

FIG. 41 is a block diagram illustrating a configuration of a train operation control system 90G according to an embodiment 7. The train operation control system 90G is basically configured in the same manner as the train operation control system 90B (see FIG. 18) according to the embodiment 2, except for the following points.

The configuration of the train operation control system 90G is different from the configuration of the train operation control system 90B according to the embodiment 2, in that the anti-deadlock device 900 is additionally provided. The train operation control system 90B is modified as appropriate in accordance with the addition of the anti-deadlock device 900.

For example, the use-noticed segment string list 223 is prepared, in the same manner as in the embodiment 6, by the use segment request device 200B gathered on the ground, and transmitted to the anti-deadlock device 900 via the segment use request collecting part 305.

As described in the embodiment 6, the anti-deadlock device 900 outputs, to the course control device 400, the use-requested segment 222*a* that has been modified for each train such that no deadlock occurs against another train.

The train operation control system 90F can simplify the entire system, and also can prevent the deadlock.

The anti-deadlock device 900 is provided separately from the course control device 400. That is, in a configuration adopted herein, the output of the segment use request collecting part 305 is supplied separately to the anti-deadlock device 900 and to the course control device 400, and the output of the anti-deadlock device 900 is supplied to the course control device 400. In such a configuration, even when the anti-deadlock device 900 breaks down, the course control device 400 is able to implement the train control function. Additionally, even if, due to breakdown or the like, the anti-deadlock device 900 erroneously outputs a use-requested segment list including a segment not requested by the train, the course control device 400 can exclude it. Therefore, even though the anti-deadlock device 900 is attached, an abnormal value is not put into the use permission segment list 421 that will be sent back to the train. Thus, the train can be smoothly controlled.

Embodiment 8

Figure 42:
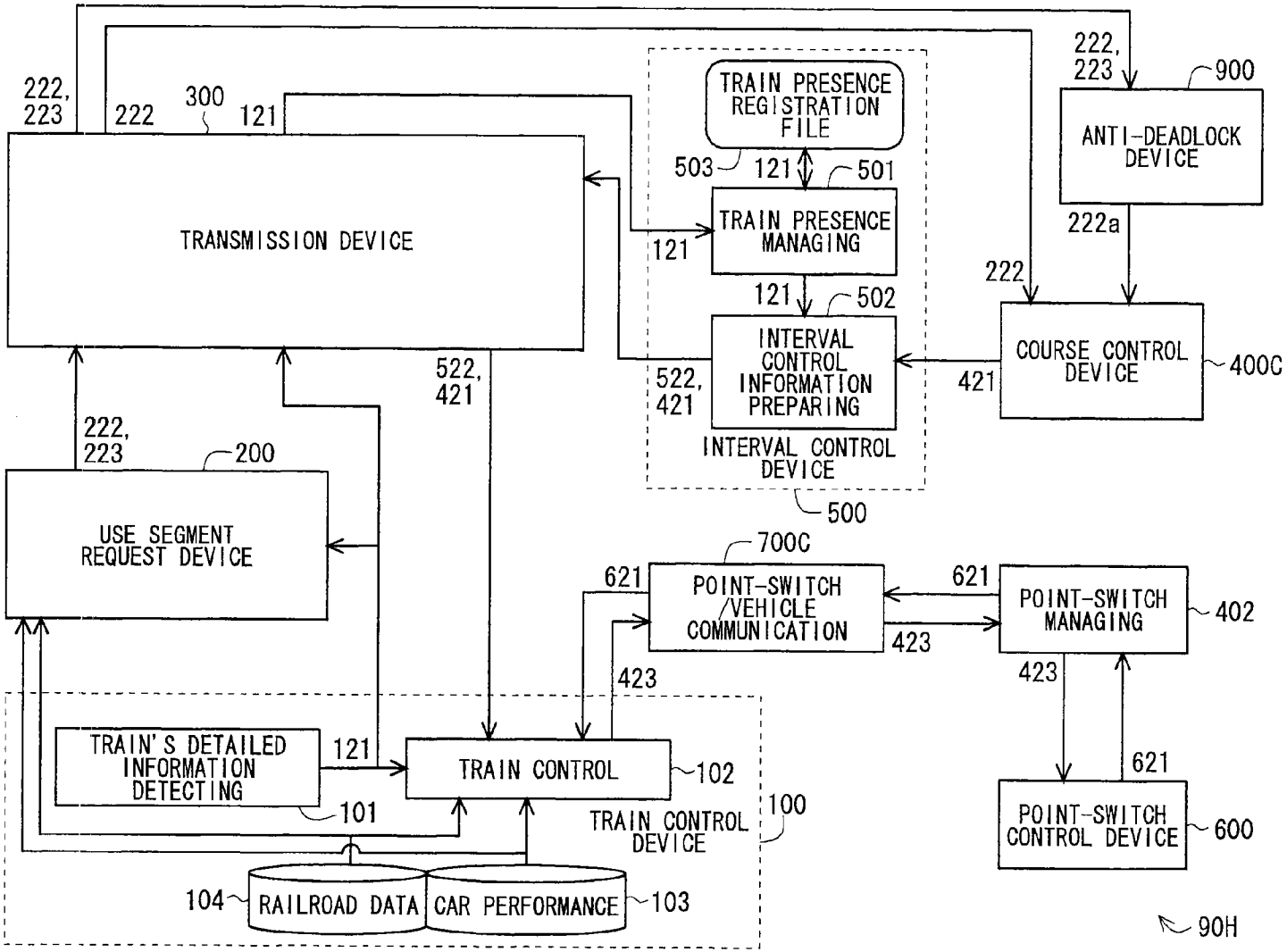
FIG. 42 A block diagram illustrating a configuration of a train operation control system according to an embodiment 8.

FIG. 42 is a block diagram illustrating a configuration of a train operation control system 90H according to an embodiment 8. The train operation control system 90H is basically configured in the same manner as the train operation control system 90C (see FIG. 19) according to the embodiment 3, except for the following points.

The configuration of the train operation control system 90H is different from the configuration of the train operation control system 90C according to the embodiment 3, in that the anti-deadlock device 900 is additionally provided. The train operation control system 90C is modified as appropriate in accordance with the addition of the anti-deadlock device 900.

As described in the embodiment 6, the anti-deadlock device 900 outputs, to the course control device 400C, the use-requested segment 222*a* that has been modified for each train such that no deadlock occurs against another train.

The train operation control system 90H can gather the course control devices corresponding to all the stations to one location, and also can prevent the deadlock.

The anti-deadlock device 900 is provided separately from the course control device 400C. That is, in a configuration adopted herein, the output of the transmission device 300 is supplied separately to the anti-deadlock device 900 and to the course control device 400C, and the output of the anti-deadlock device 900 is supplied to the course control device 400C. In such a configuration, even when the anti-deadlock device 900 breaks down, the course control device 400C is able to implement the train control function. Additionally, even if, due to breakdown or the like, the anti-deadlock device 900 erroneously outputs a use-requested segment list including a segment not requested by the train, the course control device 400C can exclude it. Therefore, even though the anti-deadlock device 900 is attached, an abnormal value is not put into the use permission segment list 421 that will be sent back to the train. Thus, the train can be smoothly controlled.

Embodiment 9

Figure 43:
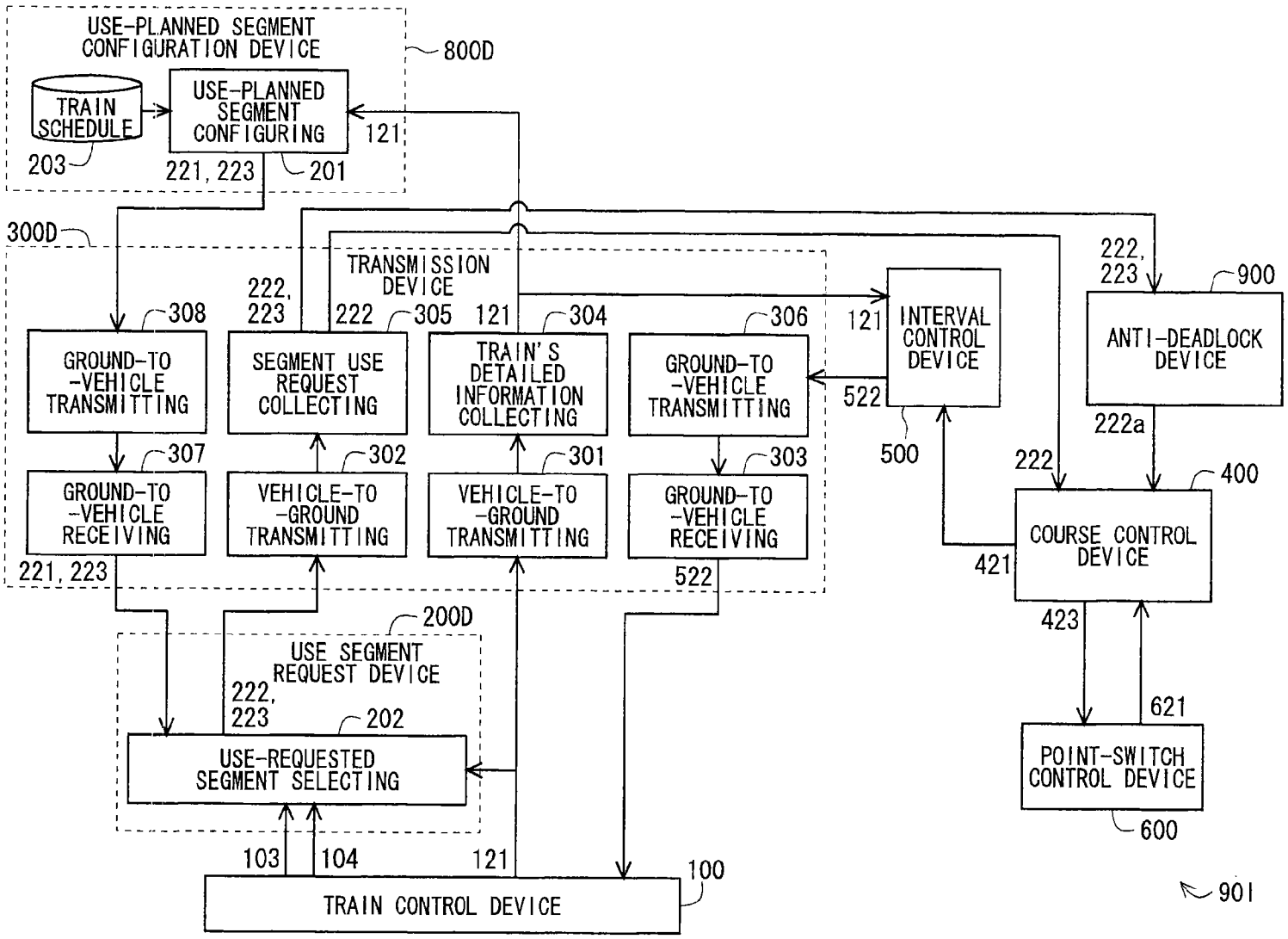
FIG. 43 A block diagram illustrating a configuration of a train operation control system according to an embodiment 9.

FIG. 43 is a block diagram illustrating a configuration of a train operation control system 90I according to an embodiment 9. The train operation control system 90I is basically configured in the same manner as the train operation control system 90D (see FIG. 20) according to the embodiment 4, except for the following points.

The configuration of the train operation control system 90I is different from the configuration of the train operation control system 90D according to the embodiment 4, in that the anti-deadlock device 900 is additionally provided. The train operation control system 90D is modified as appropriate in accordance with the addition of the anti-deadlock device 900.

For example, the use-noticed segment string list 223 is prepared by the use-planned segment configuring part 201 of the use-planned segment configuration device 800D installed on the ground, and transmitted to the anti-deadlock device 900 via the transmission device 300D and the use segment request device 200D.

The train operation control system 90I can simply and flexibly perform the system operation, and also can prevent the deadlock.

Embodiment 10

Figure 44:
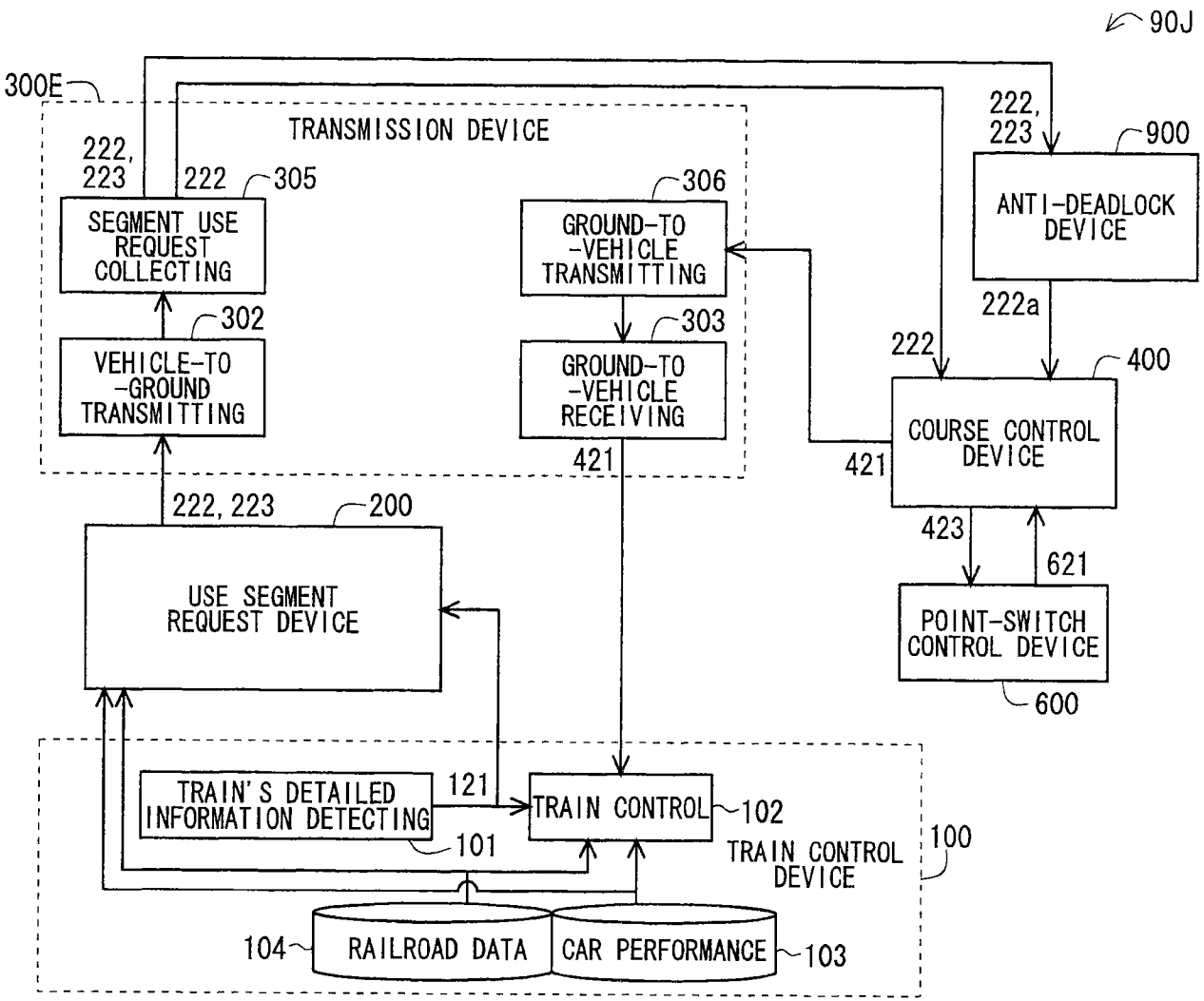
FIG. 44 A block diagram illustrating a configuration of a train operation control system according to an embodiment 10.
Figure 45:
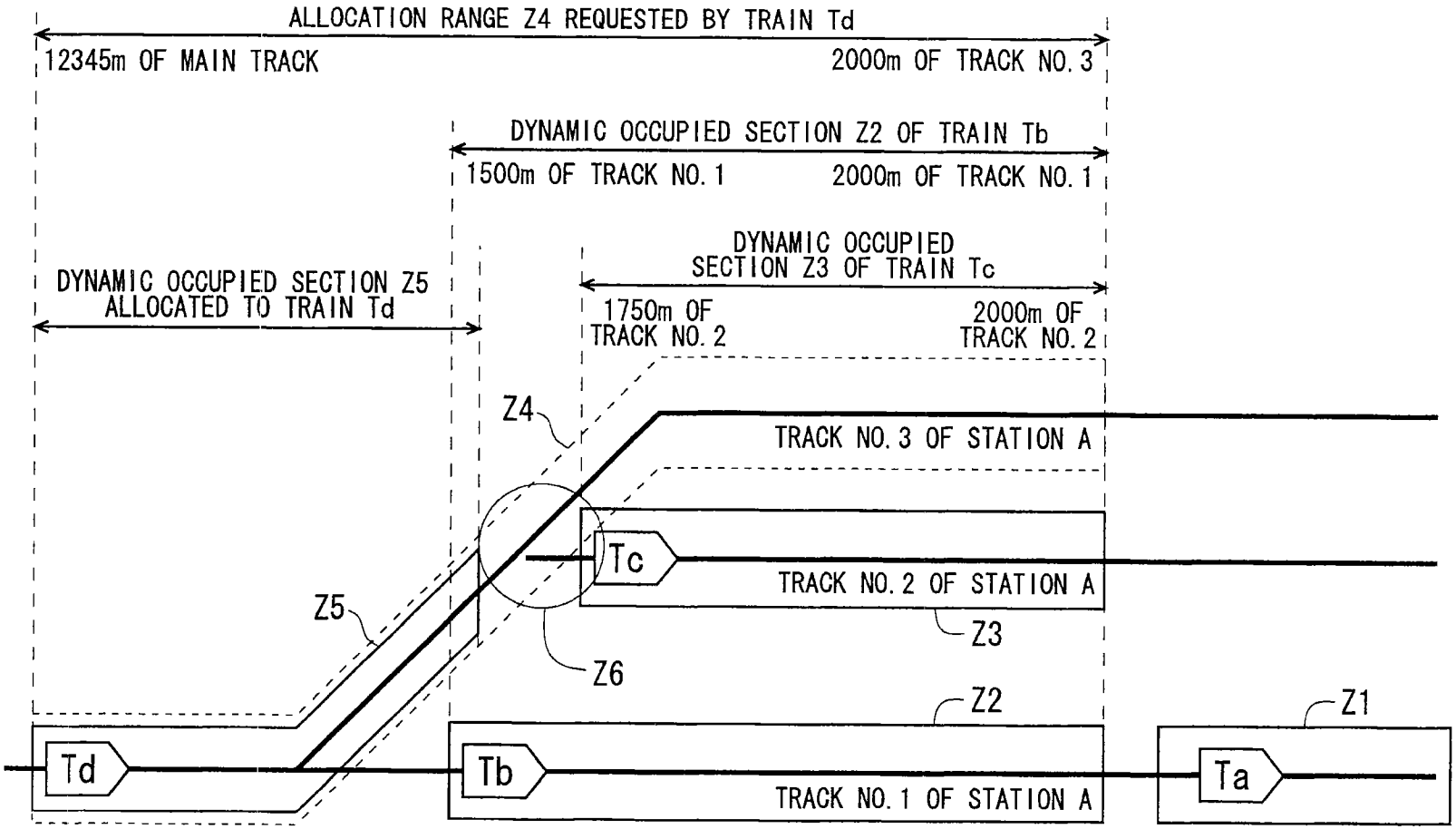
FIG. 45 A diagram schematically showing problems involved in checking of a dynamic occupied section according to the conventional technique.

FIG. 44 is a block diagram illustrating a configuration of a train operation control system 90J according to an embodiment 10. The train operation control system 90J is basically configured in the same manner as the train operation control system 90E (see FIG. 23) according to the embodiment 5, except for the following points.

The configuration of the train operation control system 90J is different from the configuration of the train operation control system 90E according to the embodiment 5, in that the anti-deadlock device 900 is additionally provided. The train operation control system 90E is modified as appropriate in accordance with the addition of the anti-deadlock device 900.

The train operation control system 90J can simplify the entire system, and also can prevent the deadlock.

The anti-deadlock device 900 is provided separately from the course control device 400. That is, in a configuration adopted herein, the output of the transmission device 300E is supplied separately to the anti-deadlock device 900 and to the course control device 400, and the output of the anti-deadlock device 900 is supplied to the course control device 400. In such a configuration, even when the anti-deadlock device 900 breaks down, the course control device 400 is able to implement the train control function. Additionally, even if, due to breakdown or the like, the anti-deadlock device 900 erroneously outputs a use-requested segment list including a segment not requested by the train, the course control device 400 can exclude it. Therefore, even though the anti-deadlock device 900 is attached, an abnormal value is not put into the use permission segment list 421 that will be sent back to the train. Thus, the train can be smoothly controlled.

While the invention has been described in detail, the foregoing description is in all aspects illustrative and not restrictive. It is therefore understood that numerous modifications and variations not illustrated herein can be devised without departing from the scope of the invention.

DESCRIPTION OF THE REFERENCE SIGNS

10 point switch; 12 point-switch protection section; 90, 90B-90J train operation control system; 100 train control device; 101 train's detailed information detecting part; 102 train control part; 103, 103B car performance data storage part, car performance data; 104, 104B railroad data storage part, railroad data; 121 train's detailed information; 200, 200B, 200D use segment request device; 201 use-planned segment configuring part; 202 use-requested segment selecting part; 203, 203B train schedule data storage part, train schedule data; 204 train data selecting part; 221 use-planned segment list (use-planned segment information); 222, 222*a* use-requested segment list (use-requested segment information); 223 use-noticed segment string list (use-noticed segment string information); 240 use-requested segment selection process; 300, 300B, 300D, 300E transmission device; 400, 400C course control device; 401 segment use permission setting part; 402 point-switch managing part; 403 segment competition table storage part (segment competition information storage part), segment competition table (segment competition information); 404 segment use permission registration file storage part (segment use permission status information storage part), segment use permission registration file (segment use permission status information); 421 use permission segment list (use permission segment information); 422 segment travelable state information; 423 point switch control command; 440 use permission segment list preparation process; 445 segment use competition determination process; 470 point switch management process; 500 interval control device; 501 train presence managing part; 502 interval control information preparing part; 503 train presence registration file storage part, train presence registration file; 522 stop limit information; 540 stop limit information preparation process; 600 point-switch control device; 621 point-switch state information; 800D use-planned segment configuration device; 900 anti-deadlock device; 901 segment string use permission setting part; 902 segment-string competition table storage part (segment-string competition information storage part), segment-string competition table (segment-string competition information); 903 segment-string use notice registration file storage part (segment-string use notice information storage part), segment-string use notice registration file (segment-string use notice information); 918 segment string competition determination process; 920 priority determination process; S1-S6, S11-S13, S21-S27, S0001, S0001*a*, S0001*b*, S0102, S0203, S0204, S0205, S0402, S0406, S0406*a*, S0406*b*, S0502, S0507, S0507*a*, S0507*b*, S0604, S0604*a*, S0604*b*, S0705, S0705*a*, S0705*b* segment; R0001, R0002, R0101, R0102 segment string; and T1 to T4 train.

The invention claimed is:

1. A train operation control system that controls operations of a plurality of trains existing on tracks of a railway network, said train operation control system comprising:

a train control device mounted on each train and configured to obtain information of a current position of an own train;

a segment competition information storage part that stores segment competition information prepared by: defining in advance a plurality of segments with respect to said railway network in accordance with a predetermined segment definition rule based on a point-switch protection section, a control direction of a point switch, and an advancing direction of a train; and setting in advance a competitive relationship between said plurality of segments;

a use segment request device configured to, based on information of said current position, select a use-requested segment that is a segment for which a use permission is requested in order to operate a train, and prepare a use-requested segment information;

a segment use permission status information storage part that stores segment use permission status information in which a use permission status of each segment is registered; and a segment use permission setting part configured to: obtain said use-requested segment information from each train; in accordance with a predetermined competition determination process using said segment competition information and said segment use permission status information, determine whether or not a competition for said use-requested segment in terms of the train operation occurs between said plurality of trains; cause said use-requested segment for which it is determined that no competition occurs to be incorporated, as a use permission segment, into use permission segment information of the corresponding train; and update said segment use permission status information in accordance with a result of a competition determination.

2. The train operation control system according to claim 1, wherein even when it is determined that no competition occurs for said use-requested segment, said segment use permission setting part does not incorporate said use-requested segment into said use permission segment information in a case where said use-requested segment is a segment for which traveling is prohibited in accordance with a state of said point switch, said train operation control system further comprises an interval control device configured to, based on said use permission segment information of each train, prepare stop limit information for each train and output said stop limit information to the corresponding train, said stop limit information being information for ensuring an interval with a preceding train, said train control device is configured to control traveling of the own train based on said stop limit information of the own train.

3. The train operation control system according to claim 1, wherein said train control device prepares stop limit information based on said use permission segment information of the own train, and controls traveling of the own train based on said stop limit information, said stop limit information being information for ensuring an interval with a preceding train.

4. The train operation control system according to claim 1, wherein said use segment request device is mounted on each train, and prepares said use-requested segment information of the own train.

5. The train operation control system according to claim 1, wherein said use segment request device is included in an on-ground device, and prepares said use-requested segment information of each train existing on a track.

6. The train operation control system according to claim 1, further comprising:

a train schedule data storage part that stores train schedule data;

a use-planned segment configuring part configured to, based on said train schedule data, select a segment where the train currently exists and a segment where the train is scheduled to travel among said plurality of segments, and prepare use-planned segment information that includes the selected segments as use-planned segments; and a use-requested segment selecting part configured to, through a predetermined selection process, select at least one use-requested segment including said segment where the train currently exists from said use-planned segments, and prepare said use-requested segment information, wherein said use-requested segment selecting part is provided in said use segment request device mounted on each train, said use-planned segment configuring part as well as said train schedule data storage part is included in an on-ground device, and said use-planned segment configuring part prepare said use-planned segment information of each train that currently exists on a track.

7. The train operation control system according to claim 6, wherein with respect to each path located in a portion of said railway network where there is the possibility of occurrence of a deadlock, a segment string is defined in advance, said segment string including a sequence of segments directed to the same direction, said use-planned segment configuring part is configured to prepare use-noticed segment string information that is information concerning a use notice for said segment string and that includes a use-scheduled clock time at which said segment string is scheduled to be used, said train operation control system further comprises an anti-deadlock device for preventing said deadlock, wherein said anti-deadlock device includes:

a segment-string competition information storage part that stores segment-string competition information prepared by setting in advance a competitive relationship between said segment strings;

a segment-string use notice information storage part that stores segment-string use notice information in which a use notice status of each segment string is registered; and a segment string use permission setting part configured to: obtain said use-requested segment information and said use-noticed segment string information from each train; determine whether or not said deadlock occurs between two oncoming trains in accordance with a predetermined segment string competition determination process using said segment-string competition information and said segment-string use notice information, said segment string use permission setting part is configured to:

when it is determined that said deadlock occurs, delete a use request for the segment involved in said deadlock from said use-requested segment information of a low-priority train that is determined in accordance with a predetermined priority determination process, and output said use-requested segment information obtained after the deletion to said segment use permission setting part; and when it is determined that said deadlock does not occur, output said use-requested segment information having no modification given thereto to said segment use permission setting part, said segment use permission setting part incorporates, into said use permission segment information, said use-requested segment that satisfies a condition that said use-requested segment is determined as not competing in terms of a train operation based on said use-requested segment information obtained from each train and a condition that said use-requested segment is included in said use-requested segment information obtained from said anti-deadlock device.

8. The train operation control system according to claim 1, wherein said train control device controls the direction of the point switch corresponding to said use permission segment that is included in said use permission segment information of the own train, in accordance with the definition of the segment corresponding to said point switch.

9. The train operation control system according to claim 1, wherein until a limit clock time from which a brake operation is necessary, said brake operation being for preventing an entry into an unpermitted segment for which no use permission is obtained; said use segment request device does not incorporate said unpermitted segment into said use-requested segment information.

10. The train operation control system according to claim 1, wherein with respect to each path located in a portion of said railway network where there is the possibility of occurrence of a deadlock, a segment string is defined in advance, said segment string including a sequence of segments directed to the same direction, said use segment request device is configured to prepare use-noticed segment string information that is information concerning a use notice for said segment string and that includes a use-scheduled clock time at which said segment string is scheduled to be used, said train operation control system further comprises an anti-deadlock device for preventing said deadlock, wherein said anti-deadlock device includes:

a segment-string competition information storage part that stores segment-string competition information prepared by setting in advance a competitive relationship between said segment strings;

a segment-string use notice information storage part that stores segment-string use notice information in which a use notice status of each segment string is registered; and a segment string use permission setting part configured to: obtain said use-requested segment information and said use-noticed segment string information from each train; determine whether or not said deadlock occurs between two oncoming trains in accordance with a predetermined segment string competition determination process using said segment-string competition information and said segment-string use notice information, said segment string use permission setting part is configured to:

when it is determined that said deadlock occurs, delete a use request for the segment involved in said deadlock from said use-requested segment information of a low-priority train that is determined in accordance with a predetermined priority determination process, and output said use-requested segment information obtained after the deletion to said segment use permission setting part; and when it is determined that said deadlock does not occur, output said use-requested segment information having no modification given thereto to said segment use permission setting part, said segment use permission setting part incorporates, into said use permission segment information, said use-requested segment that satisfies a condition that said use-requested segment is determined as not competing in terms of a train operation based on said use-requested segment information obtained from each train and a condition that said use-requested segment is included in said use-requested segment information obtained from said anti-deadlock device.

* * * * *